US011262044B2

(12) United States Patent
Hwang

(10) Patent No.: US 11,262,044 B2
(45) **Date of Patent: *Mar. 1, 2022**

(54) LIGHTING MODULE AND LIGHTING DEVICE HAVING SAME

(71) Applicant: LG INNOTEK CO., LTD., Seoul (KR)

(72) Inventor: Seong Jin Hwang, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/128,347

(22) Filed: Dec. 21, 2020

(65) Prior Publication Data

US 2021/0108775 A1 Apr. 15, 2021

Related U.S. Application Data

(63) Continuation of application No. 16/843,014, filed on Apr. 8, 2020, now Pat. No. 10,900,633, which is a (Continued)

(30) Foreign Application Priority Data

Apr. 29, 2016 (KR) ..... 10-2016-0053582
May 23, 2016 (KR) ..... 10-2016-0063065
May 23, 2016 (KR) ..... 10-2016-0063076

(51) Int. Cl.
*F21S 43/14* (2018.01)
*F21V 7/09* (2006.01)
(Continued)

(52) U.S. Cl.
CPC ..... *F21S 43/14* (2018.01); *F21K 9/60* (2016.08); *F21S 2/005* (2013.01); *F21S 43/00* (2018.01);
(Continued)

(58) Field of Classification Search
CPC .. F21S 43/14; F21S 43/00; F21S 43/31; F21S 43/26; F21S 2/005; F21V 29/70;
(Continued)

(56) References Cited

U.S. PATENT DOCUMENTS 4,929,866 A * 5/1990 Murata ..... G02B 6/0073 313/500
8,408,751 B2 * 4/2013 Chen ..... F21V 7/005 362/297
(Continued)

FOREIGN PATENT DOCUMENTS

CN 1299029 6/2001
CN 201373334 12/2009
(Continued)

OTHER PUBLICATIONS

International Search Report (with English Translation) and Written Opinion dated Aug. 8, 2017 issued in Application No. PCT/KR2017/004308.
(Continued)

*Primary Examiner* — Mary Ellen Bowman
(74) *Attorney, Agent, or Firm* — KED & Associates, LLP

(57) ABSTRACT

A lighting module disclosed in an embodiment comprises: a plurality of light emitting devices on a substrate; and a reflector arranged in the direction of emission of light from each light emitting device on the substrate. The light emitting device has a light exit surface, and the reflector has a reflecting surface concave toward the substrate, at least a portion of the reflecting surface corresponding to the light exit surface of the light emitting device. The reflecting surface is arranged at a height that increases gradually in proportion to the interval from the light emitting device arranged in the light incident direction. The reflecting surface comprises a plurality of convex portions arranged in a first direction and first bridge portions that connect between
(Continued)

the plurality of convex portions. The first bridge portions are arranged along the convex portions and are arranged to be lower than a straight line that connect high points of adjacent convex portions. The convex portions and the first bridge portions have the same length in a second direction, which is perpendicular to the first direction, and the area of the convex portions may be larger than the area of the first bridge portions.

20 Claims, 27 Drawing Sheets

Related U.S. Application Data continuation of application No. 16/096,022, filed as application No. PCT/KR2017/004308 on Apr. 21, 2017, now Pat. No. 10,648,626.

(51) Int. Cl.

| | |
|---|---|
| ***F21S 43/31*** | (2018.01) |
| ***F21V 7/00*** | (2006.01) |
| ***F21V 7/04*** | (2006.01) |
| ***F21S 43/20*** | (2018.01) |
| ***F21S 43/00*** | (2018.01) |
| ***F21V 29/70*** | (2015.01) |
| ***F21K 9/60*** | (2016.01) |
| ***F21S 2/00*** | (2016.01) |
| ***F21V 15/01*** | (2006.01) |
| ***F21Y 103/10*** | (2016.01) |
| ***F21S 41/33*** | (2018.01) |
| ***F21Y 115/10*** | (2016.01) |
| ***F21S 41/148*** | (2018.01) |
| ***F21S 45/47*** | (2018.01) |
| ***F21S 41/151*** | (2018.01) |
| ***F21S 41/36*** | (2018.01) |

(52) U.S. Cl.

CPC ..... *F21S 43/26* (2018.01); *F21S 43/31* (2018.01); *F21V 7/0083* (2013.01); *F21V 7/048* (2013.01); *F21V 7/09* (2013.01); *F21V 15/01* (2013.01); *F21V 29/70* (2015.01); *F21S 41/148* (2018.01); *F21S 41/151* (2018.01); *F21S 41/337* (2018.01); *F21S 41/36* (2018.01); *F21S 45/47* (2018.01); *F21Y 2103/10* (2016.08); *F21Y 2115/10* (2016.08)

(58) Field of Classification Search

CPC ..... F21V 7/0083; F21V 7/048; F21V 7/09; F21V 15/01; F21K 9/60

See application file for complete search history.

(56) References Cited

U.S. PATENT DOCUMENTS

| | | | | |
|---|---|---|---|---|
| 10,648,626 | B2 * | 5/2020 | Hwang | F21K 9/60 |
| 2001/0003506 | A1 | 6/2001 | Natsume | |
| 2008/0062714 | A1 | 3/2008 | Kim et al. | |
| 2010/0296266 | A1 | 11/2010 | Dussault et al. | |
| 2014/0055994 | A1 | 2/2014 | Kang et al. | |
| 2014/0340908 | A1 | 11/2014 | Hyun et al. | |
| 2015/0036335 | A1 * | 2/2015 | Liu | F21V 7/005 362/235 |
| 2017/0276320 | A1 | 9/2017 | Zhou et al. | |

FOREIGN PATENT DOCUMENTS

| | | |
|---|---|---|
| CN | 103629570 | 3/2014 |
| CN | 105156950 | 12/2015 |
| DE | 10-2010-056312 | 6/2012 |
| EP | 1901112 | 3/2008 |
| EP | 2792942 | 10/2014 |
| JP | 2010-108900 | 5/2010 |
| KR | 10-2010-0068436 | 6/2010 |
| KR | 10-1487383 | 1/2015 |
| KR | 10-2016-0028687 | 3/2016 |
| WO | WO 2005/055328 | 6/2005 |

OTHER PUBLICATIONS

European Search Report dated Mar. 1, 2019 issued in Application No. 17789854.1.

U.S. Notice of Allowance dated Jan. 14, 2020 issued in U.S. Appl. No. 16/096,022.

Chinese Office Action dated Jun. 1, 2020 issued in Application No. 201780026638.4.

European Search Report dated Oct. 9, 2020 issued in Application No. 20174834.0.

U.S. Office Action dated Jun. 22, 2020 issued in U.S. Appl. No. 16/843,014.

* cited by examiner

LIGHTING MODULE AND LIGHTING DEVICE HAVING SAME

CROSS-REFERENCE TO RELATED PATENT APPLICATIONS

This application is a Continuation of U.S. patent application Ser. No. 16/843,014, filed Apr. 8, 2020, which is a continuation of U.S. patent application Ser. No. 16/096,022, filed Oct. 24, 2018 (U.S. Pat. No. 10,648,626, issued on May 12, 2020), which is a U.S. National Stage Application under 35 U.S.C. § 371 of PCT Application No. PCT/KR2017/004308, filed Apr. 21, 2017, which claims priority to Korean Patent Application Nos. 10-2016-0053582, filed Apr. 29, 2016, 10-2016-0063065, filed May 23, 2016 and 10-2016-0063076 filed May 23, 2016, whose entire disclosures are hereby incorporated by reference.

TECHNICAL FIELD

Embodiments relate to a lighting module illuminating a surface light source.

Embodiments relate to a lighting device having a lighting module.

Embodiments relate to a vehicle lighting module and a lighting device having the same.

BACKGROUND ART

Conventional lighting applications include not only a vehicle lighting but also a backlight for a display and a signage.

A light emitting device, for example, a light emitting diode (LED) has advantages such as low power consumption, semi-permanent lifetime, fast response speed, safety, environmental friendliness compared to conventional light sources such as fluorescent lamps and incandescent lamps. Such an LED has been applied to various lighting devices such as various display devices, indoor lights or outdoor lights, or the like.

Recently, a lamp employing an LED has been proposed as a vehicle light source. Compared to incandescent lamps, an LED has an advantage in low power consumption. However, since an emitting angle of light emitted from an LED is small, when the LED is used as a vehicle lamp, it is required to increase a light-emitting area of a lamp using the LED.

Since a size of an LED is small, it is possible to increase a degree of freedom of design of a lamp, and the LED has economic efficiency due to the semi-permanent lifetime.

Technical Problem

An embodiment provides a lighting module having a surface light source by using a plurality of light emitting devices and reflectors.

An embodiment provides a lighting module in which light uniformity of a surface light source is improved by using a reflector reflecting light emitted from each of the plurality of light emitting devices.

An embodiment provides a lighting module in which a reflective surface of the reflector corresponding to each of the plurality of light emitting devices has an inclined surface or a curved surface.

An embodiment provides a lighting module having a reflector in which concave portions and convex portions are alternately disposed at a surface of a reflective surface, and a lighting device having the same.

An embodiment provides a lighting module having a surface light source by using a plurality of light emitting devices and reflectors.

An embodiment provides a lighting module in which light uniformity of a surface light source is improved by using a reflector reflecting light emitted from each of the plurality of light emitting devices in an upward direction.

An embodiment provides a lighting module in which a reflective surface of the reflector corresponding to each of the plurality of light emitting devices has an inclined surface or a curved surface.

An embodiment provides a lighting module having a reflector in which concave portions and convex portions are alternately disposed at a surface of a reflective surface, and a lighting device having the same.

Technical Solution

A lighting module according to an embodiment includes: a substrate; a plurality of light emitting devices disposed on the substrate; and a reflector disposed in a light-emitting direction of each of the plurality of light emitting devices on the substrate, wherein the light emitting device has an exit surface emitting light, the reflector has a reflective surface concave toward the substrate, at least a portion of which corresponds to the exit surface of the light emitting device, the reflective surface is disposed at a gradually higher height as it is farther from the light emitting device disposed in an incident direction, the reflective surface includes a plurality of convex portions arranged in a first direction and first bridge portions connecting between the plurality of convex portions, the first bridge portions are disposed along the convex portions, the first bridge portions are disposed to be lower than a straight line connecting high points of adjacent convex portions, the convex portions and the first bridge portions have the same length in a second direction orthogonal to the first direction, and an area of the convex portions may be larger than that of the first bridge portions.

A lighting module according to an embodiment includes: a substrate; a plurality of light emitting devices disposed on the substrate and having an exit surface adjacent to an upper surface of the substrate; and a reflector disposed in a light-emitting direction of each of the plurality of light emitting devices, wherein the reflector includes a reflective surface corresponding to the exit surface of each of the light emitting devices, the reflective surface includes a plurality of reflection cells arranged in a vertical direction and a bridge portion having a width smaller than a longitudinal width of the reflection cell between the plurality of reflection cells, each of the reflection cells includes convex portions adjacent to the light emitting device and concave portions disposed between the convex portions and the bridge portion, and the reflective surface has a concave negative curvature which is lower than a line segment connecting opposite edges and a gradually higher height as it is farther from the light emitting device.

A lighting device according to an embodiment includes: a substrate, a plurality of light emitting devices disposed on the substrate, and a lighting module having a reflector disposed in a light-emitting direction of the plurality of light emitting devices; a housing having a receiving space in which an upper portion is opened and in which the lighting module is disposed; and an optical member disposed on the lighting module, wherein the reflector is disposed on the substrate and includes a reflective surface corresponding to an exit surface of each of the light emitting devices, the reflective surface includes a plurality of reflection cells arranged in a vertical direction and a bridge portion having a width smaller than a longitudinal width of the reflection cell between the plurality of reflection cells, each of the reflection cells includes convex portions adjacent to the light emitting device and concave portions disposed between the convex portions and the bridge portion, and the reflective surface has a concave negative curvature which is lower than a line segment connecting opposite edges and a gradually higher height as it is farther from the light emitting device.

A lighting module according to an embodiment includes: a substrate; a plurality of light emitting devices disposed on the substrate and having an exit surface adjacent to an upper surface of the substrate; and a reflector disposed in a light-emitting direction of each of the plurality of light emitting devices, wherein the reflector includes a first reflective surface corresponding to the exit surface of each of the light emitting devices, second and third reflective surfaces disposed at opposite outer sides of the first reflective surface, the first to third reflective surfaces include a plurality of reflection cells having convex portions and concave portions, the reflector includes a first bridge portion that vertically separates the reflection cells, and a second bridge portion that horizontally separates the reflection cells, the first reflective surface has a gradually higher height as it is farther from the light emitting device, and the second and third reflective surfaces are disposed to face each other at opposite sides of the first reflective surface.

A lighting device according to an embodiment includes: a substrate, a plurality of light emitting devices on the substrate, and a lighting module having a reflector disposed in a light-emitting direction of the plurality of light emitting devices; a housing having a receiving space in which an upper portion is opened and in which the lighting module is disposed; and an optical member disposed on the lighting module, wherein the reflector is disposed on the substrate and includes a first reflective surface corresponding to an exit surface of each of the light emitting devices, second and third reflective surfaces disposed at opposite outer sides of the first reflective surface, the first to third reflective surfaces include a plurality of reflection cells having convex portions and concave portions, the reflector includes a first bridge portion that vertically separates the reflection cells, and a second bridge portion that horizontally separates the reflection cells, the first reflective surface has a gradually higher height as it is farther from the light emitting device, and the second and third reflective surfaces are disposed to face each other at opposite sides of the first reflective surface.

A lighting module according to an embodiment includes: a substrate; a plurality of light emitting devices disposed on the substrate and having an exit surface adjacent to an upper surface of the substrate; and a reflector disposed at each of the plurality of light emitting devices, wherein the reflector includes a reflective surface corresponding to the exit surface of each of the light emitting devices and having a concave curved surface or an inclined surface.

According to an embodiment, the reflective surface may include a concave portions arranged between the convex portions and the first bridge portions in a first direction, and the convex portion may include a convex curved surface.

According to an embodiment, the reflective surface may include a plurality of second bridge portions disposed in the first direction, the concave portions may include an inclined surface or a curved surface, the concave portions and the first bridge portions may have the same length in a second direction, and the plurality of second bridge portions may cross the first bridge portions.

According to an embodiment, the reflective surface may have a deeper depth as it is adjacent to a center portion, the depth may be an interval in a straight line connecting opposite edges in the first direction and opposite edges in the second direction, the first bridge portions may have a number smaller than that of the convex portions arranged in the first direction, and an interval between the first bridge portions may be the same or may be gradually narrower as it is farther from the light emitting device.

According to an embodiment, the reflective surface of the reflector may include an open region in which a lower region adjacent to the light emitting device is opened in an incident direction, wherein a length in the second direction may be greater than that in the first direction in the open region, and a length of the open region in the second direction may be greater than that of the light emitting device in the second direction.

According to an embodiment, the open region may have a recess corresponding to a center portion of the exit surface of the light emitting device, wherein the recess may be recessed deeper in an emission direction of the light emitting device, and a maximum length of the recess in the second direction may be smaller than a length of the light emitting device in the second direction.

According to an embodiment, an interval between the plurality of light emitting devices may be disposed to be longer than a bottom length of the reflector disposed between the light emitting devices, wherein an inner portion of the reflector may be spaced apart from the substrate, and the reflector may be formed of a resin material and may have a support sidewall supported at the substrate.

According to an embodiment, a portion of the reflector may connect between the reflectors or may be disposed to be overlapped with the light emitting device.

According to an embodiment, a lower end of the reflective surface may be disposed to be lower than an optical axis of the light emitting device, or may be disposed to be lower than the upper surface of the substrate.

According to an embodiment, the reflector may have a coupling portion protruding toward the substrate.

Advantageous Effects

According to a lighting module according to an embodiment, luminous intensity of a surface light source may be improved.

According to a lighting module according to an embodiment, light uniformity of a surface light source may be improved.

An embodiment may not use a molding member between reflectors, thereby reducing a loss of light.

In a lighting module and a lighting device having the same according to an embodiment, optical reliability may be improved.

In a vehicle lighting device having a lighting module according to an embodiment, reliability may be improved.

DESCRIPTION OF DRAWINGS

FIG. 11 (*b*) is a view illustrating an example of a C-C side cross section of a reflection cell in FIG. 9.

MODES OF THE INVENTION

Figure 1:
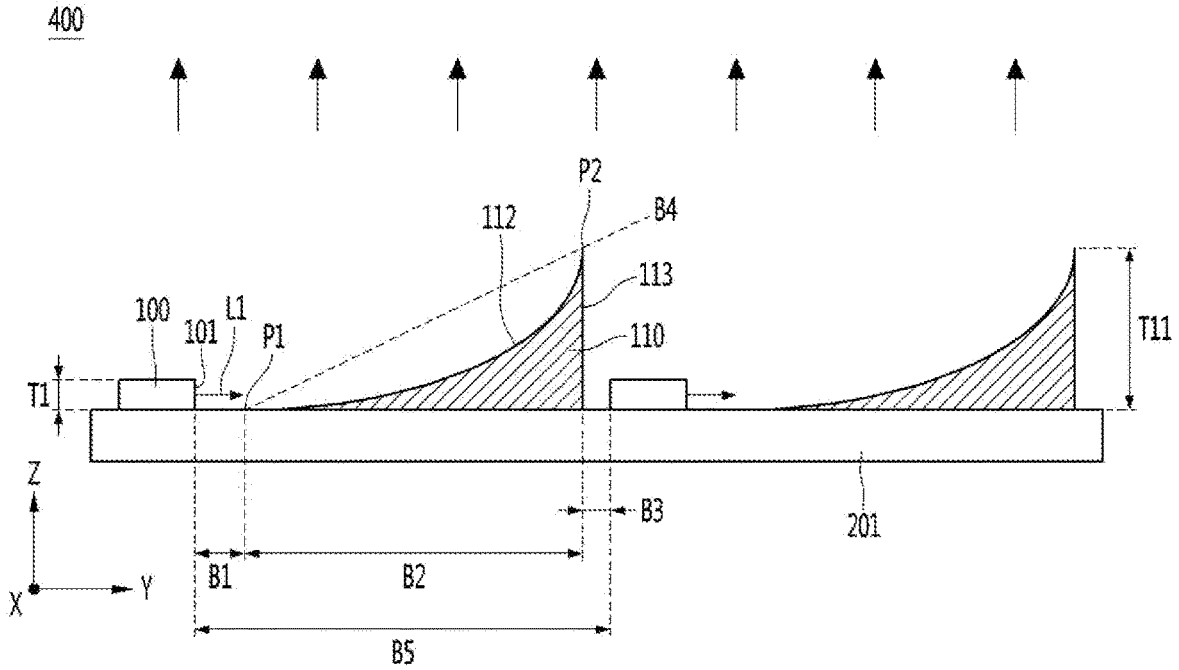
FIG. 1 is a side cross-sectional view of a lighting module according to a first embodiment.

Hereinafter, preferred embodiments of the present invention will be described in detail with reference to the accompanying drawings, in which a person having ordinary skill in the art to which the present invention pertains can easily implement the present invention. However, it should be understood that embodiments described in the specification and configurations illustrated in the drawings are merely a preferred embodiment of the present invention, and there are various equivalents and modifications that can substitute the embodiments and configurations at the time of filing the present application.

In describing operating principles of a preferred embodiment of the present invention in detail, when detailed description of a known function or configuration is deemed to unnecessarily blur the gist of the present disclosure, the detailed description will be omitted. Terms to be described below are defined as terms defined in consideration of functions of the present invention and meaning of each term should be interpreted based on the contents throughout the specification. The same reference numerals are used for parts having similar functions and actions throughout the drawings.

A lighting device according to the present invention may be applied to various lamp devices requiring lighting, for example, a vehicle lamp, a home lighting device, or an industrial lighting device. For example, when a lighting device is applied to a vehicle lamp, it may be applied to a head lamp, a side mirror lamp, a fog lamp, a tail lamp, a stop lamp, a side marker lamp, a daytime running light, a vehicle interior lighting, a door scarf, rear combination lamps, a backup lamp, and the like. The lighting device of the present invention may also be applied to indoor and outdoor advertisement apparatus fields, and also may be applicable to all other lighting-related fields and advertisement-related fields that are currently being developed and commercialized or that may be implemented by technological development in the future.

Hereinafter, embodiments will be shown more apparent through the description of the appended drawings and embodiments. In the description of the embodiments, in the case in which each layer (film), area, pad or pattern is described as being formed "on" or "under" each layer (film), area, pad or pattern, the "on" and "under" include both of forming "directly" and "indirectly". Also, the reference for determining "on" or "under" each layer will be described based on the figures.

Figure 2:
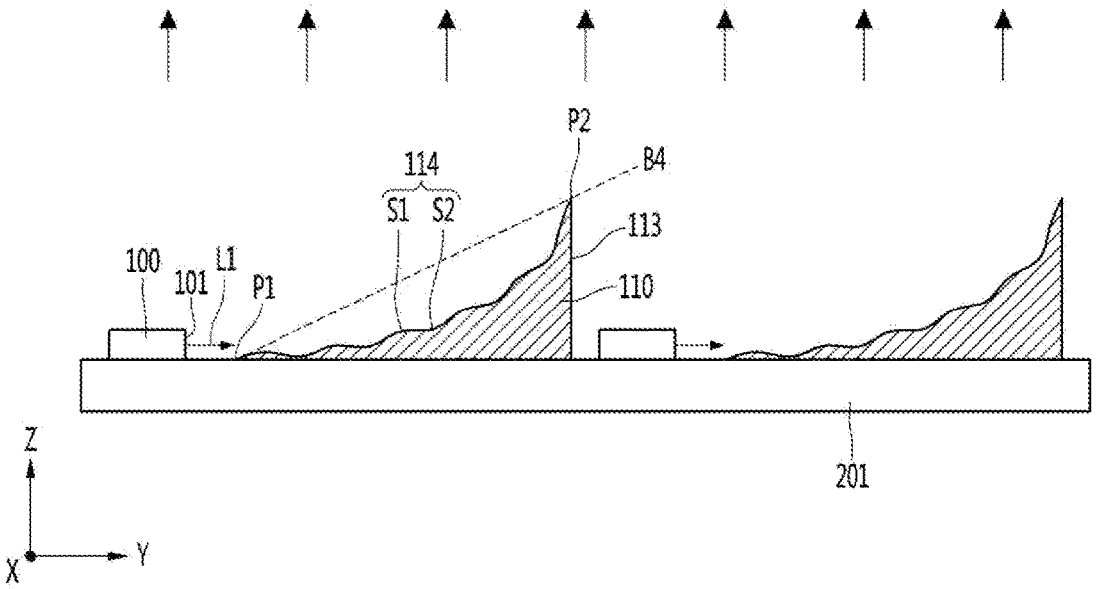
FIG. 2 is another example of the lighting module of FIG. 1.

FIG. 1 is a side cross-sectional view of a lighting module according to a first embodiment, and FIG. 2 is another example of the lighting module of FIG. 1.

Referring to FIGS. 1 and 2, a lighting module 400 according to an embodiment includes a substrate 201, a light emitting device 100 disposed on the substrate 201, and a reflector 110 disposed on an emission side of the light emitting device 100.

The substrate 201 may include a printed circuit board (PCB), for example, a resin-based printed circuit board (PCB), a metal core PCB, a flexible PCB, a ceramic PCB, and an FR-4 substrate. When the substrate 201 is disposed as a metal core PCB having a metal layer disposed at a bottom thereof, heat dissipation efficiency of the light emitting device 100 may be improved. The substrate 201 may include a flexible or non-flexible PCB.

The substrate 201 may include a wiring layer having a circuit pattern, and the wiring layer may be disposed at an upper portion of the substrate 201 and may be electrically connected to the light emitting device 100. One or a plurality of light emitting devices 100 may be disposed on the substrate 201. The plurality of light emitting devices 100 may be connected in series, in parallel, or in series-parallel by the circuit pattern of the substrate 201, but is not limited thereto. The substrate 201 may function as a base member located at a base of the light emitting device 100 and the reflector 110.

Figure 38:
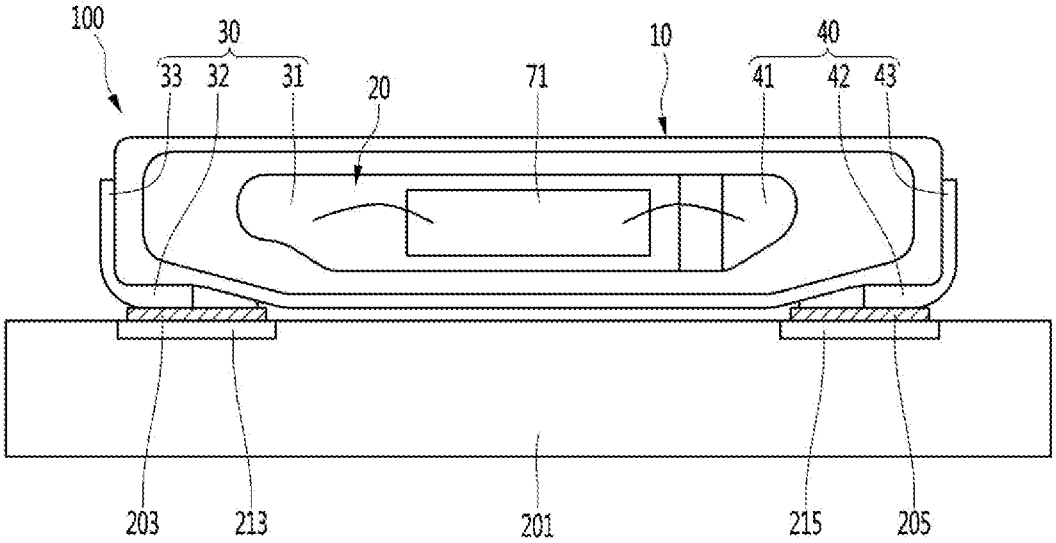
FIG. 38 is a front view of the light emitting device of FIG. 36 disposed on a substrate.
Figure 39:
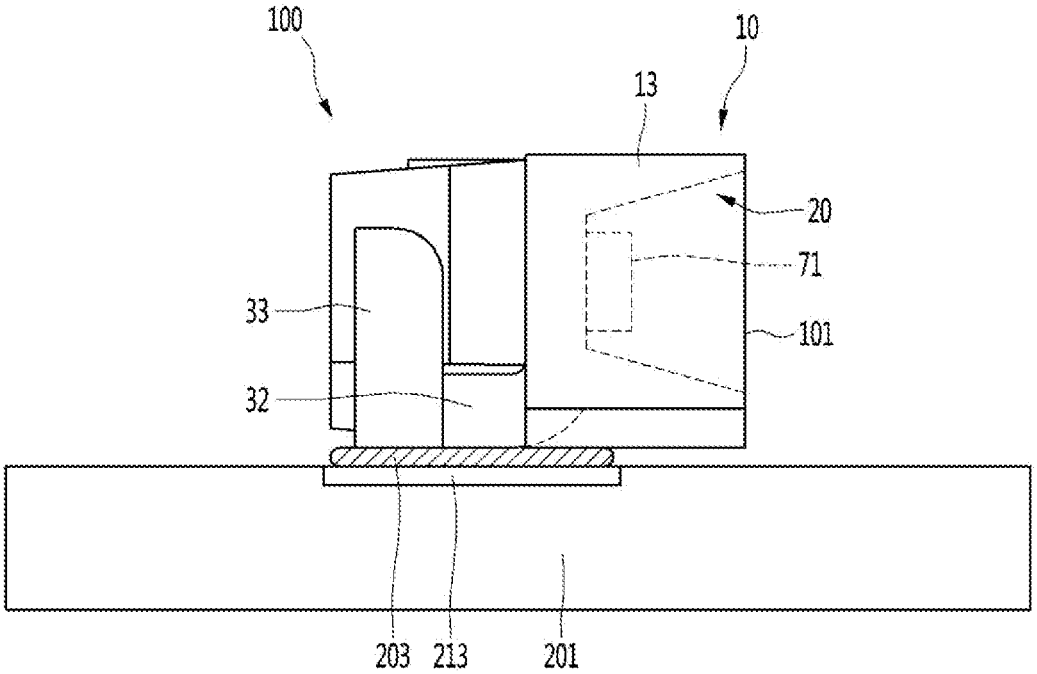
FIG. 39 is a side view of the light emitting device of FIG. 36 disposed on a substrate.

The light emitting device 100 may be disposed on the substrate 201 as shown in FIGS. 38 and 39. As shown in FIG. 1, the light emitting device 100 may be disposed in plural on the substrate 201 at a predetermined interval B5 or may be disposed at an irregular interval. The light emitting device 100 may be disposed in at least one row or two or more rows on the substrate 201, and the one or two or more rows of the light emitting device 100 may be disposed in a first direction Y on the substrate 201. Light emitted from the light emitting device 100 may be reflected by the reflector 110 and may be emitted in a vertical direction or in a third direction Z. The light emitting device 100 may emit light in the first direction Y and may emit light in the third direction by the reflector 110. Accordingly, the lighting module 400 may provide a surface light source in the third direction. Here, the first direction Y is a direction orthogonal to a second direction X, and the third direction Z is a direction orthogonal to the first and second directions Y and X.

An exit surface 101 of the light emitting device 100 may be disposed to face a reflective surface 112 of the reflector 110. The light emitting device 100 may be disposed in the second direction X along the reflector 110 in one or plural. For convenience of explanation, an embodiment will be described as an example in which one light emitting device 100 is disposed on each of the reflective surfaces 112 of the reflector 110. The light emitting devices 100 may be disposed along the first direction Y in plural, and the exit surface 101 of the light emitting device 100 may correspond to each reflector 110 or each reflective surface 112.

The light emitting device 100 is an element having a light emitting diode (LED), and may include a package in which an LED chip is packaged. The LED chip may emit at least one of blue, red, green, and ultraviolet (UV) rays, and the light emitting device may emit at least one of white, blue, red, and green. The light emitting device 100 may be a side view type in which a bottom portion thereof is electrically connected to the substrate 201, but is not limited thereto.

The exit surface 101 of the light emitting device 100 may correspond to the reflective surface 112 of the reflector 110. The exit surface 101 of the light emitting device 100 may be a surface adjacent to an upper surface of the substrate 201 or a surface perpendicular to the upper surface of the substrate 201. An optical axis L1 of light emitted to the exit surface 101 of the light emitting device 100 may be an axial direction parallel to the upper surface of the substrate 201 or may be tilted in a direction within 30 degrees with respect to a horizontal axis at the upper surface of the substrate 201. The reflective surface 112 may be a surface which is not parallel to the optical axis L1. The optical axis L1 may be an axial direction perpendicular to the exit surface 101 or may be a center axis of light emitted from the center of the light emitting device 100. The optical axis L1 may be a straight line extending in the first direction Y from the center portion of the exit surface 101 of the light emitting device 100.

A thickness T1 of the light emitting device 100 may be 3 mm or less, for example, 2 mm or less, and may be in a range of 1/10 to 1/2 of a maximum thickness or height T11 of the reflector 110. A length of the light emitting device 100 may be 1.5 times or more the thickness T1 of the light emitting device 100, but is not limited thereto. In such a light emitting device 100, a light emission angle in the second direction may be wider than that in a thickness direction Z. The light emission angle in the second direction X of the light emitting device 100 may be in a range of 110 to 160 degrees.

The reflector 110 and the light emitting device 100 may be disposed in the first direction Y. The reflector 110 may be disposed in an emission direction of each of the light emitting devices 100. A portion of the reflector 110, for example, a portion adjacent to a side surface or side surfaces of the light emitting device 100 may be disposed to be lower than the optical axis L1 of the light emitting device 100.

The reflector 110 may be spaced apart from the exit surface 101 of the light emitting device 100 at a predetermined interval B1. The interval B1 may be in a range of 0.5 mm or more, when the interval B1 is narrower than the above range, hot spots or a light splash phenomenon may occur. The reflector 110 and the light emitting device 100 may be disposed in the same direction on the substrate 201.

The reflector 110 may include the reflective surface 112 and the reflective surface 112 may correspond to the exit surface 101 of the light emitting device 100. The reflective surface 112 may be an inclined surface or a concave surface. When the reflective surface 112 is an inclined surface, the reflective surface may be a multi-stepped inclined structure. For convenience of explanation, an embodiment will be described with a structure in which the reflective surface 112 is a curved surface. The reflective surface 112 may be a concave curved surface or a curved surface having a negative curvature with respect to a straight line B4 connecting a lower end P1 and an upper end P2. The curved surface includes a shape having a curvature of a parabola or a curved surface having an aspherical shape. In the reflective surface 112 of the reflector 110, a height in the third direction may be gradually lowered as it is adjacent to the light emitting device 100 corresponding to the reflective surface 112. The reflective surface 112 of the reflector 110 may be gradually adjacent to the substrate 201 as it is adjacent to the light emitting device 100 corresponding to the reflective surface 112. The lower end P1 of the reflective surface 112 may be a portion of the reflective surface 112 closest to the light emitting device 100 or may be the lowermost portion thereof. The upper end P2 of the reflective surface 112 may be a portion of the reflective surface 112 farthest from the light emitting device 100 or may be the highest portion thereof.

The reflector 110 may become gradually thicker as it is farther from the light emitting device 100 disposed in an incident direction. The reflector 110 may become gradually thicker as it is farther from the exit surface 101 of the light emitting device 100. The reflector 110 may reflect the light emitted from the light emitting device 100 upwardly. In this case, the reflector 110 may vary a path of light reflected by the curved reflective surface 112 or irregularly reflect the light. Accordingly, the light reflected by the reflector 110 may be illuminated to the surface light source. The reflectors 110 disposed at an emission region of each of the light emitting devices 100 may be connected to each other or may be separated from each other.

The reflectors 110 may be disposed to correspond to each of the exit surfaces 101 of the light emitting devices 100, respectively. The reflective surface 112 of the reflector 110 may be disposed so as not to be overlapped with the light emitting device 100 in the vertical direction or the third direction Z. The interval B5 between the light emitting devices 100 may be greater than a length B2 of a bottom surface of the reflector 110. The interval B5 between the light emitting devices 100 may be greater than the length B2 of the bottom surface of the reflector 110 disposed between adjacent light emitting devices 100. The light emitting device 100 and the reflector 110 may be arranged in a structure that is alternately repeated. As another example, the interval B5 of the light emitting devices 100 may be the same as or different from a interval between the reflectors 110. As another example, when the interval B5 between the light emitting devices 100 is less than a length of the reflector 110 (e.g., B2>B5), a portion of the reflector 110 may be disposed to be overlapped with the light emitting device 100 in the vertical direction. For example, an upper portion of the reflector 110 may be disposed on the light emitting device 100 disposed between adjacent reflectors 110. Alternatively, the reflective surface 112 of the reflector 110 may be disposed on the light emitting device 100 disposed between the adjacent reflectors 110. Accordingly, it is possible to prevent occurrence of dark portions in a region between the adjacent reflectors 110, or to prevent hot spots, and to protect the light emitting device 100 in absence of a molding member. As another example, the upper portion of the reflector 110 disposed in each emission direction of the light emitting device 100 may be disposed to be overlapped with a lower portion of another adjacent reflector in the vertical direction. Since a portion of the adjacent reflectors 110 are overlapped with each other in the vertical direction, the light emitting device 100 may be protected, a height of the reflector 110 may be lowered and the occurrence of hot spots or dark portions in a boundary region may be prevented. In this case, since the light emitting device 100 emits light in a side view type, the light emitting device 100 may not affect the light.

A plurality of the reflectors 110 may be spaced apart from each other. The plurality of reflectors 110 may be physically separated from each other, or may be connected to each other. When the reflectors 110 are separated, the reflectors 110 may be attached on each substrate 201 or attached to other structures, for example, a housing 300 (see FIG. 7), but is not limited thereto. When the reflectors 110 are connected to each other, the reflectors 110 may be connected to each other through an outside of the light emitting device 100. When the plurality of reflectors 110 are connected to each other, a region between the reflectors 110 may be opened and the light emitting device 100 may be disposed in the opened region.

Here, an outer sidewall 113 of the reflector 110 disposed between the light emitting devices 100 may have a predetermined interval B3 from the light emitting device 100 disposed between the reflectors 110, and for example, the interval may be 2 mm or less. The interval B3 may be in a range of 0 to 2 mm. At least a portion of the light emitting device 100 disposed between the reflectors 110 may be vertically overlapped with the reflector 110. When the interval between the outer sidewall 113 of the reflector 110 and the adjacent light emitting device 100 is zero or less, the reflector 110 may be disposed on the light emitting device 100, or may be in contact with a surface of the light emitting device 100.

The reflector 110 includes a material having a light reflectance of 70% or more with respect to light emitted from the light emitting device 100. The reflector 110 may be formed as a single-layer or multilayer structure using a polymer, a metal, or a dielectric, and for example, may include a laminated structure of a metal/dielectric. The reflector 110 may include a material having a polymer, a polymer compound, or a metal. The reflector 110 may be formed of a material having a polymer filled with inorganic fine particles such as titanium dioxide ($TiO_2$), a silicone or epoxy resin, a thermosetting resin including a plastic material, or a material having high heat resistance and high light resistance. The silicone includes a white-based resin. The body may be formed of at least one selected from the group consisting of an epoxy resin, a modified epoxy resin, a silicone resin, a modified silicone resin, an acrylic resin, and a urethane resin. For example, a solid epoxy resin composition which is formed by adding an epoxy resin composed of triglycidyl isocyanurate, hydrogenated bisphenol A diglycidyl ether, etc. and an acid anhydride composed of hexahydrophthalic anhydride, 3-methylhexahydrophthalic anhydride, 4-methylhexahydrophthalic anhydride, etc. with 1,8-diazabicyclo (5,4,0) undecene-7 (DBU) as a curing agent, ethylene glycol as a co-catalyst, titanium oxide pigment, and glass fiber in the epoxy resin, partially curing by heating, and B staging may be used, and the present invention is not limited thereto. The reflector 110 may be formed as an optical film, PET, PC, PVC resin, or the like.

When the surface of the reflective surface 112 is a metal, the reflector 110 may include a metal layer having at least one of aluminum, chromium, silver, and barium sulfate, or selective alloys thereof. The metal layer may be a layer coated with a material different from that of the reflector 110.

A row of the light emitting device 100/reflector 110 may be a linear bar shape having a predetermined length, a curved bar shape having a predetermined curvature, a bent bar shape bent at least once, or may be a mixture of two or more of the straight, curved, and bent shapes. Such a shape may vary depending on applications such as a type and structure of a vehicle lamp such as a head lamp, a side mirror lamp, a fog lamp, a tail lamp, a stop lamp, a side marker lamp, and a daytime running light. An embodiment may not use a separate molding member on the reflector 110, thereby reducing optical loss.

FIG. 2 is another example of the lighting module of FIG. 1. In the description of FIG. 2, the same configuration as FIG. 1 will be described with reference to the above description.

Referring to FIG. 2, a lighting module includes a substrate 201, a plurality of light emitting devices 100 on the substrate 201, and a reflector 110 disposed in a light-emitting direction of each of the light emitting devices 100.

The reflector 110 includes a reflective surface 114 having a concave-convex structure to enhance reflection efficiency of incident light. The reflective surface 114 may be concave compared with a straight line connecting opposite edges. The reflective surface 114 having the concave-convex structure may irregularly reflect incident light to improve light uniformity of the surface light source. A convex portion S1 and a concave portion S2 may be alternately or repeatedly disposed in the concave-convex structure, the convex portion S1 may have a predetermined pattern or may be repeated in an irregular pattern, and the concave portion S2 may be disposed between the convex portions S1.

The reflective surface 114 may be concave compared with a straight line connecting opposite ends P1 and P2. The convex portion S1 and the concave portion S2 may be disposed in an entire region of the reflective surface 114 or in a full width at half maximum (FWHM) region of a spread angle of the light emitting device 100 to effectively reflect incident light. The convex portion S1 and the concave portion S2 may be defined as one reflection cell or facet at the reflective surface 114. For convenience of explanation, the structure of the convex portion S1 and the concave portion S2 will be described as a reflection cell, and the reflection cells may be disposed in a stripe shape in the second direction, that is X direction or may be disposed in a matrix form. The reflective surface 114 may include a plurality of reflection cells.

The convex portion S1 in the reflective surface 114 may include a convex curved surface or an inclined surface, and the concave portion S2 may include a concave curved surface or an inclined surface, or a flat surface. The reflection cell may include a structure of a textured surface, an embossing shape, a shape having beads, a polygonal shape, a hemispherical shape, or an elliptical shape. The beads may include polyethylene terephthalate, silicon, silica, glass bubble, polymethyl methacrylate (PMMA), urethane, zinc, zirconium, a metal oxide such as aluminum oxide ($Al_2O_3$), acryl, or a combination thereof.

A cycle of the concave portion S2 and/or the convex portion S1 in the reflection cell of the reflective surface 114 may become gradually narrower as it is farther from the light emitting device 100 that emits light or the same, but is not limited thereto. A length ratio S2:S1 of the concave portion S2 to the convex portion S1 in the first direction in one reflection cell may include a range of 1:1 to 1:9. An area ratio S2:S1 of the concave portion S2 to the convex portion S1 in one reflection cell may satisfy a range of 1:1 to 1:9. The length or the area of the convex portion S1 in such a single reflection cell may be larger than that of the concave portion S2. Accordingly, the convex portions S1 of the reflection cells may improve reflection efficiency of light incident from the light emitting device 100, and may improve uniformity of light via irregular reflection of the light. The convex portion S1 in the one reflection cell is disposed to be closer to the light emitting device 100 than the concave portion S2 so as to reflect the incident light and the concave portion S2 may be provided to form another convex portion S1.

A material of the reflector 110 is described with reference to FIG. 1, the convex portion S1/the concave portion S2 may be formed along the concave curved surface of the reflective surface 114 or along the inclined surface thereof. Here, when the reflective surface 114 of the reflector 110 is a metal such as aluminum, silver, or chrome, the convex portion S1 or the concave portion S2 may be formed of a metal. Materials of the convex portion S1 and the concave portion S2 may be the same as or different from that of the reflector 110.

Figure 3:
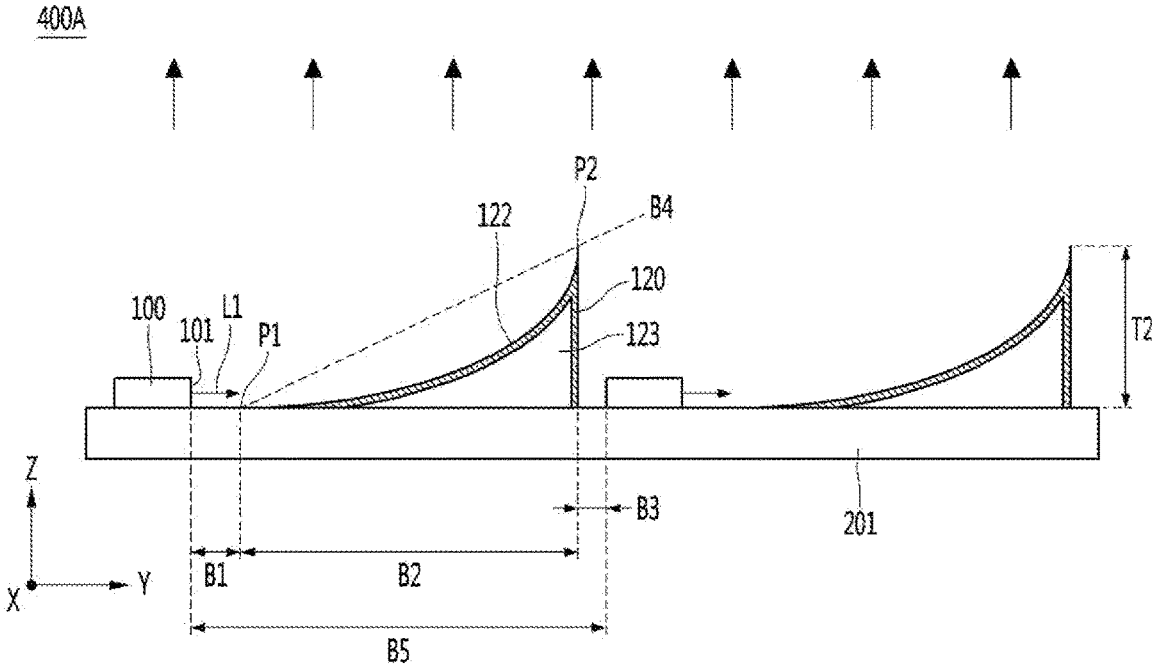
FIG. 3 is a side cross-sectional view of a lighting module according to a second embodiment.

FIG. 3 is a view illustrating a lighting module according to a second embodiment. In describing FIG. 3, it will be referred to the description of the above-described embodiment.

Referring to FIG. 3, a lighting module 400A includes a substrate 201, a plurality of light emitting devices 100 on the substrate 201, and a reflector 120 disposed in a light-emitting direction of each of the light emitting devices 100.

The reflector 120 includes a plate formed of a material having a predetermined thickness at a predetermined height T12 and an air gap 123 may be disposed at a region between a reflective surface 122 of the reflector 120 and the substrate 201. A thickness of the plate may be in a range of 5 mm or less, for example, 1 to 3 mm. When the thickness of the plate is thicker than the range, improvement of reflection efficiency may be insignificant, and when the thickness is thinner than the range, it may be difficult to secure rigidity of the plate. The reflective surface 122 of the reflector 120 may have a curved surface as shown in FIG. 1 or may include an inclined surface, which is described with reference to FIG. 1.

The reflector 120 may be spaced apart from an exit surface 101 of the light emitting device 100 at a predetermined interval B1. The interval B1 may be in a range of 0.5 mm or more, and when the interval B1 is narrower than the above range, hot spots or a light splash phenomenon may occur.

The reflector 120 includes a reflective surface 122 corresponding to the exit surface 101 of the light emitting device 100 and the reflective surface 122 may be an inclined surface or a curved surface. The reflective surface 122 may be concave compared with a straight line connecting opposite edges. When the reflective surface 122 is an inclined surface, the reflective surface may be a multi-stepped inclined structure. For convenience of explanation, an embodiment will be described with a structure in which the reflective surface 122 is a curved surface. The reflective surface 122 may be a concave curved surface or a curved surface having a negative curvature from a straight line B4 connecting a lower end P1 and an upper end P2. The curved surface includes a curved surface having a shape having a curvature of a parabola or an aspherical shape.

The reflector 120 may become gradually higher as it is farther from the light emitting device 100 disposed in an incident direction. The reflector 120 may become gradually thicker as it is farther from the exit surface 101 of the light emitting device 100. The reflector 120 may reflect the light emitted from the light emitting device 100 upwardly. In this case, the reflector 110 may vary a path of light reflected by the curved reflective surface 122 or irregularly reflect the light. Accordingly, the light reflected by the reflector 120 may be illuminated as a form of a surface light source.

The reflector 120 may be disposed to correspond to each of the exit surfaces 101 of the light emitting devices 100, respectively. The reflective surface 122 of the reflector 120 may be disposed so as not to be overlapped with the light emitting device 100 in a vertical direction. A interval B5 between the light emitting devices 100 may be greater than a length B2 of the bottom surface of each reflector 120. The light emitting device 100 and the reflector 120 may be disposed in a structure in which the light emitting device 100 and the reflector 120 are alternately repeated, and the interval B5 between the light emitting devices 100 may be the same as or different from a interval between the reflectors 120.

The reflector 120 includes a material having a light reflectance of 70% or more with respect to light emitted from the light emitting device 100. The reflector 120 may be formed as a single-layer or multilayer structure using a polymer, a metal, or a dielectric, and for example, may include a laminated structure of a metal/dielectric. The reflector 120 may include a material having a polymer, a polymer compound, or a metal. The reflector 120 may be formed of a material having a polymer filled with inorganic fine particles such as titanium dioxide ($TiO_2$), a silicone or epoxy resin, a thermosetting resin including a plastic material, or a material having high heat resistance and high light resistance. The reflector 120 may be selected from materials of the reflectors disclosed in FIGS. 1 and 2, but is not limited thereto.

When the surface of the reflective surface 122 is a metal, the reflector 120 may be formed of a metal layer having at least one of aluminum, chromium, silver, and barium sulfate, or selected alloys thereof. The metal layer may be a layer coated with a material different from that of the reflector 120.

Figure 4:
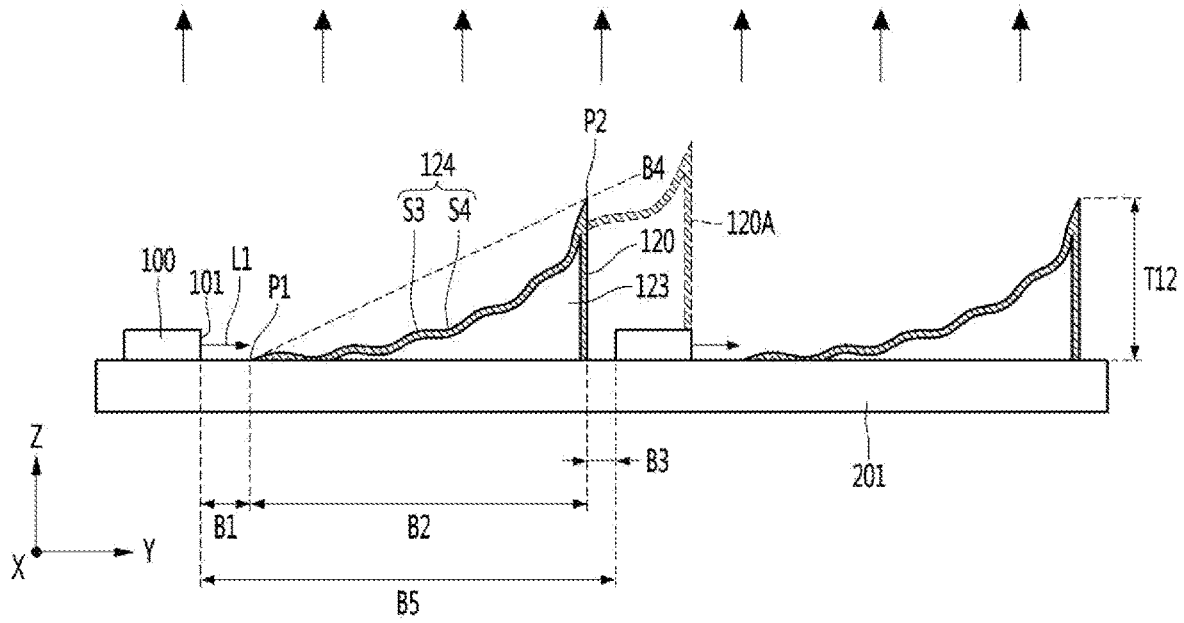
FIG. 4 is another example of the lighting module of FIG. 3.

FIG. 4 is a view illustrating another example of a lighting module according to a second embodiment. In describing FIG. 4, it will be referred to the description of the above-described embodiment.

Referring to FIG. 4, a lighting module includes a substrate 201, a plurality of light emitting devices 100 on the substrate 201, and a reflector 120 disposed in a light-emitting direction of each of the light emitting devices 100.

A interval between the light emitting devices 100 may be wider than that between reflective surfaces 122 of the reflectors 120 so that the light emitting device 100 may be disposed between the reflective surfaces 122 of the adjacent reflectors 120. A portion 120A of the reflector 120 may extend to be overlapped with the light emitting device 100 in the second direction X. The portion 120A of the reflector 120 may extend to be overlapped with the light emitting device 100 in the first and second directions Y and X. Here, when the interval B5 between the light emitting devices 100 is less than a bottom length of the reflector 120 (e.g., B2+B3), the portion 120A of the reflector 120 may be disposed to be overlapped with the light emitting device 100 in the vertical direction. For example, the portion 120A of the reflector 120 may be disposed on the light emitting device 100 disposed between adjacent reflectors. Alternatively, a reflective surface 122 disposed on the portion 120A of the reflector 120 may extend on the light emitting device 100 disposed between adjacent reflectors. Accordingly, it is possible to prevent occurrence of dark portions in a region between adjacent reflectors 120, or to prevent hot spots, and to protect the light emitting device 100 in absence of a molding member. The portion 120A of the reflector 120 may be removed but is not limited thereto.

As another example, the portion 120A of the reflector 120 disposed in each emission direction of the light emitting device 100 may be disposed to be overlapped with a lower portion of another adjacent reflector in the vertical direction. Since a portion of the adjacent reflectors 120 are overlapped with each other in the vertical direction, the light emitting device 100 may be protected, a height of the reflector 120 may be lowered and the occurrence of hot spots or dark portions in a boundary region may be prevented. In this case, since the light emitting device 100 emits light in a side view type, the light emitting device 100 may not affect the light.

The reflector 120 includes a reflective surface 124 having a concave-convex structure to enhance reflection efficiency of incident light. The reflective surface 124 having the concave-convex structure may irregularly reflect incident light to improve light uniformity of the surface light source. A convex portion S3 and a concave portion S4 may be alternately or repeatedly disposed in the concave-convex structure, the convex portion S3 may have a predetermined pattern or may be repeated in an irregular pattern, and the concave portion S4 may be disposed between the convex portions S3.

The concave portion S4 and the convex portion S3 may be disposed in an entire region of the reflective surface 122 or in a full width at half maximum (FWHM) region of a spread angle of the light emitting device 100 to effectively reflect light. A pair of the convex portion S3 and the concave portion S4 of the reflective surface 122 may be a single reflecting cell or a facet. The convex portion S3 may be disposed to be closer to the exit surface 101 of the light emitting device 100 than the concave portion S4 in each of the reflection cells.

The convex portion S3 in the concave-convex structure of the reflective surface 122 may include a convex curved surface or an inclined surface, and the concave portion S4 may include a concave curved surface or an inclined surface, or a flat surface. The concave-convex structure may include a structure of a textured surface, an embossing shape, a bead shape, a polygonal shape, a hemispherical shape, or an elliptical shape. A cycle of the concave portion S4 and/or the convex portion S3 in the concave-convex structure of the reflective surface 122 may gradually become narrower as it is farther from the light emitting device 100 disposed in the incident direction or the same, but is not limited thereto. A length ratio S4:S3 of the concave portion S4 to the convex portion S3 in one reflecting cell may include a range of 1:1 to 1:9. An area ratio S4:S3 of the concave portion S4 to the convex portion S3 in one reflection cell may satisfy a range of 1:1 to 1:9. The length or the area of the convex portion S3 in this one reflection cell is made larger than that of the concave portion S3, so that reflection efficiency of the light incident from the light emitting device 100 may be improved and uniformity of light may be improved via irregular reflection of the light. A material of the reflector 120 may be selectively applied with reference to the detailed description of FIGS. 1 to 3. Here, the reflective surface 122 may be formed of the above-described metal layer, or may be formed of a material that is the same as or different from that of the reflector 120.

Figure 5:
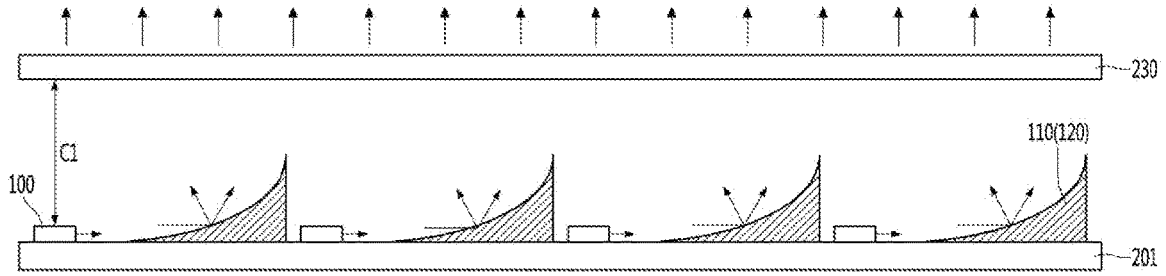
FIG. 5 is a view illustrating a lighting device having the lighting module of FIGS. 1 and 3.

FIG. 5 is a view of a lighting device having a lighting module according to an embodiment. The lighting module of the lighting device will be referred to the description of FIGS. 1 to 4, and may optionally include a portion of the configuration of the above-described lighting module.

Referring to FIG. 5, the lighting device includes an optical member 230 disposed on a lighting module 400. The lighting module 400 includes the lighting module of FIGS. 1 to 4 disclosed in the embodiment and includes, for example, a substrate 201, a plurality of light emitting devices 100 on the substrate 201, and reflectors 110 or 120 disclosed in the embodiment on the light emission side of the plurality of light emitting devices 100.

The optical member 230 may diffuse incident light and transmit the light. The optical member 230 uniformly diffuses and emits a surface light source reflected from the reflectors 110 and 120. The optical member 230 may include an optical lens or an inner lens, and the optical lens may condense light toward a target or change a path of the light. The optical member 230 may include a plurality of lens portions 231 (see FIG. 8) on at least one of an upper surface and a lower surface thereof, and the lens portion 231 (see FIG. 8) may be in a shape protruding downward from the optical member 230, or in a shape protruding upward therefrom. Such an optical member 230 may control light distribution characteristics of the lighting device.

The optical member 230 may include a material having a refractive index of 2.0 or less, for example, 1.7 or less. The material of the optical member 230 may be formed by a transparent resin material of acryl, polymethyl methacrylate (PMMA), polycarbonate (PC), or epoxy resin (EP), or transparent glass.

The optical member 230 may have an interval Cl of 50 mm or less, for example, 15 mm to 30 mm from the lighting module such as the substrate 201, when the interval Cl deviates from the above range, light intensity may be lowered, and when the interval Cl is smaller than the above range, uniformity of light may be lowered.

Figure 6:
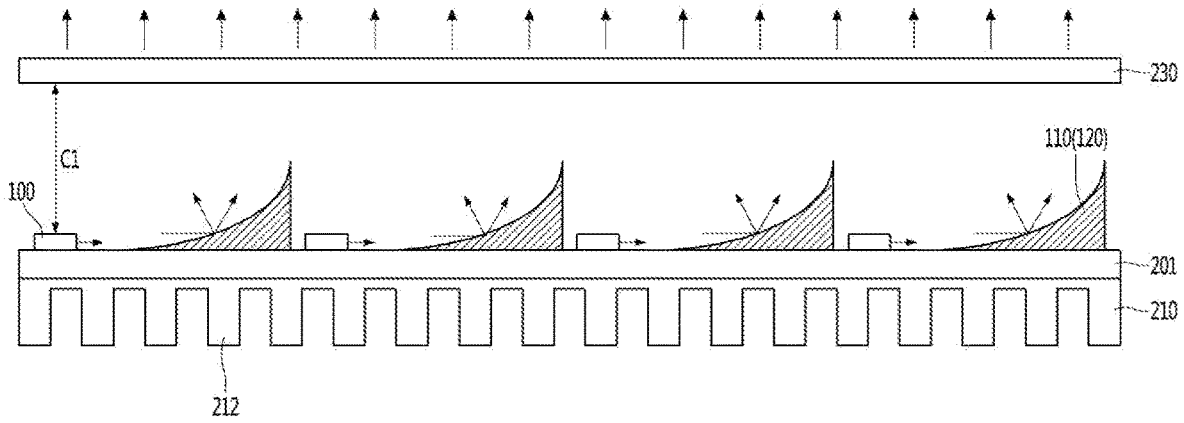
FIG. 6 is a view illustrating an example in which a heat dissipation plate is disposed at the lighting device of FIG. 5.

FIG. 6 is another example of the lighting device of FIG. 5, and includes a heat dissipation plate 210. The heat dissipation plate 210 may be disposed at a lower surface of the substrate 201 and may dissipate heat conducted to the substrate 201. The heat dissipation plate 210 may include a plurality of heat dissipation fins 212, and the plurality of heat dissipation fins 212 may be arranged downward at a predetermined interval. The heat dissipation plate 210 may include at least one of metals such as aluminum, copper, magnesium, and nickel, or an alloy thereof.

The heat dissipation plate 210 may have an area equal to, wider or narrower than that of the substrate 201, but is not limited thereto. Since the heat dissipation plate 210 is disposed, operational reliability of the light emitting device 100 may be improved.

Figure 7:
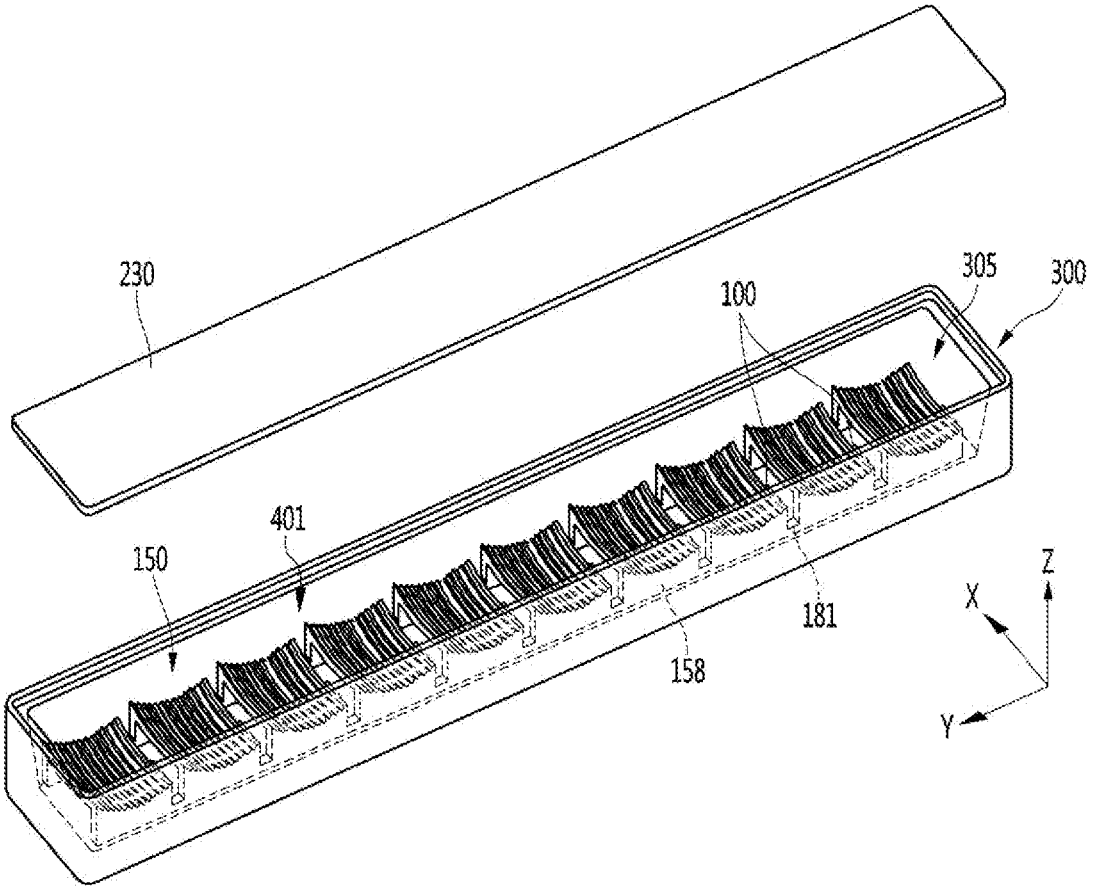
FIG. 7 is a perspective view of a lighting device having a lighting module according to a third embodiment.
Figure 8:
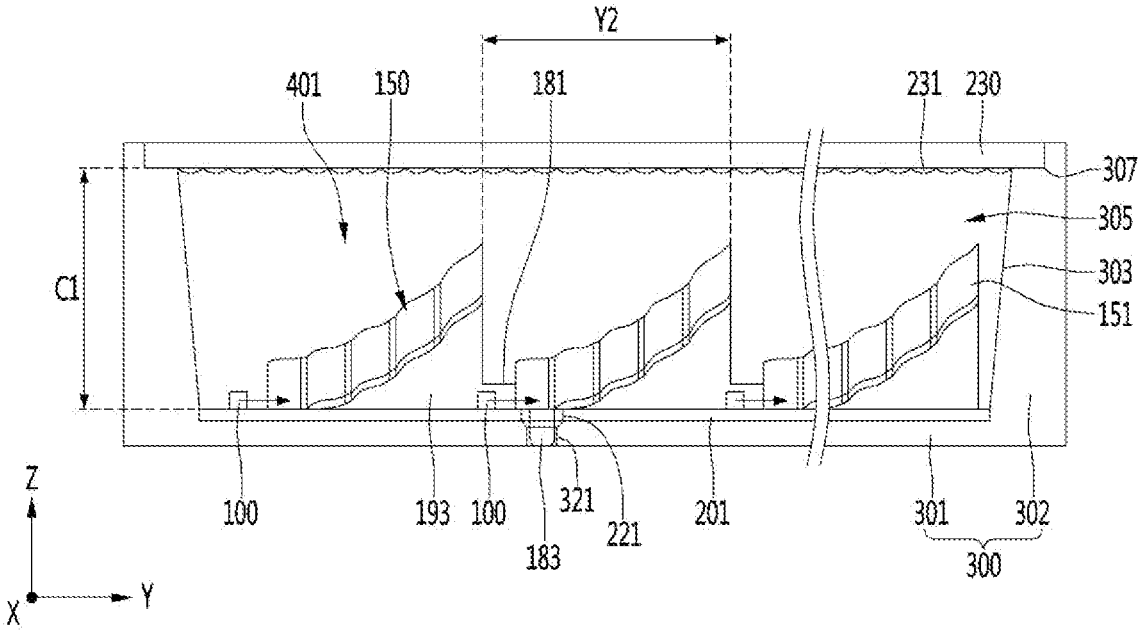
FIG. 8 is a side cross-sectional view schematically illustrating a lighting device to which an optical member of FIG. 7 is coupled.
Figure 9:
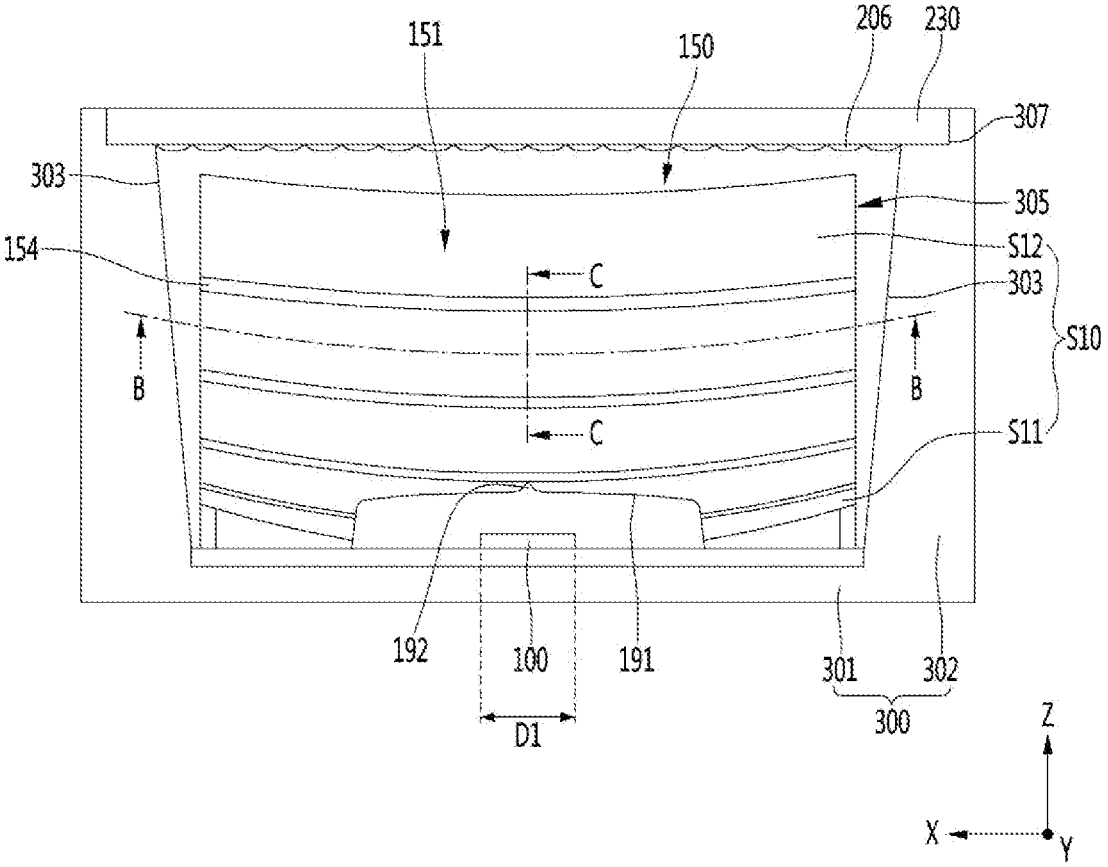
FIG. 9 is a longitudinal cross-sectional view schematically illustrating the lighting device of FIG. 8.
Figure 10:
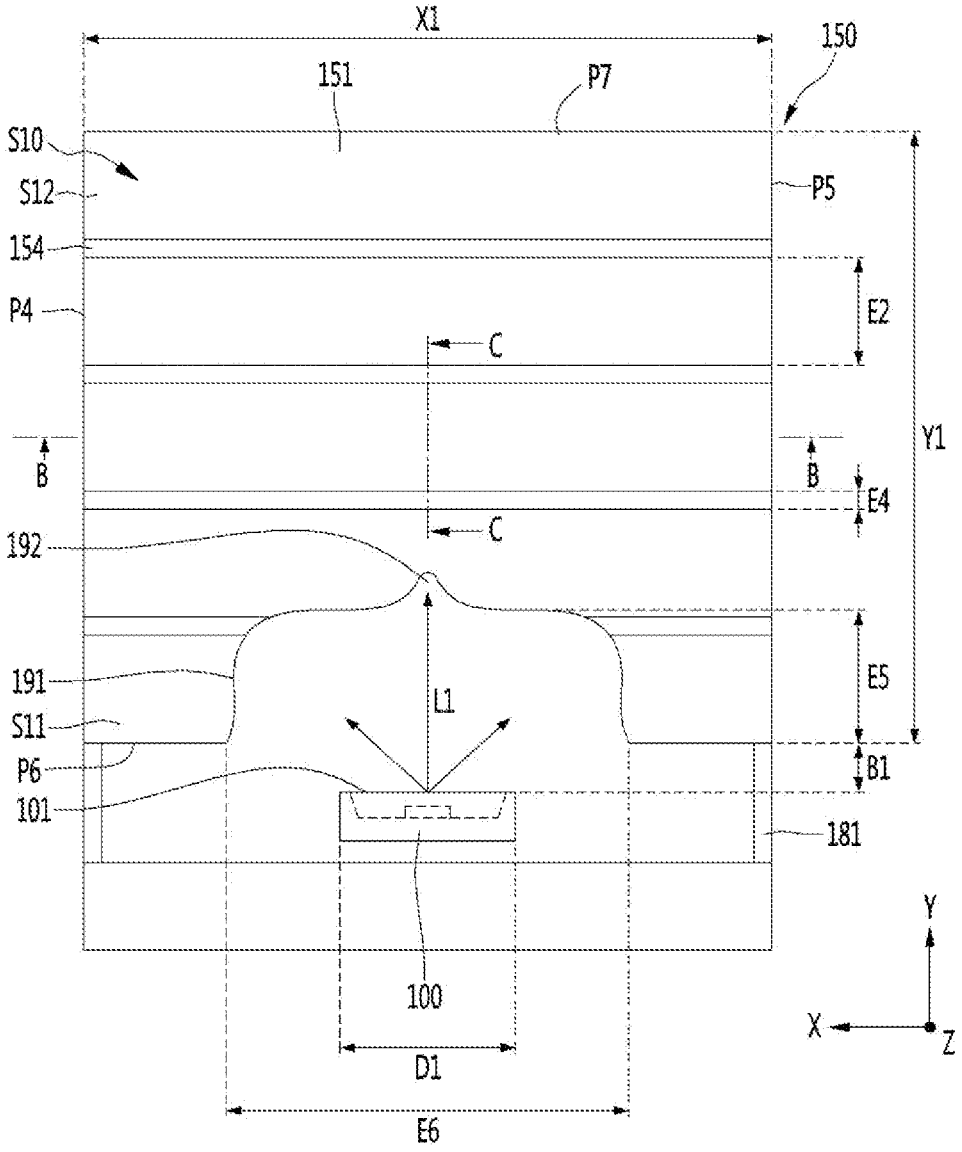
FIG. 10 is a deployed plan view of a reflector of the lighting device of FIG. 9.
Figure 11:
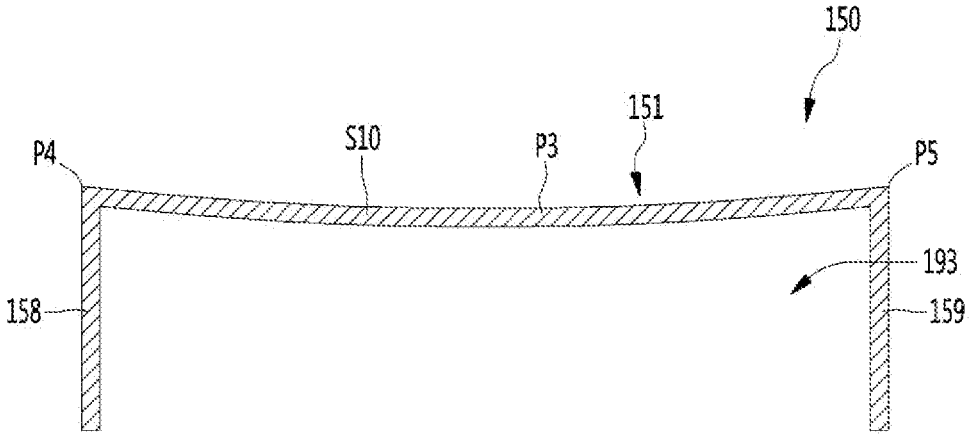
FIG. 11 (*a*) is a view illustrating an example of a B-B side cross section of the reflector in FIG. 9.
Figure 11:
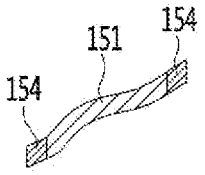
Figure 12:
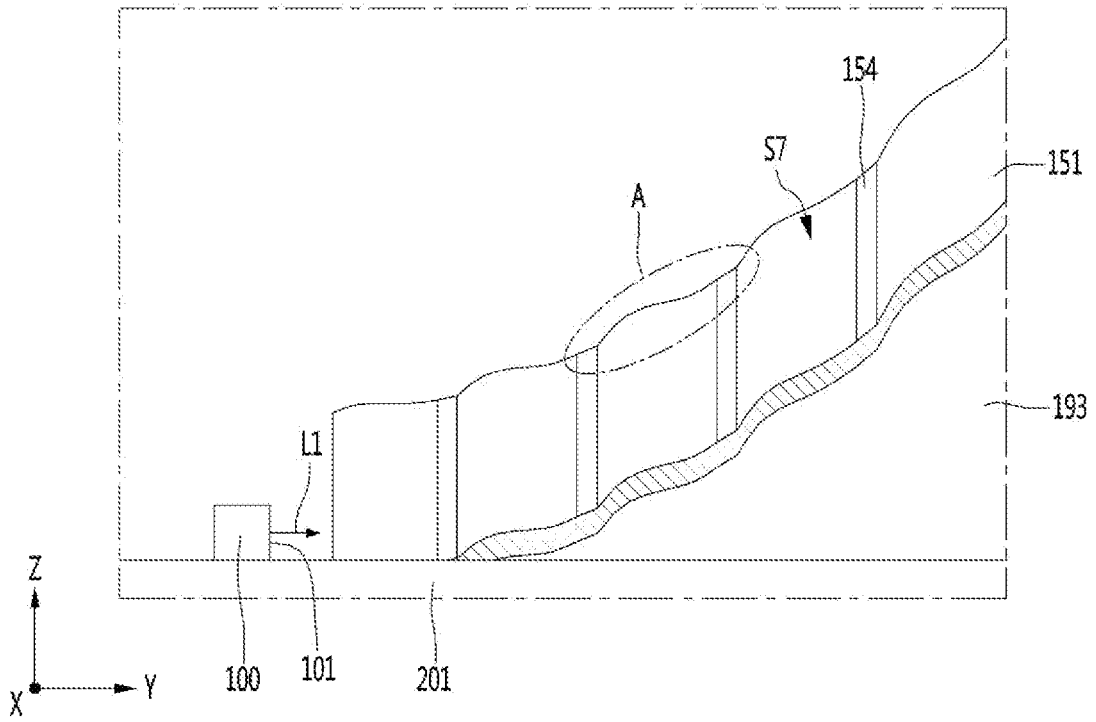
FIG. 12 is a partially enlarged view of the lighting device of FIG. 8.
Figure 13:
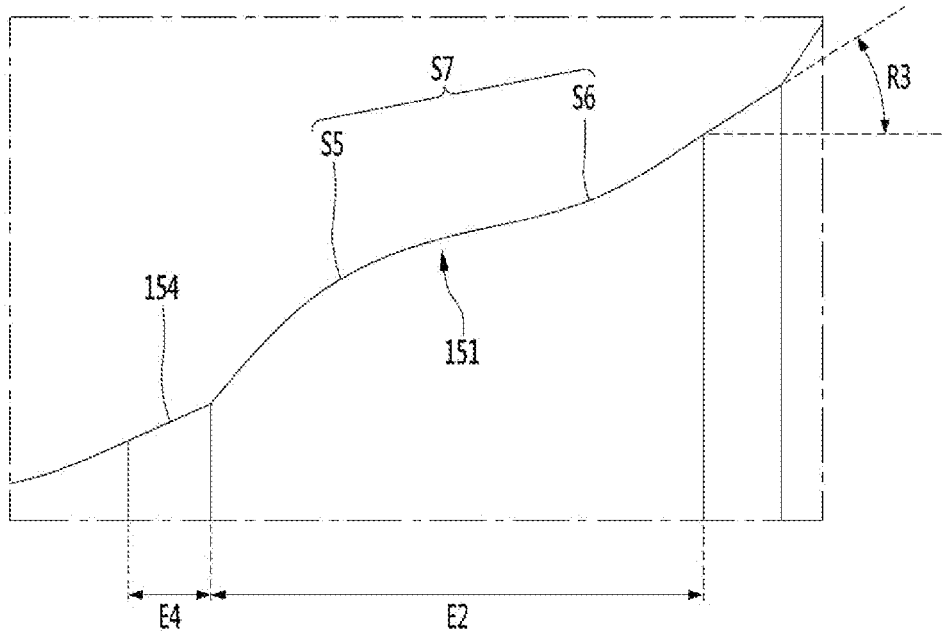
FIG. 13 is a detailed view of region A of a reflective surface of a reflector of FIG. 12.

FIG. 7 is a perspective view illustrating a lighting device according to a third embodiment, FIG. 8 is a longitudinal cross-sectional view of an assembled lighting device of FIG. 7, FIG. 9 is a longitudinal cross-sectional view of the assembled lighting device of FIG. 7, FIG. 10 is a deployed plan view of a reflector of the lighting device of FIG. 9, FIGS. 11(*a*) and 11(*b*) are views illustrating examples of B-B side and C-C side cross sections of the reflector in FIG. 9, FIG. 12 is a partially enlarged view of the lighting device of FIG. 8, and FIG. 13 is a detailed view of a region A of a reflective surface of the reflector of FIG. 12.

Referring to FIGS. 7 to 13, the lighting device includes a housing 300 having a receiving space 305, a lighting module 401 disposed at a bottom of the receiving space 305 of the housing 300, and an optical member 230 disposed on the lighting module 401.

The lighting module 401 includes a substrate 201, a light emitting device 100, and a reflector 150. The substrate 201 and the light emitting device 100 will be described with reference to the description disclosed in an embodiment.

As shown in FIGS. 7 to 9, the housing 300 may be provided such that a side surface 303 of the receiving space 305 is inclined with respect to a bottom surface of the housing 300, and such an inclined surface may improve light extraction efficiency. A surface of the receiving space 305 of the housing 300 may be formed of a metallic material of reflective material and the light extraction efficiency in the receiving space 305 may be improved by such a metallic material. A depth of the receiving space 305 may be greater than a maximum height of the reflector 150 so that the light reflected from the reflector 150 may be guided to be dispersed and emitted.

The housing 300 includes a bottom portion 301 and a sidewall portion 302, the bottom portion 301 is disposed under the substrate 201, and the sidewall portion 302 may protrude upward from an outer periphery of the bottom portion 301 and may be disposed at a periphery of the reflector 150.

A concave stepped portion 307 may be formed at an upper portion of the sidewall portion 302 of the housing 300 and the stepped portion 307 may be disposed at an outer side of the optical member 230. The optical member 230 may be adhered to the stepped portion 307 of the housing 300 with an adhesive. The housing 300 may include a metal or a plastic material, but is not limited thereto.

A hole (not shown) through which a cable connected to the substrate 201 passes may be formed at the bottom portion 301 or the sidewall portion 302 of the housing 300, but is not limited thereto. A coupling hole 321 in which one or more coupling portions 183 of the reflectors 150 are fastened may be formed at the bottom portion 301 of the housing 300, and the coupling hole 321 may correspond to a hole 221 of the substrate 201, and may be a hole through which a fastening means such as a screw is fastened or a hole in the form of a hook. The coupling portion 183 of the reflector 150 protrudes toward the substrate and may have a hook structure or a screw coupling hole, but is not limited thereto. Accordingly, the reflector 150 may be fixed to the bottom of the housing 300.

As shown in FIGS. 7 and 8, the reflector 150 may be respectively disposed in a light-emitting direction of each light emitting device 100, and may be connected to each other. A connection portion 181 between the reflectors 150 may be disposed in a region between the reflectors 150 and overlapped in the second direction of the light emitting device 100. As shown in FIG. 11, support sidewalls 158 and 159 may be disposed at opposite outer sides of the reflector 150, for example, at an outer side in the X-axis direction. Such support sidewalls 158 and 159 may extend to an upper surface of the substrate. The reflector 150 may be attached or fixed on the substrate 201 by the support sidewalls 158 and 159 and may connect the adjacent reflectors 150 to each other.

An interval Y2 between the reflectors 150 may be greater than a longitudinal length of each of the reflectors 150 and for example, may be in a range of 10 to 30 mm or 15 to 25 mm. The reflector 150 may be disposed so as not to be overlapped with the light emitting device 100 in the vertical direction to easily couple to the reflector 150. The interval Y2 between the reflectors 150 may be equal to the longitudinal length of the reflector 150, and in this case, an upper portion of the reflector 150 may be disposed to be overlapped with the light emitting device 100 in the vertical direction. As another example, since the upper portion of the reflector 150 disposed in each emission direction of the light emitting device 100 may extend to an upper region of another adjacent light emitting device 100, it is possible to prevent occurrence of dark portions or hot spots in a region between the adjacent reflectors 150. As another example, the upper portion of the reflector 150 disposed in each emission direction of the light emitting device 100 may be disposed to be overlapped with a lower portion of another adjacent reflector in the vertical direction. Since a portion of the adjacent reflectors 150 are overlapped with each other in the vertical direction, the light emitting device 100 may be protected, a height of the reflector 150 may be lowered, and the occurrence of hot spots or dark portions in a boundary region may be prevented.

An optical member 230 may be disposed on the lighting module according to an embodiment, a plurality of lens portions 231 may be disposed in a lower portion of the optical member 230, and the incident light from the reflector 150 may be diffused so that uniform light uniformity may be provided. The optical member 230 may be changed depending on lighting characteristics or applications.

Referring to FIGS. 8 and 11, the reflector 150 may include a reflective surface 151, which may extend outward from a center region of the reflector 150 with a predetermined curvature. The reflective surface 151 may be concave compared with a straight line connecting opposite edges. The reflective surface 151 may be disposed to have a negative curvature based on opposite edges P4 and P5 as shown in FIG. 11(*a*). Here, the opposite edges P4 and P5 may be portions opposite to each other in the second direction at the reflective surface 151. As shown in FIGS. 9 and 11, a distance between the opposite edges P4 and P5 at the reflective surface 151 may gradually increase as it is farther from the light emitting device 100 disposed in the incident direction. For example, when the reflective surface 151 has a negative curve between the left and right edges P4 and P5, the curvature may gradually increase as it is farther from the light emitting device 100. The reflective surface 151 is concave with respect to the second direction X, and a radius of curvature of the concave curve may be 25 mm or less, for example, 20 mm or less. The reflective surface 151 may have, for example, a concave curve or concave curvature with respect to a straight line at upper end and lower end edges P6 and P7. The reflective surface 151 is concave than a straight line connecting the upper end edge P6 and the lower end edge P7 thereof, and in the case of the concave curve, the radius of curvature may be greater than the radius of curvature with respect to a curved surface between the opposite edges P4 and P5 in the first direction, and may be in a range of 40 mm or less, for example, 33 to 38 mm.

The reflective surface 151 may include a plurality of reflection cells S7 and a bridge portion 154 connecting the plurality of reflection cells S7. The bridge portion 154 may have a long length in one direction, and for example, may be disposed to be long along the reflection cells S7. One or a plurality of the bridge portions 154 may be disposed in the vertical direction, in the transverse direction, or in the horizontal and vertical directions. That is, the bridge portion 154 may be disposed in at least one of the first and second directions.

The reflective surface 151 may be divided into a plurality of reflection cells S7 by a bridge portion 154 arranged in a transverse direction. The bridge portion 154 may connect the reflection cells S7 arranged in the vertical direction to each other. The plurality of the bridge portions 154 may be disposed parallel to each other. The number of the bridge portions 154 may be less than or equal to that of the reflection cells S7. The length of the bridge portion 154 in the transverse direction may be equal to that of the convex portion S5. The length of the bridge portion 154 in the transverse direction may be equal to that of the concave portion S6. Here, the horizontal and vertical directions may be the directions when the reflective surface 151 is viewed from the top.

The reflection cell S7 may be continuously arranged from a first reflection cell S11 to a last second reflection cell S12 and the bridge portion 154 may be connected between adjacent reflection cells S7. The bridge portion 154 may be disposed between the adjacent reflection cells S7 in an inclined surface, and may be disposed in a concave curved surface in the first direction. As shown in FIG. 11, a center P3 of each reflection cell S7 of the reflective surface 151 may be disposed to be lower than the straight line connecting the opposite edges P4 and P5. The plurality of reflection cells S7 are disposed at the reflective surface 151 in an oblique direction or gradually higher as it is farther from the light emitting device 100, and thus a uniform light reflection distribution may be provided. The bridge portion 154 may be disposed to be lower or concave than the straight line connecting high points of the adjacent reflection cells S7 or high points of the convex portion S5.

Referring to the developed view of the reflector 150 as shown in FIG. 10, a transverse length X1 may be in a range of 10 mm or more, for example, 10 to 40 mm, or 15 to 30 mm. A longitudinal length Y1 of the reflector 150 may be equal to or less than the transverse length X1 and may have a range of 10 mm or more, for example, 10 to 30 mm or 15 to 25 mm.

The reflective surface 151 may be disposed at a width E1 in a range of 2 mm or more, for example, 2 to 30 mm. A longitudinal length E2 of the reflective surface 151 may be smaller than the width E1 and for example, may be ⅕ or less. The width E1 of the reflective surface 151 may be the same as a transverse length of each reflection cell (e.g., S7) and may be the same as that of the reflector 150.

A longitudinal width E4 of the bridge portion 154 may be the same as or different from each other, and may be in a range of 0.2 mm or more, for example, 0.2 to 0.7 mm. The width E4 of the bridge portion 154 may be disposed in a range of 20% or less, or 12% to 16% of the longitudinal length E2 of the reflection cell S7, so that it is possible to prevent a decrease in luminous intensity in the region between the reflective surfaces 151 or between the reflection cells S7. Ratios of the convex portion and the concave portion at the reflection cell S7 may be the same as or different from each other.

As shown in FIGS. 8, 12, and 13, each reflection cell S7 of the reflective surface 151 has a convex portion S5 and a concave portion S6, and the convex portion S5 of each reflection cell S7 may be disposed in a region to be lower than the concave portion S6. The convex portion S5 at the reflection cell S7 may be disposed to be more adjacent to the light emitting device 100 than the concave portion S6. The convex portion S5 may be disposed to be adjacent to the light emitting device 100 or between the bridge portion 154 and the concave portion S6. The concave portion S6 may be disposed between the convex portion S5 and the bridge portion 154. The convex portion S5 of the reflection cell S7 may be in a curved shape and the concave portion S6 may be formed as a concave curved surface or an inclined surface connected to the curved surface of the convex portion S5. When viewed from a side cross section, the reflector 150 may be formed to have line segments connecting the convex portions S5 of each of the reflection cells S7 in a curved shape. Since the reflection cell S7 may effectively reflect incident light, it is possible to provide a uniform surface light source.

Each of the reflectors 150 may have a top view in a polygonal shape and for example, may be in a regular square or rectangular shape. Each reflection cell of the reflective surface 151 of the reflector 150 may be in a polygonal shape, for example, a triangular, square, pentagonal, or hexagonal shape.

The bridge portion 154 connecting between the reflection cells S7 may be an inflection point of the reflection cells S7 and increase a degree of freedom of the concave portion S6 and the convex portion S5 of the reflection cell S7. When the bridge portion 154 has a predetermined width, light condensing ability may be improved and tolerance at the timing of manufacturing the reflection cell S7 may be reduced. Here, a low point of the concave portion S6 in each of the reflection cells S7 may have a negative curvature compared with the bridge portion 154 or may be disposed to be at the same height as or higher than a horizontal plane of the bridge portion 154.

An inclination angle of an upper bridge portion disposed on the reflector 150 may be larger than that of a lower bridge portion adjacent to the light emitting device 100 among the plurality of bridge portions 154. For example, as shown in FIG. 12, the bridge portion 154, that is, the upper bridge portion may be inclined at a third angle R3 with respect to a horizontal straight line, and the third angle R3 may be in a range of 1 degree or more, for example, 1 to 60 degrees.

As shown in FIGS. 9 and 10, an open region 191 may be disposed at a lower portion of the reflector 150, and the open region 191 may be formed such that an emission direction of the light emitting device 100, for example, a direction of an optical axis L1 is removed, or may be included as a concave groove. Since the open region 191 removes a portion of the reflector 150 in an area adjacent to the light emitting device 100, it is possible to solve problems that hot spots are generated by light reflected from a portion of the reflector 150 adjacent to the light emitting device 100 or a control of light distribution is difficult.

A length E6 in the second direction or transverse direction of the open region 191 may be in a range of 70% or less, for example, 30% to 70% of the length E6 in the second direction or the transverse direction of the reflector 150. A length E5 in the first direction or the longitudinal direction of the open region 191 may be in a range of 6% or more, for example, 6% to 50% or 20% to 30% of the first direction or the longitudinal length Y1 of the reflector 150. The length E6 in the second direction or the transverse direction of the open region 191 may be in the range of 3 mm or more, for example, 3 to 20 mm, and the longitudinal length E5 of the open region 191 may be in the range of 2 mm or more, for example, 2 to 15 mm. Here, the lengths may have a relationship of E6>E5. The longitudinal length E5 of the open region 191 may be greater than a longitudinal depth of the light emitting device 100. The transverse length E6 of the open region 191 may be at least greater than a transverse length D1 of the light emitting device 100 so that the problem caused by the light incident from the light emitting device 100 may be reduced. When a size of the open region 191 is smaller than the above range, it is difficult to control a path of the light emitted from the light emitting device 100, or hot spots may be generated, and when the size of the open region 191 is larger than the above range, the luminous intensity may be lowered. For convenience of explanation, the length in the first direction or the vertical direction may be defined as a longitudinal length, and the length in the second direction or the transverse direction may be defined as a transverse length.

The open region 191 may have a top view in a polygonal shape or hemispherical shape, but is not limited thereto. The open region 191 may include a curved edge portion. The open region 191 may include a recess 192 a portion of which corresponding to the optical axis L1 of the light emitting device 100 or the center portion of the exit surface 101 is recessed. The recess 192 may be in a triangular or hemispherical shape. The recess 192 may be disposed in a region between the first reflective surfaces 153. Damage of the reflector 150 may be reduced via curve processing of the recess 192 and the open region 191. A maximum length in the second direction of the recess 192 may be smaller than a length in the second direction of the light emitting device 100 and the maximum length in the second direction of the recess 192 may be smaller than a length in the first direction of the light emitting device 100.

The reflector 150 may have an air gap 193 in which a rear lower portion is empty. The reflector 150 includes a material having a light reflectance of 70% or more with respect to the light emitted from the light emitting device 100. The reflector 150 may be formed as a single-layer or multilayer structure using a polymer, a metal, or a dielectric, and for example, may include a laminated structure of a metal/dielectric. The reflector 150 may include a material having a polymer, a polymer compound, or a metal. The reflector 150 may be formed of a material having a polymer filled with inorganic fine particles such as titanium dioxide ($TiO_2$), a silicone or epoxy resin, a thermosetting resin including a plastic material, or a material having high heat resistance and high light resistance. The silicone includes a white-based resin. The body may be formed of at least one selected from the group consisting of an epoxy resin, a modified epoxy resin, a silicone resin, a modified silicone resin, an acrylic resin, and a urethane resin. For example, a solid epoxy resin composition which is formed by adding an epoxy resin composed of triglycidyl isocyanurate, hydrogenated bisphenol A diglycidyl ether, etc. and an acid anhydride composed of hexahydrophthalic anhydride, 3-methylhexahydrophthalic anhydride, 4-methylhexahydrophthalic anhydride, etc. with 1,8-diazabicyclo (5,4,0) undecene-7 (DBU) as a curing agent, ethylene glycol as a co-catalyst, titanium oxide pigment, and glass fiber in the epoxy resin, partially curing by heating, and B staging may be used, and the present invention is not limited thereto. The reflector 150 may be formed as an optical film, PET, PC, PVC resin, or the like.

When the surface of the reflective surface is a metal, the reflector 150 may be formed of a layer having at least one of aluminum, chromium, silver, and barium sulfate or selected alloys thereof. The metal layer may be a layer coated with a material different from that of the reflector 150. As another example, an air gap may be filled with a reflector material at the lower portion of the reflector 150, but is not limited thereto.

Figure 14:
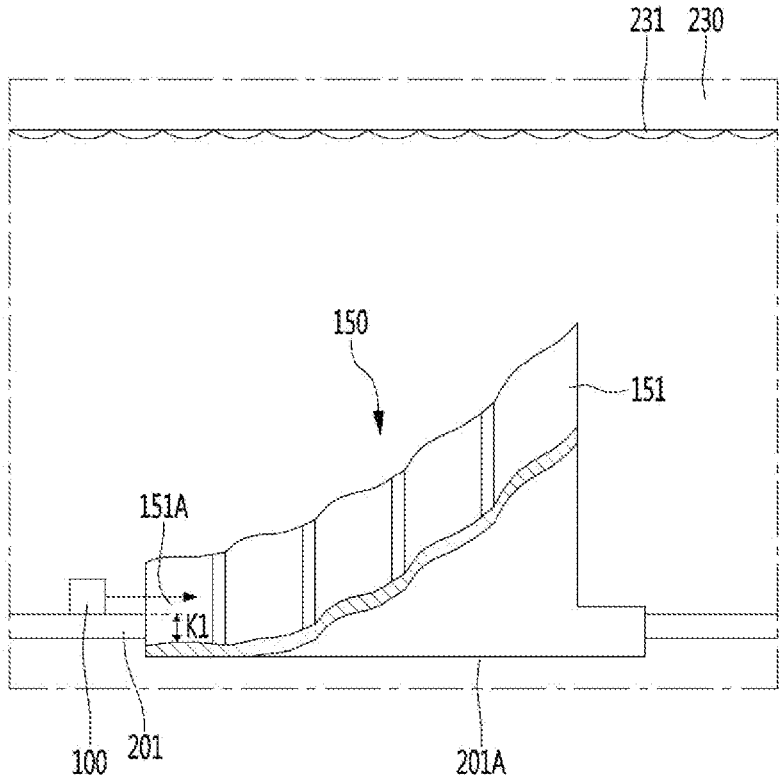
FIG. 14 is another example of the lighting device of FIG. 8.

FIG. 14 is another example of a lighting module in the lighting device of FIG. 8.

Referring to FIG. 14, in a lighting module 401, a portion of a substrate 201 may be opened, and a lower portion of the reflector 150 may be disposed in an open region 201A. A depth K1 of the open region 201A may be equal to or greater than a thickness of the lower portion of the reflector 150. An upper surface of a lower portion 151A of the reflector 150 may be disposed at the same line as the upper surface of the substrate 201 or may be disposed to be lower than the light emitting device 100. This is because, since a thickness of the light emitting device 100 is low and the size is small, most of the light emitted from the light emitting device 100 may be illuminated to a lower region of the reflector 150. To solve this problem, a lower end of the upper surface of the reflector 150 may be disposed to be lower than the upper surface of the substrate 201 so that the light emitted from the light emitting device 100 may be incident on the reflector 150 in a direction of a center region of the reflector 150. Further, the optical axis of the light emitting device 100 may be located at a higher position as compared with the third embodiment. Accordingly, incidence efficiency of the light incident on the reflector 150 may be increased, so that uniformity of the light may be improved.

Figure 15:
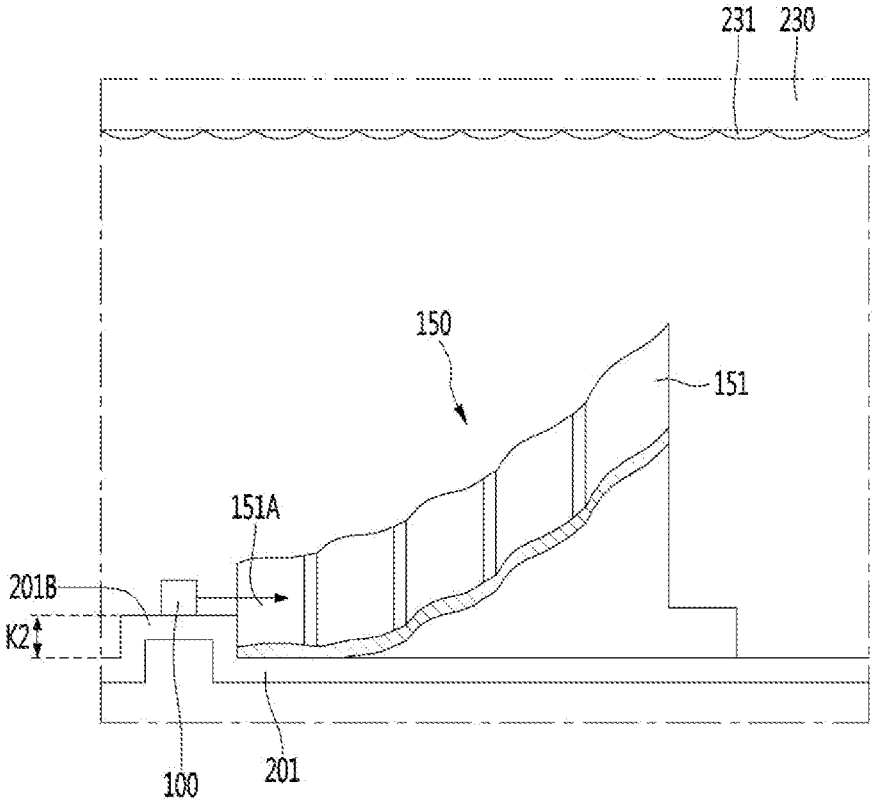
FIG. 15 is another example of the lighting device of FIG. 8.

FIG. 15 is another example of the lighting module of the lighting device of FIG. 8.

Referring to FIG. 15, an upper surface of a lower portion 151A of a reflector 150 in the lighting module may be disposed at an upper surface of a substrate 201. Here, the substrate 201 may include a mounting portion 201B on which a light emitting device 100 disposed, and the mounting portion 201B may protrude from the upper surface of the substrate 201 at a predetermined height K2. The height K2 of the mounting portion 201B may be disposed to be in a range of 1 time or more, for example, 1 to 5 times a thickness of the light emitting device 100. The height K2 of the mounting portion 201B may be a thickness or more of the reflector 150. Accordingly, an optical axis of the light emitting device 100 may be disposed to be adjacent to a center of the reflector 150, so that incidence efficiency of light may be improved and uniformity of light may be improved. In addition, the reflector 150 may uniformly receive light incident at an upward/downward spread angle with respect to the optical axis of the light emitting device 100. Here, a material of the mounting portion 201B may be a structure that protrudes from the substrate 201, or protrudes from a heat dissipation plate or a housing, but is not limited thereto.

The surface light source of such a lighting device may be provided in the form of a linear light source having a predetermined width. The lighting device according to an embodiment may be applicable to various vehicle lighting devices such as a head lamp, a side mirror lamp, a fog lamp, a tail lamp, a stop lamp, a side marker lamp, and a daytime running light, traffic lights, etc.

Figure 16:
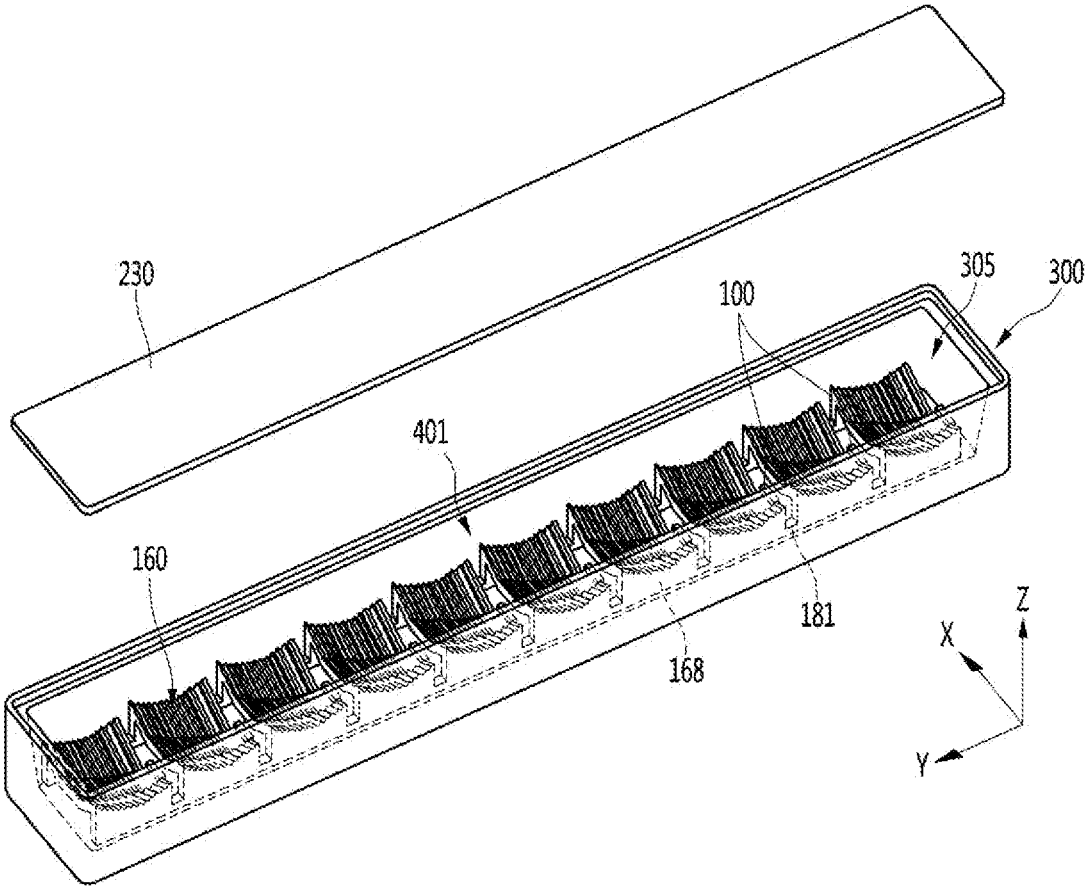
FIG. 16 is a perspective view of a lighting device having a lighting module according to a fourth embodiment.
Figure 17:
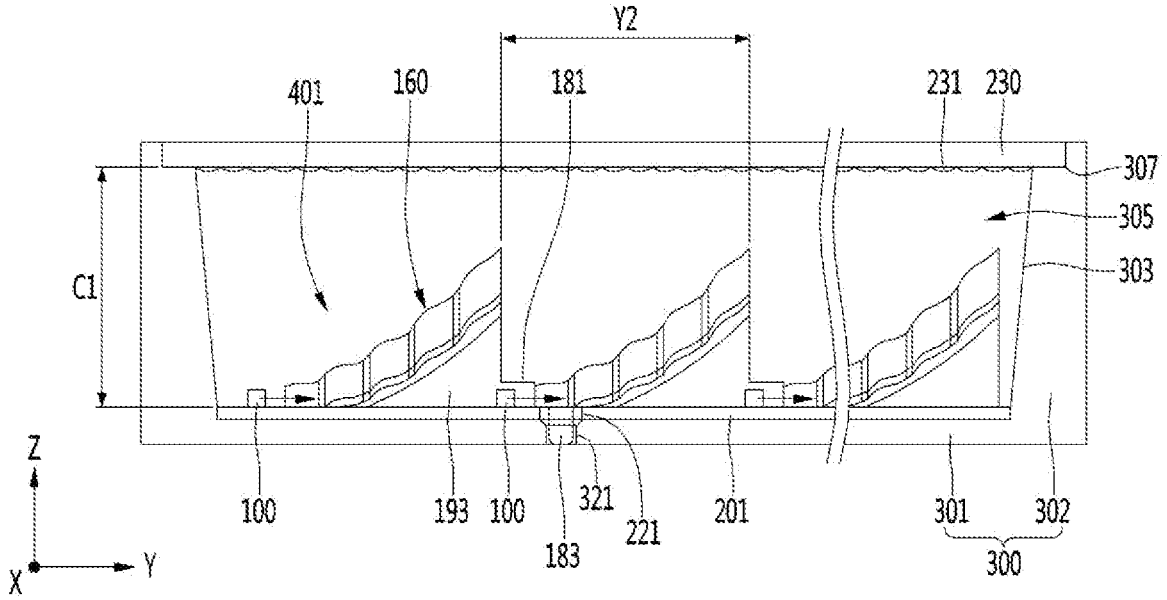
FIG. 17 is a side cross-sectional view schematically illustrating a lighting device to which an optical member of FIG. 16 is coupled.
Figure 18:
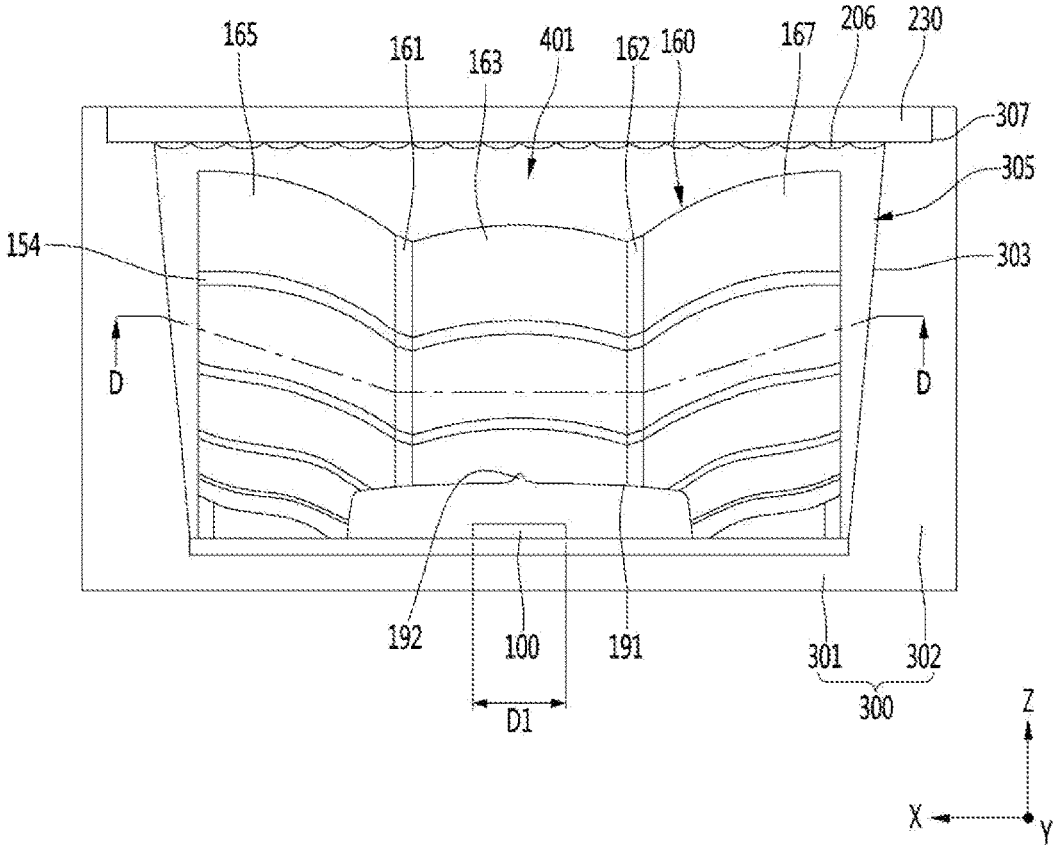
FIG. 18 is a longitudinal cross-sectional view schematically illustrating the lighting device of FIG. 17.
Figure 19:
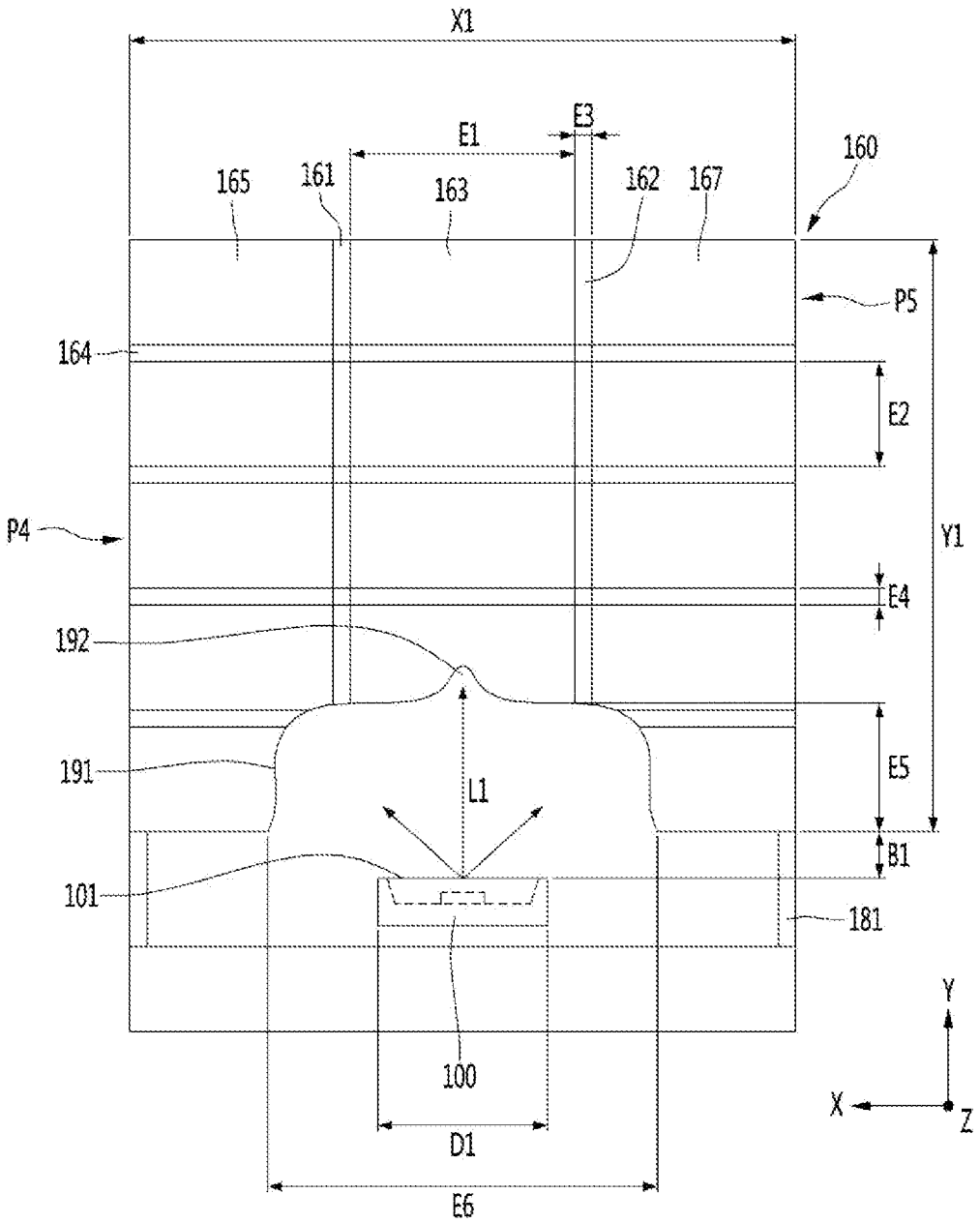
FIG. 19 is a deployed plan view of a reflector of the lighting device of FIG. 18.
Figure 20:
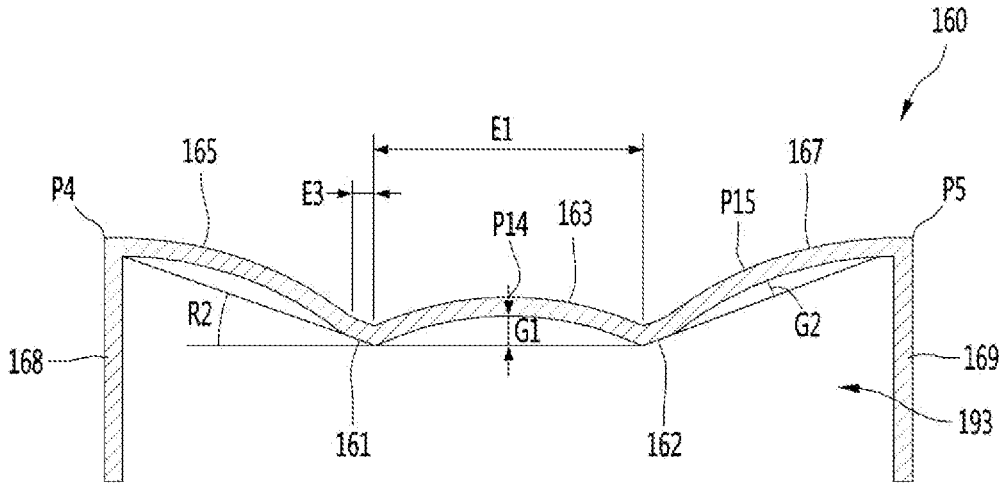
FIG. 20 is a view illustrating an example of a D-D side cross-section of the reflector of FIG. 18.
Figure 21:
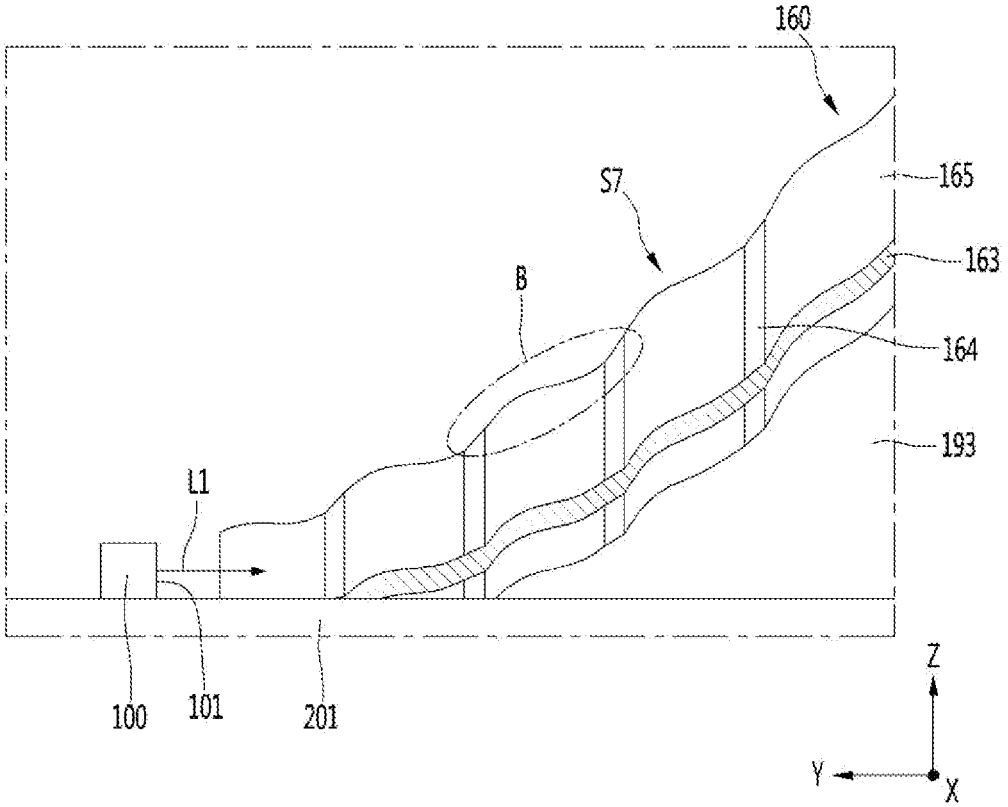
FIG. 21 is a partially enlarged view of the lighting device of FIG. 17.
Figure 22:
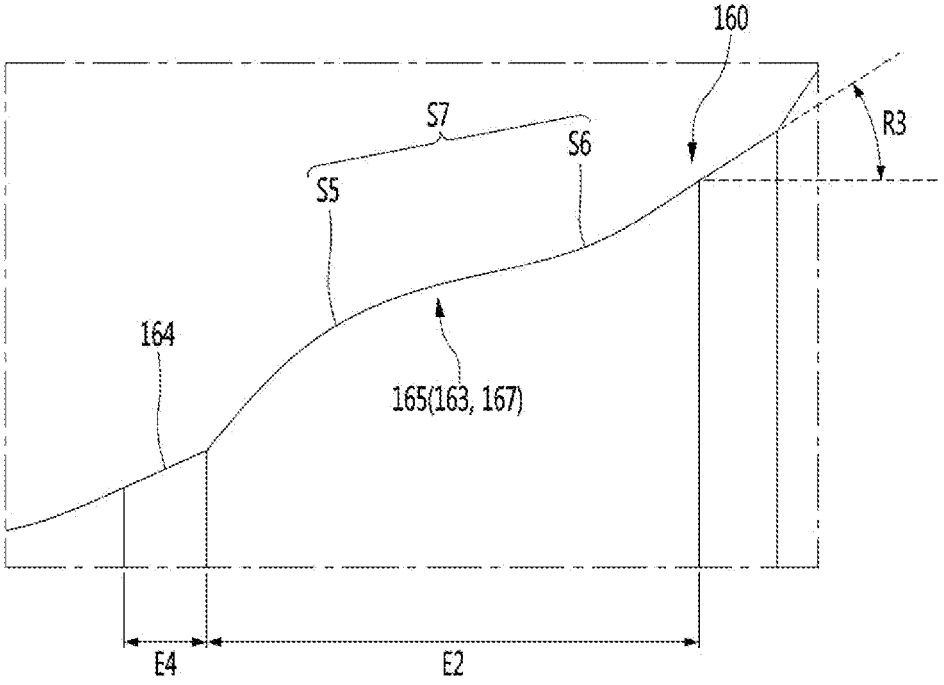
FIG. 22 is a detailed view of region B of a reflective surface of a reflector of FIG. 21.

FIG. 16 is a perspective view illustrating a lighting device according to a fourth embodiment, FIG. 17 is a side cross-sectional view of the lighting device of FIG. 16, FIG. 18 is a longitudinal cross-sectional view of the lighting device of FIG. 16, FIG. 19 is a deployed plan view of a reflector of the lighting device of FIG. 18, FIG. 20 is view illustrating an example of D-D side cross section of the reflector in FIG. 18, FIG. 21 is a partially enlarged view of the lighting device of FIG. 17, and FIG. 22 is a detailed view of a region B of a reflective surface of the reflector of FIG. 21. In describing the fourth embodiment, the same configuration as the above-described configuration refers to the above configuration, and the configurations described above may be selectively applied to the fourth embodiment.

Referring to FIGS. 16 to 22, the lighting device includes a housing 300 having a receiving space 305, a lighting module 401 disposed at a bottom of the receiving space 305 of the housing 300 and an optical member 230 disposed on the lighting module 401.

The lighting module 401 includes a substrate 201, a light emitting device 100, and a reflector 160. The substrate 201 and the light emitting device 100 is described with reference to the description disclosed in embodiment(s).

The description of the housing 300 shown in FIGS. 16 to 18 will be referred to the descriptions of FIGS. 8 and 9, and a detailed description thereof will be omitted and selectively applied.

The reflectors 160 disposed in the housing 300 may be respectively disposed in a light-emitting direction of each of the light emitting devices 100 and may be connected to each other. A connection portion 181 between the reflectors 160 may be disposed in a region between the reflectors 160 and overlapped in the second direction of the light emitting device 100. An interval Y2 between the reflectors 160 may be greater than a longitudinal length of each of the reflectors 160 and for example, may have a range of 10 to 30 mm or 15 to 25 mm. The reflector 160 may be disposed so as not to be overlapped with the light emitting device 100 in the vertical direction to easily couple the reflector 160. The interval Y2 between the reflectors 160 may be the same as the longitudinal length of the reflector 160, and in this case, an upper portion of the reflector 160 may be disposed to be overlapped with the light emitting device 100 in the vertical direction. As another example, since the upper portion of the reflector 160 disposed in each emission direction of the light emitting device 100 may extend to an upper side of another adjacent light emitting device 100, it is possible to prevent occurrence of dark portions or hot spots in a region between the adjacent reflectors 160. As another example, the upper portion of the reflector 160 disposed in each emission direction of the light emitting device 100 may be disposed to be overlapped with a lower portion of another adjacent reflector in the vertical direction. Since a portion of the adjacent reflectors 160 are overlapped with each other in the vertical direction, the light emitting device 100 may be protected, a height of the reflector 160 may be lowered and the occurrence of hot spots or dark portions in a boundary region may be prevented.

An optical member 230 may be disposed on the lighting module according to an embodiment, a plurality of lens portions 231 may be disposed in a lower portion of the optical member 230, and the incident light from the reflector 160 may be diffused so that uniform light uniformity may be provided.

Referring to FIGS. 17 to 20, the reflector 160 according to an embodiment may include a plurality of reflective surfaces 163, 165, and 167, and the reflective surfaces 163, 165, and 167 are disposed in a center region and left and right regions of the reflector 160, respectively. The reflective surfaces 163, 165, and 167 are left/right symmetrical with respect to the center of the reflector 160, and are not limited thereto. The left side may be a region located at the left side when viewed from the light emitting device 100 and the right side may be a region located at the right side when viewed from the light emitting device 100. The areas of the reflective surfaces 163, 165, and 167 of the reflector 160 may be disposed to be concave in a direction of the substrate compared with a straight line connecting opposite edges. That is, the surface of the reflector 160 may be disposed so as to have a depth gradually deeper toward the center portion. The depth may be a distance in a straight line connecting opposite edges in the first direction and opposite edges in the second direction at the surface of the reflector 160.

As shown in FIGS. 18 to 20, the reflective surfaces 163, 165, and 167 may be disposed at a center region, at least one region on the left side of the center region, and at least one region on the right side thereof. Here, the reflective surfaces 163, 165, and 167 of the reflector 160 may be the first reflective surface 163 at the center side and the reflective surfaces 165 and 167 at the side sides. The second reflective surface 165 at side may be disposed at the left side of the first reflective surface 163 and the third reflective surface 167 may be disposed at the right side of the first reflective surface 163. The first reflective surface 163 may correspond to an exit surface 101 of the light emitting device 100 and the second and third reflective surfaces 165 and 167 may be disposed at opposite outer sides of the first reflective surface 163. The second and third reflective surfaces 165 and 167 may be disposed to correspond to or face each other at opposite outer sides of the first reflective surface 163. The second and third reflective surfaces 165 and 167 may be disposed to be inclined at a predetermined angle, for example, an internal angle in a range of 91 to 150 degrees, with respect to a horizontal straight line of the first reflective surface 163. A distance between opposite edges of the second and third reflective surfaces 165 and 167 may be equal to each other or wider as it is farther from the light emitting device 100. The distance between the edges of the second and third reflective surfaces 165 and 167 may be disposed to be gradually widened in consideration of an emission angle of light of the light emitting device 100.

As shown in FIG. 20, when viewed at the same horizontal straight line passing through a center P15 of the second and third reflective surfaces 165 and 167, the horizontal straight line passing through the center P15 may be disposed at a position higher than an entire region or a center P14 of the first reflective surface 163. A maximum convex depth G1 of the back surface of the first reflective surface 163 may be greater than a maximum convex depth G2 of the back surfaces of the second and third reflective surfaces 165 and 167, so that the reflection efficiency of light may be improved. The second or third reflective surface 165 or 167 may be disposed to be inclined at a predetermined angle R2 in a range of 60 degrees or less, for example, 15 to 45 degrees with respect to a horizontal straight line connecting the left and right ends. A uniform light reflection distribution may be provided by the second and third reflective surfaces 165 and 167 and the first reflective surface 163.

Referring to the developed view of the reflector 160 as shown in FIG. 19, a transverse length X1 may be in a range of 10 mm or more, for example, 10 to 40 mm, or 15 to 30 mm. A longitudinal length Y1 of the reflector 160 may be equal to or less than the transverse length X1 and may have a range of 10 to 30 mm or 15 to 25 mm.

The first reflective surface 163 may be disposed at a width E1 in a range of 2 mm or more, for example, 2 to 15 mm, and the second and third reflective surfaces 165 and 167 may be disposed at a width in a range of 2 mm or more, for example, 2 to 15 mm in opposite side directions from the first reflective surface 163. A longitudinal length E2 of the reflective surfaces 163, 165, and 167 may be smaller than the width E1.

The reflective surfaces 163, 165, and 167 may be separated by first bridge portions 161 and 162 disposed in the vertical direction. Each reflection cell S7 (see FIG. 21) of each of the reflective surfaces 163, 165, and 167 may be separated by a second bridge portion 164 disposed in the transverse direction. The first bridge portions 161 and 162 may connect the reflective surfaces 163, 165 and 167 disposed in the transverse direction and the second bridge portion 164 may connect the reflection cells disposed in the vertical direction to each other. The first bridge portions 161 and 162 and the second bridge portion 164 may be orthogonal to each other and may be formed as inclined planes.

A length of the first bridge portions 161 and 162 may be the same as that of the reflective surface in the second direction. A maximum length of the second bridge portion 164 may be the same as that of the reflective surface in the first direction.

The first bridge portions 161 and 162 and the second bridge portion 164 may intersect with each other at least once. The adjacent plurality of first bridge portions 161 and 162 may be parallel to each other or at least one of the plurality of second bridge portions 164 may be disposed to be tilted. The first bridge portions 161 and 162 and the second bridge portion 164 may be disposed along between the convex portions in the first and second directions. The first bridge portions 161 and 162 and the second bridge portion 164 may be disposed to be lower or concave compared with the straight line connecting the convex portions disposed in the first and second directions.

The number of the first bridge portions 161 and 162 and the second bridge portions 164 may be equal to each other or the number of the second bridge portions 164 may be greater than that of the first bridge portions 161 and 162, but is not limited thereto. The number of the first bridge portions 161 and 162 may be smaller than that of the reflective surfaces 163, 165, and 167 and the number of the second bridge portions 164 may be smaller than that of the reflection cells S7 of the reflective surfaces 163, 165, and 167.

Transverse and longitudinal widths E3 and E4 of the first bridge portions 161 and 162 and the second bridge portion 164 may be the same as or different from each other and may be in a range of 0.2 mm or more, for example, 0.2 to 0.7 mm. Since the widths E3 and E4 of the first bridge portions 161 and 162 and the second bridge portion 164 may be disposed in a range of 20% or less, for example, 12 to 16% of a transverse or longitudinal length of the reflection cell, it is possible to prevent a decrease in luminous intensity in the region between the reflective surfaces 163, 165, and 167 or between the reflection cells S7 (see FIG. 21). The ratios of the convex portion S5 and the concave portion S6 may be the same or different from each other.

As shown in FIGS. 17, 21, and 22, the reflective surfaces 163, 165, and 167 include a reflection cell S7 having a convex portion S5 and a concave portion S6, and in each of the reflection cells S7, the convex portion S5 may be disposed at a region lower than the concave portion S6. The convex portion S5 at the reflection cell S7 may be disposed to be closer to the light emitting device 100 than the concave portion S6. The convex portion S5 may be disposed to be adjacent to the light emitting device 100 or between the second bridge portion 164 and the concave portion S6. The concave portion S6 may be disposed between the convex portion S5 and the second bridge portion 164. The convex portion S5 of the reflection cell S7 may be in a curved shape and the concave portion S6 may be formed as a concave curved surface or an inclined surface connected to the curved surface of the convex portion S5. When viewed from a side cross section, the reflector 160 may be formed to have line segments connecting the convex portions S5 of each of the reflection cells S7 in a curved shape. Since the reflection cell S7 may effectively reflect incident light, it is possible to provide a uniform surface light source.

Each of the reflectors 160 may have a top view in a polygonal shape and for example, may be in a regular square or rectangular shape. Each reflection cell of the reflective surfaces 163, 165, and 167 of the reflector 160 may be in a polygonal shape, for example, a triangular, square, pentagonal, or hexagonal shape.

The first bridge portions 161 and 162 and the second bridge portion 164 connecting between the reflection cells S7 may be inflection points of the reflection cells S7 and increase a degree of freedom of the concave portion S6 and the convex portion S5 of the reflection cell S7. When the first bridge portions 161 and 162 and the second bridge portion 164 have a predetermined width, light condensing ability may be improved and tolerance at the timing of manufacturing the reflection cell S7 may be reduced. Here, a low point of the concave portion S6 in each of the reflection cells S7 may have a negative curvature compared with the first bridge portions 161 and 162 and the second bridge portion 164 or may be disposed to be at the same height as or higher than a horizontal plane of the first bridge portions 161 and 162 and the second bridge portion 164.

An inclination angle of an upper bridge portion disposed on the reflector 160 may be larger than that of a lower bridge portion adjacent to the light emitting device 100 among the plurality of second bridge portions 164. For example, as shown in FIG. 21, the second bridge portion 164, that is, the upper bridge portion may be inclined at the third angle R3 with respect to a horizontal straight line, and the third angle R3 may be in a range of 1 degree or more, for example, 1 to 60 degrees.

As shown in FIGS. 18 and 19, an open region 191 may be disposed at a lower portion of the reflector 160, and the open region 191 may be recessed in a direction of the emission side, for example, in a direction of an optical axis L1 of the light emitting device 100. Since the open region 191 removes a portion of the reflector 160 in an area adjacent to the light emitting device 100, it is possible to solve problems that hot spots are generated by light reflected from a portion of the reflector 160 adjacent to the light emitting device 100 or a control of light distribution is difficult.

A transverse length E6 of the open region 191 may be in a range of 70% or less, for example, 30% to 65% of the transverse length X1 of the reflector 160. A longitudinal length E5 of the open region 191 may be in a range of 6% or more, for example, 6% to 50% or 20% to 30% of the longitudinal length Y1 of the reflector 160. The transverse length E6 of the open region 191 may be in the range of 3 mm or more, for example, 3 to 20 mm, and the longitudinal length E5 of the open region 191 may be in the range of 2 mm or more, for example, 2 to 16 mm. Here, the length may have a relationship of E6>E5. A longitudinal length E5 of the open region 191 may be greater than a longitudinal depth of the light emitting device 100. The transverse length E6 of the open region 191 may be at least greater than the transverse length D1 of the light emitting device 100 so that the problem caused by the light incident from the light emitting device 100 may be reduced. When a size of the open region 191 is smaller than the above range, it is difficult to control a path of the light emitted from the light emitting device 100, or hot spots may be generated, and when the size of the open region 191 is larger than the above range, the luminous intensity may be lowered.

The open region 191 may have a top view in a polygonal shape or hemispherical shape, but is not limited thereto. The open region 191 may include a curved edge portion. The open region 191 may include a recess 192 a portion of which corresponding to the optical axis L1 of the light emitting device 100 is recessed. The recess 192 may be in a triangular or hemispherical shape. The recess 192 may be disposed in a region between the first reflective surfaces 163. Damage of the reflector 160 may be reduced via curve processing of the recess 192 and the open region 191.

The reflector 160 may have an air gap 193 in which a rear lower portion is empty. The reflector 160 includes a material having a light reflectance of 70% or more with respect to the light emitted from the light emitting device 100. The reflector 160 may be formed as a single-layer or multilayer structure using a polymer, a metal, or a dielectric, and for example, may include a laminated structure of a metal/dielectric. The reflector 160 may be formed of a material having a polymer filled with inorganic fine particles such as titanium dioxide ($TiO_2$), a silicone or epoxy resin, a thermosetting resin including a plastic material, or a material having high heat resistance and high light resistance. The material of the reflector 160 may be selectively applied with reference to the description of the above-described embodiment(s). When the reflective surface is a metal, the reflector 160 may be formed of a metal layer having at least one of aluminum, chromium, silver, and barium sulfate or selected alloys thereof. The metal layer may be a layer coated with a material different from that of the reflector 160. As another example, an air gap may be filled with a reflector material at the lower portion of the reflector 160, but is not limited thereto.

Figure 23:
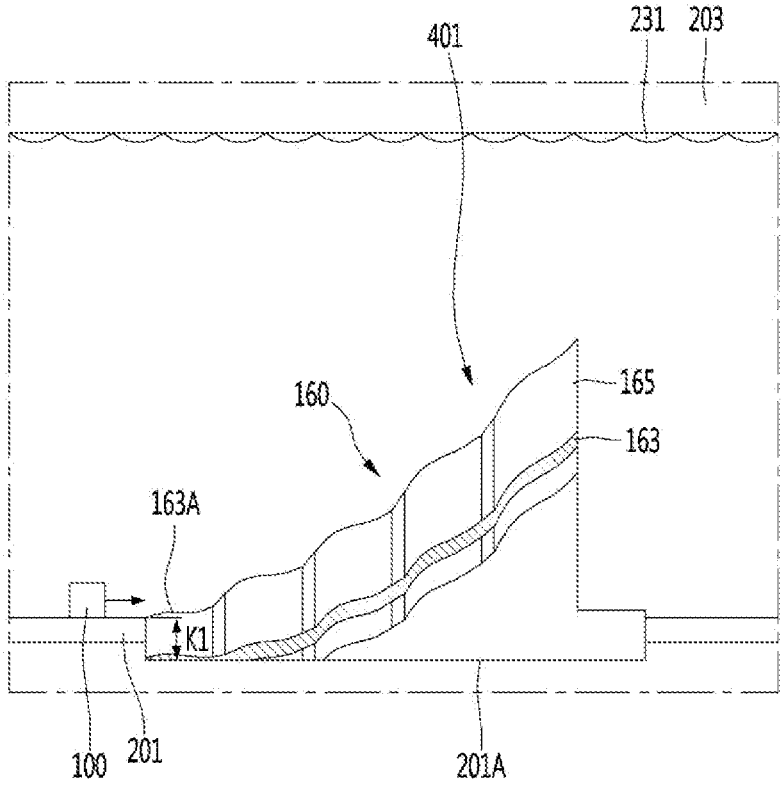
FIG. 23 is another example of the lighting device of FIG. 17.

FIG. 23 is another example of a lighting module in the lighting device of FIG. 7.

Referring to FIG. 23, in the lighting module 401, a portion of the substrate 201 may be opened, and a lower portion of the reflector 160 may be disposed in an open region 201A. A depth K1 of the open region 201A may be equal to or greater than a thickness of a portion of the reflector 160. An upper surface of a lower portion 163A of the reflector 160 may be disposed at the same line as the upper surface of the substrate 201 or may be disposed to be lower than the light emitting device 100. This is because, since a thickness of the light emitting device 100 is low and the size is small, most of the light emitted from the light emitting device 100 may be illuminated to a lower region of the reflector 160. To solve this problem, a lower end of the surface of the reflector 160 may be disposed to be lower than the upper surface of the substrate 201 so that the light emitted from the light emitting device 100 may be incident on the reflector 160 in a direction of a center region of the reflector 160. Further, the optical axis of the light emitting device 100 may be located at a higher position as compared with the fourth embodiment. Accordingly, incidence efficiency of the light incident on the reflector 160 may be increased, and uniformity of the light may be improved.

Figure 24:
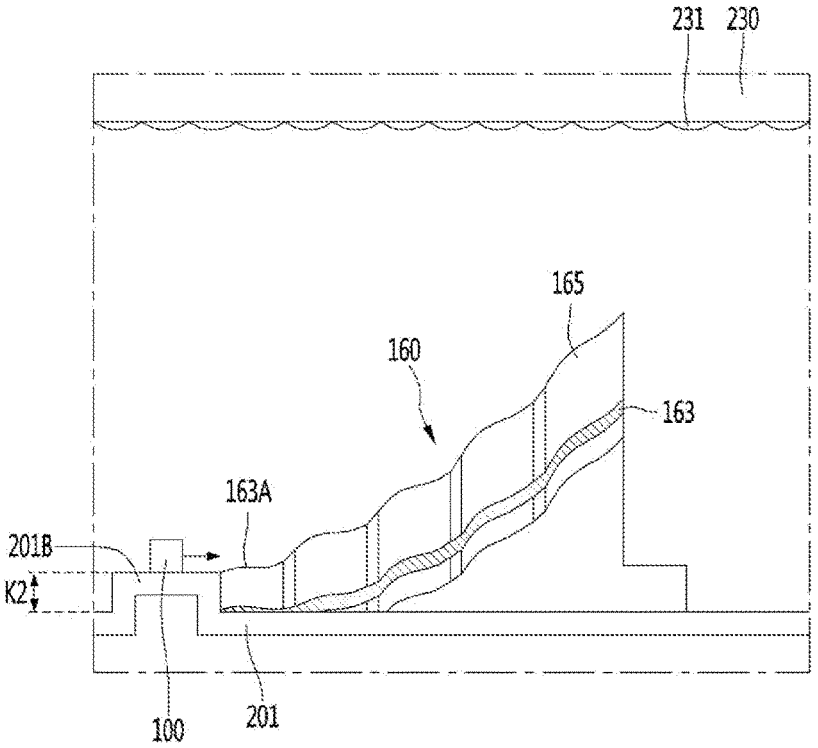
FIG. 24 is another example of the lighting device of FIG. 17.

FIG. 24 is another example of the lighting module of the lighting device of FIG. 17.

Referring to FIG. 24, an upper surface of a lower portion 163A of a reflector 160 in the lighting module may be disposed at an upper surface of a substrate 201. Here, the substrate 201 may include a mounting portion 201B on which a light emitting device 100 is disposed and the mounting portion 201B may protrude from the upper surface of the substrate 201 at a predetermined height K2. The height K2 of the mounting portion 201B may be disposed to be in a range of 1 time or more, for example, 1 to 5 times a thickness of the light emitting device 100. The height K2 of the mounting portion 201B may be a thickness or more of the reflector 160. Accordingly, an optical axis of the light emitting device 100 may be disposed to be adjacent to a center of the reflector 160, so that incidence efficiency of light may be improved and uniformity of light may be improved. In addition, the reflector 160 may uniformly receive light incident at an upward/downward spread angle of light of the light emitting device 100. Here, a material of the mounting portion 201B may be a structure that protrudes from the substrate 201, or protrudes from a heat dissipation plate or a housing, but is not limited thereto.

Fifth Embodiment

Figure 25:
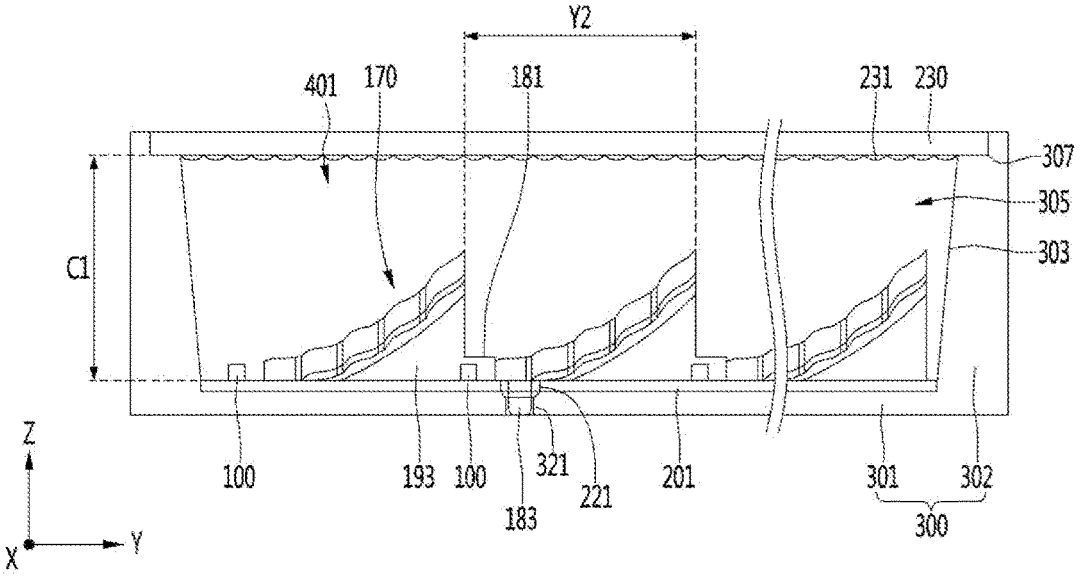
FIG. 25 is a side cross-sectional view of a lighting device having a lighting module according to a fifth embodiment.
Figure 26:
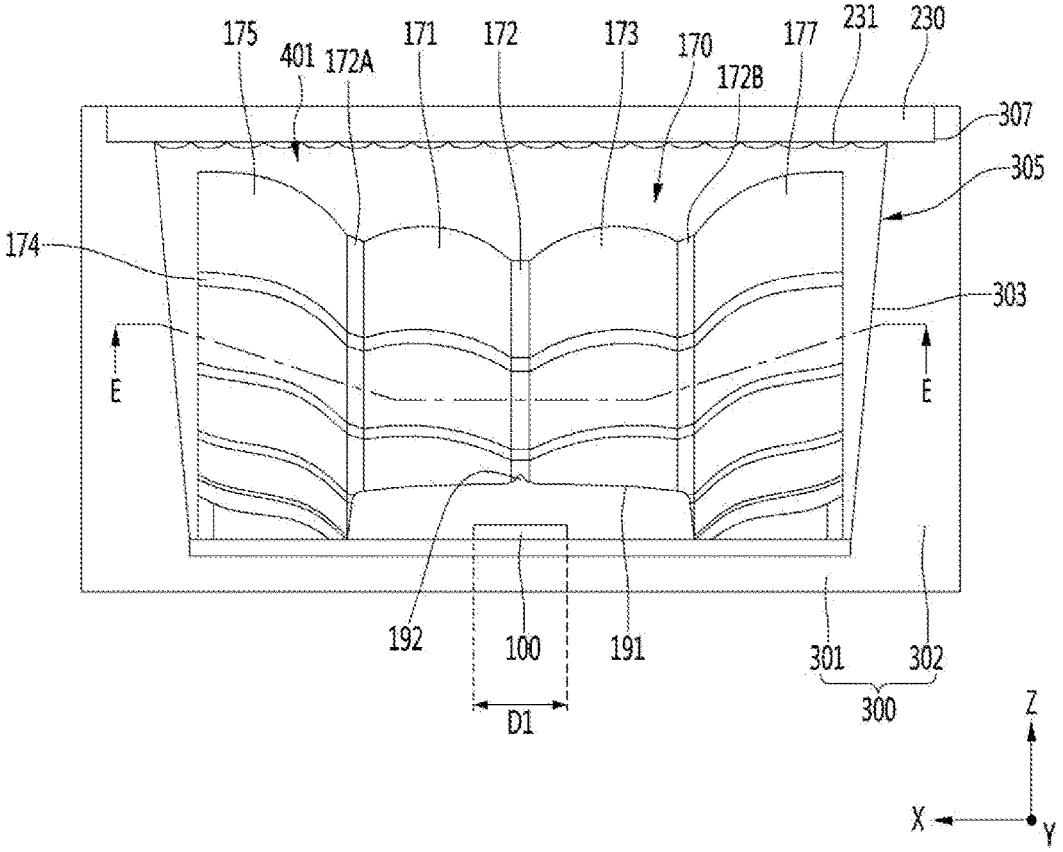
FIG. 26 is another side cross-sectional view of the lighting device of FIG. 25.
Figure 27:
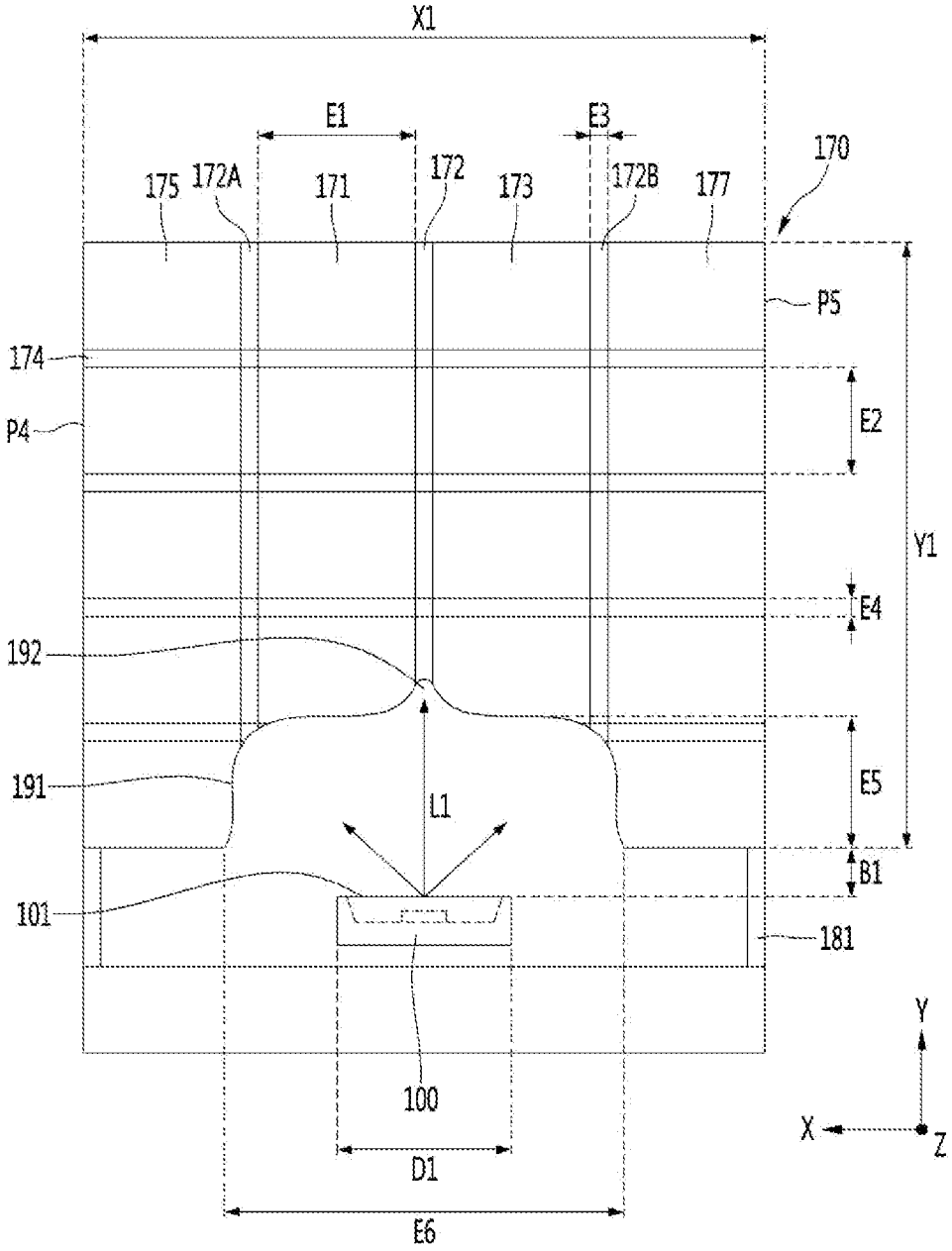
FIG. 27 is a plan view of a reflector of the lighting device of FIG. 26.
Figure 28:
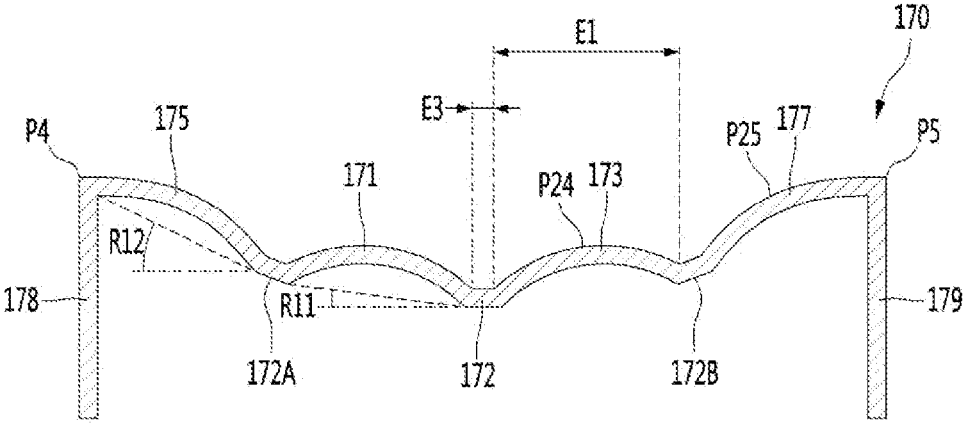
FIG. 28 is a view illustrating an E-E side cross-section of the reflector of FIG. 26.
Figure 29:
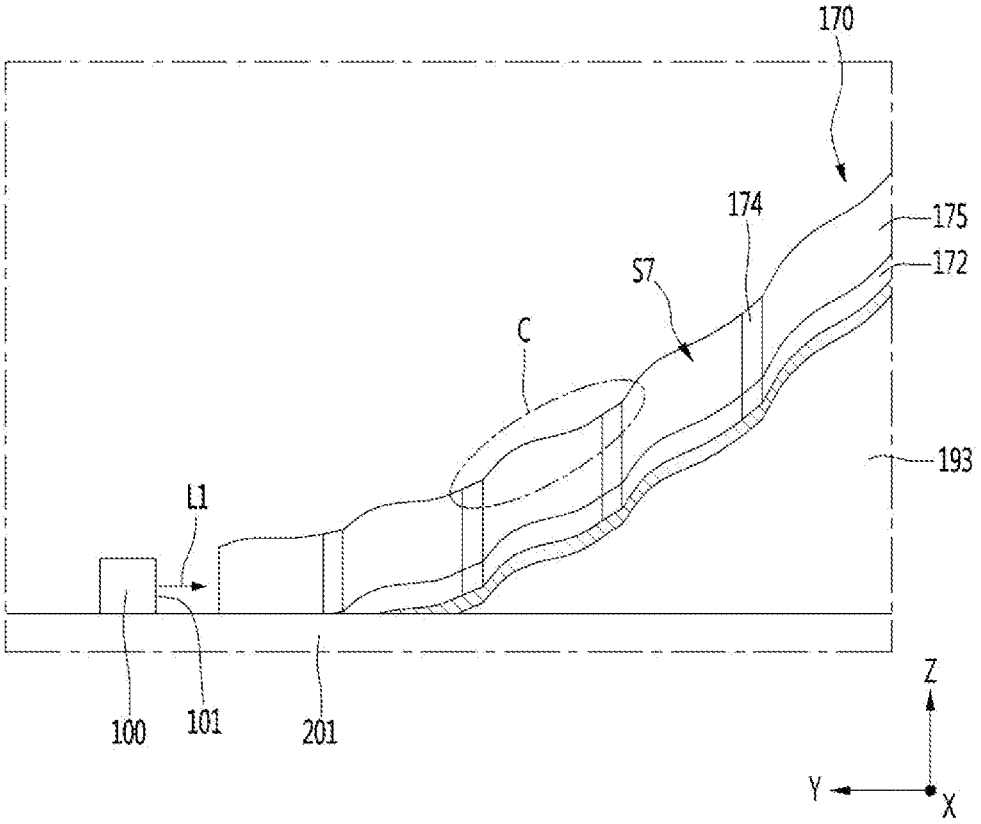
FIG. 29 is a partially enlarged view of the lighting device of FIG. 7.
Figure 30:
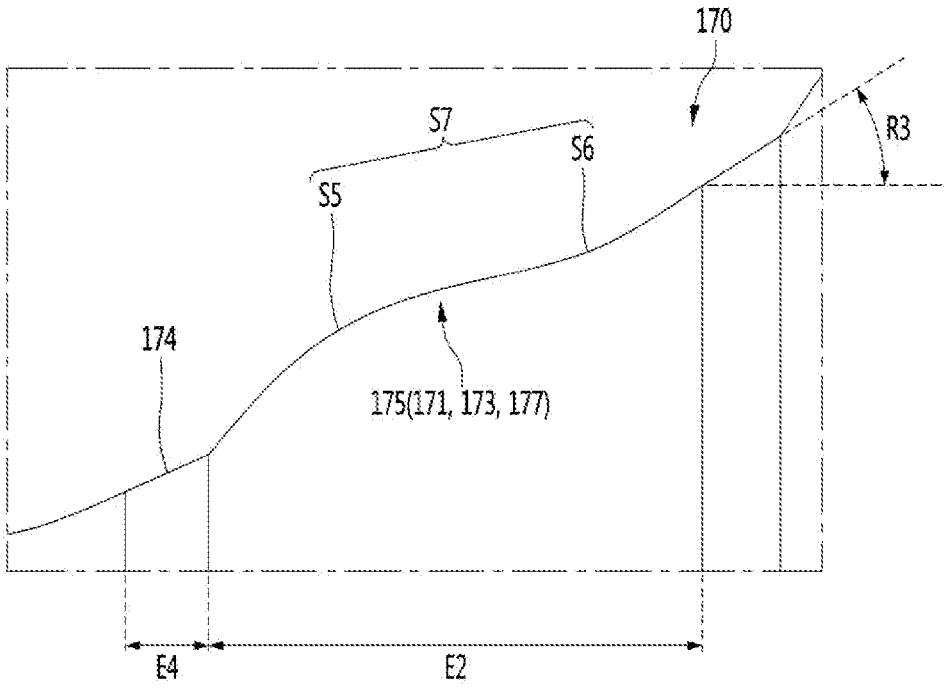
FIG. 30 is a detailed view of region C of a reflective surface of a reflector of FIG. 29.

FIG. 25 is a side cross-sectional view of a lighting device having a lighting module according to a fifth embodiment, FIG. 26 is another side cross-sectional view of the lighting device of FIG. 25, FIG. 27 is a plan view of a reflector of the lighting device of FIG. 26, FIG. 28 is a view illustrating a E-E side cross-section of the reflector of FIG. 26, FIG. 29 is a partially enlarged view of the lighting device of FIG. 25, and FIG. 30 is a detailed view of region C of a reflective surface of the reflector of FIG. 29.

Referring to FIGS. 25 to 30, the lighting device includes a housing 300 having a receiving space 305, a lighting module 401 disposed at a bottom of the receiving space of the housing 300, and an optical member 230 disposed on the lighting module. The lighting module 401 includes a substrate 201, a light emitting device 100, and a reflector 170. The description of the housing 300 will be referred to the descriptions of FIGS. 7 and 8, and a detailed description thereof will be omitted and selectively applied.

Referring to FIGS. 26 to 28, the reflector 170 may include a plurality of reflective surfaces 171, 173, 175, and 177. The regions of the reflective surfaces 171, 173, 175, and 177 may be concave in the direction of the substrate compared with a straight line connecting opposite edges to each other. The reflective surfaces 171, 173, 175, and 177 may include regions left/right line-symmetric with respect to a center line of the reflector 170. The reflective surfaces 163, 165, and 167 may not be left/right symmetrical with respect to the center line of the reflector 170, and are not limited thereto. The left side may be a region located at the left side when viewed from the light emitting device 100 and the right side may be a region located at the right side when viewed from the light emitting device 100.

At least two or more regions in the left region may be disposed and at least two or more regions in the right region may be disposed, with respect to the center line of the reflective surfaces 171, 173, 175 and 177. Here, a region adjacent to the center line among the reflective surfaces 171, 173, 175, and 177 of the reflector 170 may be reflective surfaces 171, 173, 175, and 177 at a center side, and a region disposed at an outer side of the reflective surfaces 171, 173, 175, and 177 at the center side may be side reflective surfaces 171, 173, 175, and 177.

The plurality of reflective surfaces 171, 173, 175 and 177 include first and second reflective surfaces 171 and 173 at the center side, a third reflective surface 175 disposed at an outer side of the first reflective surface 171, and a fourth reflective surface 177 disposed at an outer side of the second reflective surface 173. The first and second reflective surfaces 171 and 173 may be adjacent to an optical axial direction of the light emitting device 100 and the third and fourth reflective surfaces 175 and 177 may be disposed at opposite outer sides of the first and second reflective surfaces 171 and 173. As shown in FIG. 28, a center P25 of the third and fourth reflective surfaces 175 and 177 may be disposed at a position higher than a center P24 of the first and second reflective surfaces 171 and 173 when viewed at the same horizontal line.

Referring to FIG. 28, the first reflective surface 171 or the second reflective surface 173 may be inclined at a first angle R11 with respect to a horizontal straight line connecting left/right opposite ends, and the third reflective surface 175 or the fourth reflective surface 177 may be inclined at a second angle R12 with respect to a horizontal straight line connecting left/right opposite ends. The first angle R11 may be disposed in a range of 30 degrees or less, for example, 1 to 30 degrees, and the second angle R12 may be disposed in a range of 60 degrees or less, for example, 17 or 45 degrees. The second angle R12 may be greater than the first angle R11. As another example, the second angle R12 may be the same as the first angle R11. The light incident by the first and second angles R11 and R12 may be reflected in a uniform luminous intensity in an emission direction. Support sidewalls 178 and 179 may be disposed at opposite outer sides of the reflector 170, for example, at an outer side in the X-axis direction. Such support sidewalls 178 and 179 may extend to an upper surface of the substrate.

Referring to FIG. 27, the reflector 170 may have a transverse length X1 in a range of 10 mm or more, for example, 10 to 40 mm, or 15 to 30 mm. A longitudinal length Y1 of the reflector 170 may be equal to or less than the transverse length X1 and may have a range of 10 to 30 mm or 15 to 25 mm.

The first and second reflective surfaces 171 and 173 may be disposed at a width E1 in a range of 2 mm or more, for example, 2 to 15 mm centering on an optical axis L1 of the light emitting device 100, the third and fourth reflective surfaces 175 and 177 may be disposed at a width E1 in a range of 2 mm or more, for example, 2 to 15 mm outward from the first and second reflective surfaces 171 and 173. A longitudinal length E2 of the reflective surfaces 171, 173, 175, and 177 may be equal to or smaller than the width E1.

As shown in FIGS. 29, and 30, the reflective surfaces 171, 173, 175, and 177 include a reflection cell S7 having a convex portion S5 and a concave portion S6, and in the reflection cell S7, the convex portion S5 may be disposed at a region lower than the concave portion S6. The convex portion S5 at the reflection cell S7 may be disposed to be closer to the light emitting device 100 than the concave portion S6. Accordingly, the convex portion S5 of the reflection cell S7 may be in a curved shape and the concave portion S6 may be formed as a curved surface connected to the curved surface of the convex portion S5. Since the reflection cell S7 may effectively reflect incident light, it is possible to provide a uniform surface light source.

The region between the reflection cells S7 may include first bridge portions 172,172A and 172B and a second bridge portion 174 and the first bridge portions 172, 172A and 172B and the second bridge portion 174 may connect the reflection cells S7 and may be a horizontal plane or an inclined plane. The first bridge portions 172, 172A and 172B and the second bridge portion 174 may be an inflection point of the reflection cells S7 and increase a degree of freedom of the concave portion S6 and the convex portion S5 of the reflection cell S7. When the first bridge portions 172, 172A and 172B and the second bridge portion 174 have a predetermined width, light condensing ability may be improved and tolerance at the timing of manufacturing the reflection cell S7 may be reduced. Here, a low point of the concave portion S6 may have a negative curvature compared with the first bridge portions 172, 172A and 172B and the second bridge portion 174 or may be disposed to be at the same height as or higher than a horizontal plane of the first bridge portions 172, 172A and 172B and the second bridge portion 174.

As shown in FIGS. 27 and 28, the first bridge portions 172, 172A and 172B and the second bridge portion 174 may include a first bridge portion 172 disposed in the lateral direction between the plurality of reflective surfaces 171, 173, 175 and 177, and a second bridge portion 174 disposed in the longitudinal direction at each of the reflective surfaces 171, 173, 175 and 177, and the number of the first bridge portions 172, 172A and 172B and the second bridge portions 174 may be equal to each other or the number of the second bridge portions 174 may be greater than that of the first bridge portions 172, 172A and 172B, but is not limited thereto. The number of the first bridge portions 172, 172A and 172B may be smaller than that of the reflective surfaces 171, 173, 175 and 177 and the number of the second bridge portions 174 may be smaller than that of the reflection cells S7 of each of the reflective surfaces 171, 173, 175 and 177. As shown in FIG. 27, horizontal and longitudinal widths E3 and E4 of the first bridge portions 172, 172A and 172B and the second bridge portion 174 may be the same as or different from each other and may be in a range of 0.2 mm or more, for example, 0.2 to 0.7 mm or 0.3 to 0.7 mm. Since the widths E3 and E4 of the first bridge portions 172, 172A and 172B and the second bridge portion 174 may be disposed in a range of 20% or less, for example, 12 to 16% of a transverse or longitudinal length of the reflection cell, it is possible to prevent a decrease in luminous intensity in the region between the reflection cells S7.

The first bridge portions 172, 172A and 172B and the second bridge portion 174 may intersect with each other at least once. The plurality of first bridge portions 172, 172A and 172B may be parallel to each other or at least one of the plurality of second bridge portions 174 may be disposed to be tilted. The outer bridge portion between the third and fourth reflective surfaces 175 and 177 among the plurality of first bridge portions 172, 172A and 172B may be disposed to be tilted with respect to the inner bridge portion between the first and second reflective surfaces 171 and 173. The plurality of second bridge portions 174 may be disposed to be parallel to each other or at least one of the plurality of second bridge portions 174 may be tilted. The upper bridge portion disposed at an upper portion of the reflector 170 may be disposed to be tilted with respect to the lower bridge portion adjacent to the light emitting device 100 among the plurality of second bridge portions 174. As shown in FIG. 30, the second bridge portion 174 may be inclined at a third angle R3 with respect to a horizontal straight line, and the third angle R3 may be in a range of 1 degree or more, for example, 1 to 60 degrees.

Each of the reflectors 170 may have a top view in a polygonal shape and for example, may be in a regular square or rectangular shape. Each reflection cell of the reflective surface of the reflector 170 may be in a polygonal shape, for example, a triangular, square, pentagonal, or hexagonal shape.

When viewed from a side cross section, the reflector 170 may be formed to have line segments connecting the convex portions S5 of each of the reflection cells in a curved shape.

An open region 191 may be disposed at a lower portion of the reflector 170, and the open region 191 may be recessed in a direction of the emission, for example, in the direction of the optical axis L1 of the light emitting device 100. Since the open region 191 removes a portion of the reflector 170 in an area adjacent to the light emitting device 100, it is possible to solve problems that hot spots are generated by light reflected from a portion of the reflector 170 adjacent to the light emitting device 100 or a control of light distribution is difficult.

A transverse length E6 of the open region 191 may be in a range of 70% or less, for example, 30% to 65% of the transverse length X1 of the reflector 170. A longitudinal length E5 of the open region 191 may be in a range of 6% or more, for example, 6% to 50% or 20% to 30% of the longitudinal length Y1 of the reflector 170. Here, the length may have a relationship of E6>E5. The transverse length E6 of the open region 191 may be in the range of 3 mm or more, for example, 3 to 20 mm, and the longitudinal length E5 of the open region 191 may be in the range of 2 mm or more, for example, 2 to 15 mm. The transverse length E6 of the open region 191 may be at least greater than a transverse length D1 of the light emitting device 100 so that the problem caused by the light incident from the light emitting device 100 may be reduced. A longitudinal length E5 of the open region 191 may be greater than a longitudinal depth of the light emitting device 100. When a size of the open region 191 is smaller than the above range, it is difficult to control a path of the light emitted from the light emitting device 100, or hot spots may be generated, and when the size of the open region 191 is larger than the above range, the luminous intensity may be lowered.

The open region 191 may have a top view in a polygonal shape or hemispherical shape, but is not limited thereto. The open region 191 may include a curved edge portion. The open region 191 may include a recess 192 a portion of which corresponding to the optical axis L1 of the light emitting device 100 is recessed. The recess 192 may be in a triangular or hemispherical shape. The recess 192 may be disposed in the region between the first and second reflective surfaces 171 and 173 or may be disposed at the bridge portions 172, 172A, and 172B between the first and second reflective surfaces 171 and 173. Damage of the reflector 170 may be reduced via curve processing of the recess 192 and the open region 191.

The reflector 170 may have an air gap 193 in which a lower portion is empty. The reflector 170 includes a material having a light reflectance of 70% or more with respect to the light emitted from the light emitting device 100. The reflector 170 may be formed as a single-layer or multilayer structure using a polymer, a metal, or a dielectric, and for example, may include a laminated structure of a metal/dielectric. The reflector 170 may include a material having a polymer, a polymer compound, or a metal. The reflector 170 may be formed of a material having a polymer filled with inorganic fine particles such as titanium dioxide ($TiO_2$), a silicone or epoxy resin, a thermosetting resin including a plastic material, or a material having high heat resistance and high light resistance. The material of the reflector 170 may be selectively applied with reference to the description of the above-described embodiment(s). When the surface of the reflective surface is a metal, the reflector 170 may be formed of a layer having at least one of aluminum, chromium, silver, and barium sulfate or selected alloys thereof. The metal layer may be a layer coated with a material different from that of the reflector 170. As another example, an air gap may be filled with a reflector material at the lower portion of the reflector 170, but is not limited thereto.

As shown in FIG. 25, the reflector 170 may be respectively disposed in a light-emitting direction of each light emitting device 100, and may be connected to each other. A connection portion 181 between the reflectors 170 may be disposed in a region between the reflectors 170 and overlapped in the second direction of the light emitting device 100. An interval Y2 between the reflectors 170 may be greater than a longitudinal length of each of the reflectors 170 and for example, may have a range of 10 to 30 mm or 15 to 25 mm. The reflector 170 may be disposed so as not to be overlapped with the light emitting device 100 in the vertical direction to easily couple the light emitting device 100. The interval Y2 between the reflectors 170 may be the same as the longitudinal length of the reflector 170, and in this case, the upper portion of the reflector 170 may be disposed to be overlapped with the light emitting device 100 in the vertical direction. As another example, since the upper portion of the reflector 170 disposed in each emission direction of the light emitting device 100 may extend to an upper side of another adjacent light emitting device 100, it is possible to prevent occurrence of dark portions or hot spots in a region between the adjacent reflectors 170. As another example, the upper portion of the reflector 170 disposed in each emission direction of the light emitting device 100 may be disposed to be overlapped with a lower portion of another adjacent reflector in the vertical direction. Since a portion of the adjacent reflectors 170 are overlapped with each other in the vertical direction, the light emitting device 100 may be protected, a height of the reflector 170 may be lowered and the occurrence of hot spots or dark portions in a boundary region may be prevented.

An optical member 230 may be disposed on the lighting module according to an embodiment, a plurality of lens portions 231 may be disposed in a lower portion of the optical member 230, and the incident light from the reflector 170 may be diffused so that uniform light uniformity may be provided.

Figure 31:
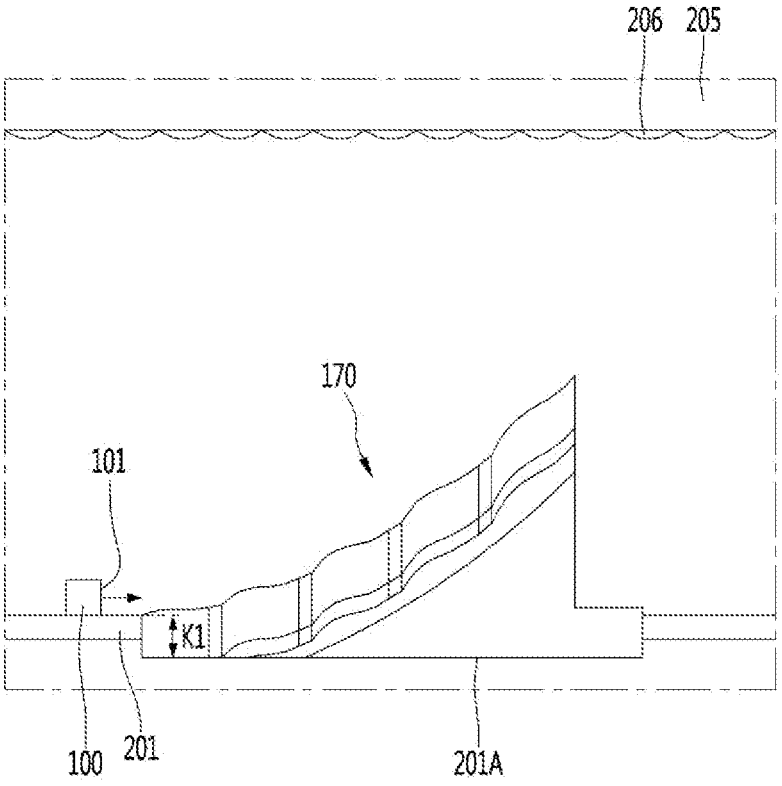
FIG. 31 is another example of the lighting device of FIG. 25.

FIG. 31 is another example of a lighting module in the lighting device of FIG. 25.

Referring to FIG. 31, in the lighting module, a portion of a substrate 201 may be opened, and a lower portion of the reflector 170 may be disposed in an open region 201A. A depth K1 of the open region 201A may be equal to or greater than a thickness of the reflector 170. A lower end of the upper surface of the reflector 170 may be disposed at the same line as the upper surface of the substrate 201 or may be disposed to be lower than the light emitting device 100. This is because, since a thickness of the light emitting device 100 is low and the size is small, most of the light emitted from the light emitting device 100 may be illuminated to a lower region of the reflector 170. To solve this problem, a lower end of an upper surface of the reflector 170 may be disposed to be lower than the upper surface of the substrate 201 so that the light emitted from the light emitting device 100 may be incident on the reflector 170 in a direction of a center region of the reflector 170. Further, the optical axis of the light emitting device 100 may be located at a higher position as compared with the third embodiment. Accordingly, incidence efficiency of the light incident on the reflector 170 may be increased, so that uniformity of the light may be improved.

Figure 32:
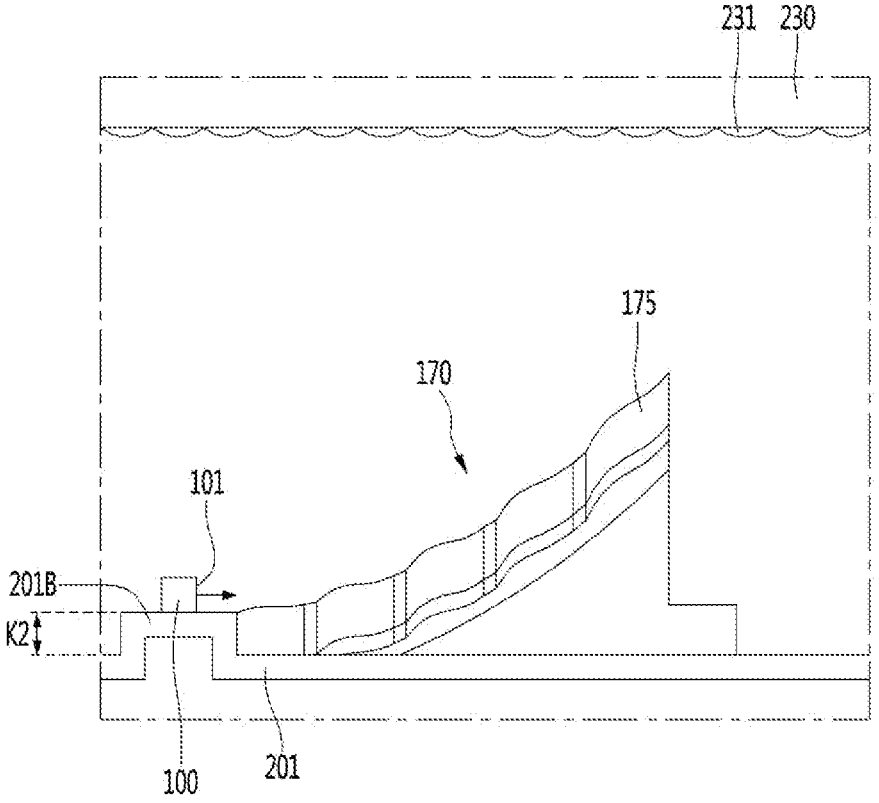
FIG. 32 is another example of the lighting device of FIG. 25.

FIG. 32 is another example of the lighting module of the lighting device of FIG. 25.

Referring to FIG. 32, a lower end of an upper surface of a reflector 170 in the lighting module may be disposed at an upper surface of a substrate 201. Here, the substrate 201 may include a mounting portion 201B on which a light emitting device 100 is disposed and the mounting portion 201B may protrude from the upper surface of the substrate 201 at a predetermined height K2. The height K2 of the mounting portion 201B may be disposed to be in a range of 1 time or more, for example, 1 to 5 times a thickness of the light emitting device 100. The height K2 of the mounting portion 201B may be a thickness or more of the reflector 170. Accordingly, an optical axis of the light emitting device 100 may be disposed to be adjacent to a center of the reflector 170, so that incidence efficiency of light may be improved and uniformity of light may be improved. In addition, the reflector 170 may uniformly receive light incident at an upward/downward spread angle of light of the light emitting device 100. Here, a material of the mounting portion 201B may be a structure that protrudes from the substrate 201, or protrudes from a heat dissipation plate or a housing, but is not limited thereto.

Figure 33:
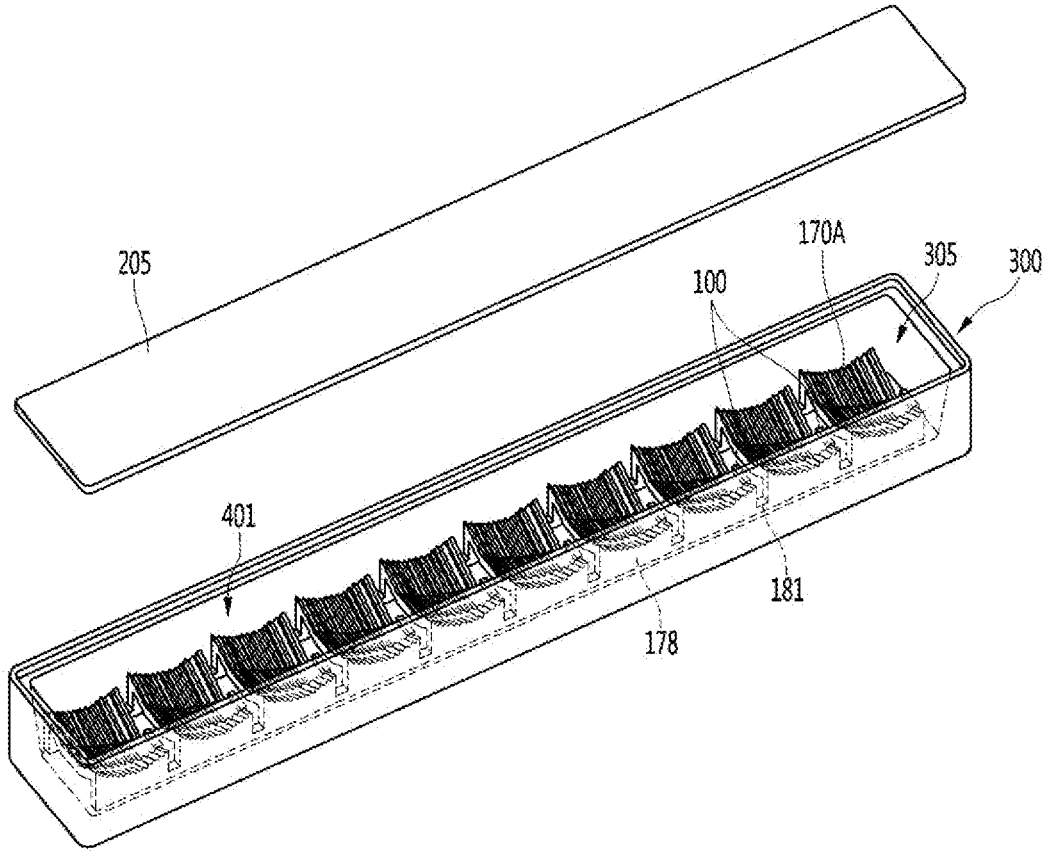
FIG. 33 is a side cross-sectional view of a lighting device having a lighting module as a modified example of the fourth embodiment.
Figure 34:
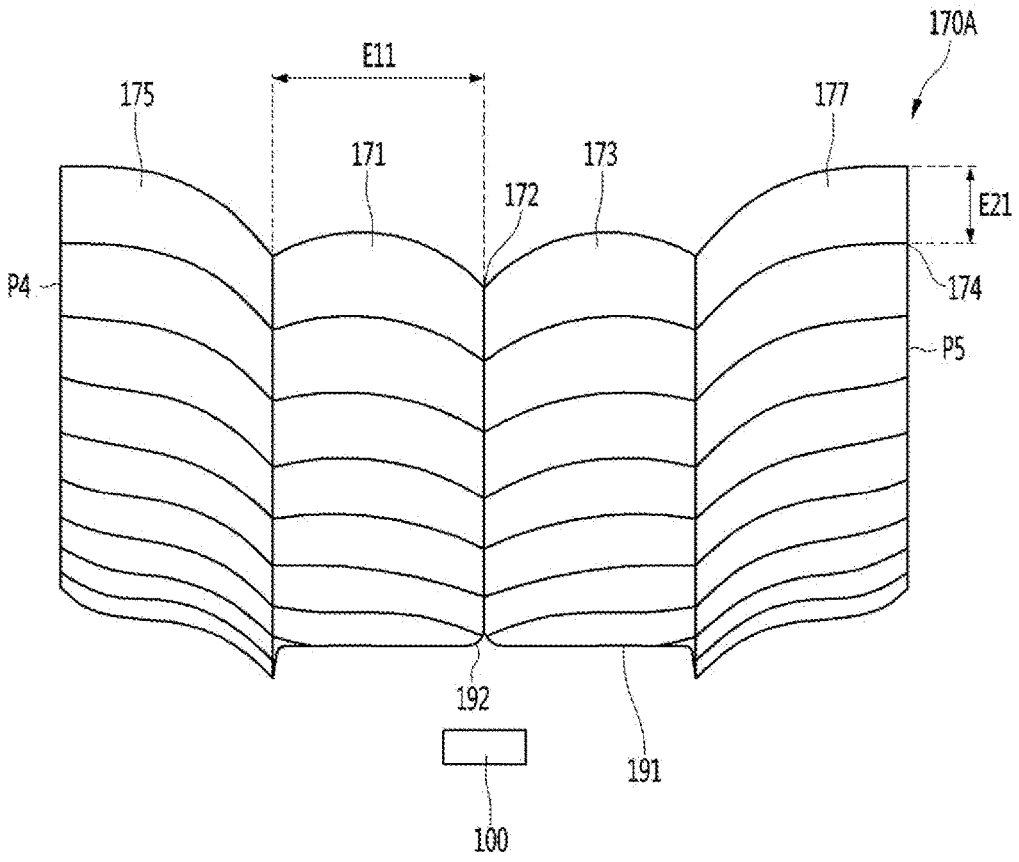
FIG. 34 is an example of a reflector of the lighting device of FIG. 33.
Figure 35:
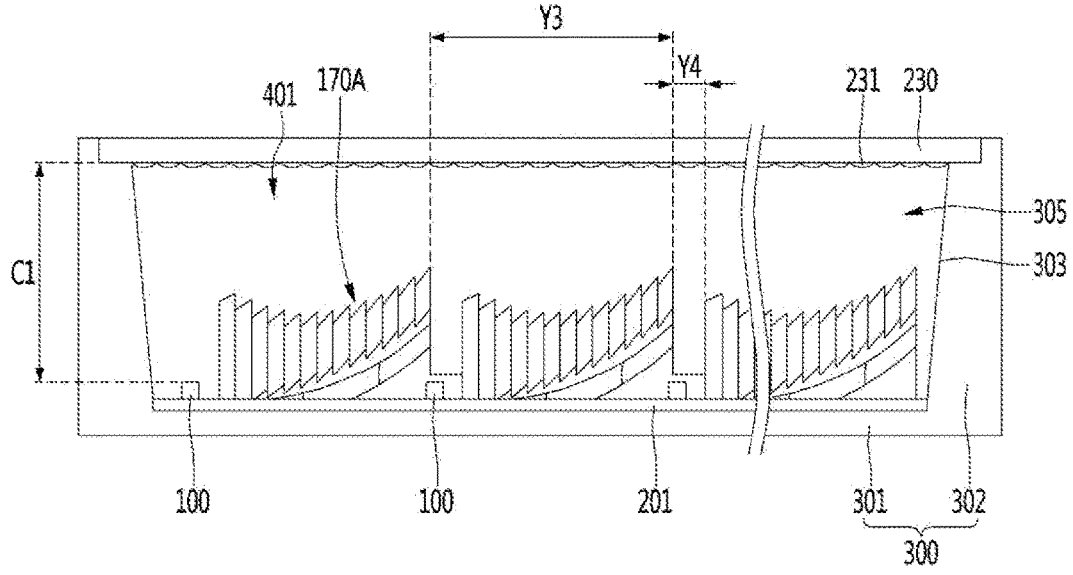
FIG. 35 is an example of a side cross-sectional view of the lighting device of FIG. 33.

FIGS. 33 to 35 are another example of the lighting module of the lighting device of FIG. 25. In describing the lighting device according to the third embodiment, the same configuration as that of the above configuration is described with reference to the above description.

Referring to FIGS. 33 to 35, the lighting device includes a housing 300, a substrate 201 disposed at a receiving space of the housing 300, a plurality of light emitting devices 100 on the substrate 201, a reflector 170A in a direction of emission of the plurality of light emitting devices 100, and an optical member 230 on the reflector 170A. An interval Y3 (see FIG. 35) between the reflectors 170A may be greater than a longitudinal length of each of the reflectors 170A and for example, may have a range of 10 to 30 mm or 15 to 25 mm. The interval Y3 between the reflectors 170A may be the same as the longitudinal length of the reflector 170A, and in this case, an upper portion of the reflector 170A may be disposed to be overlapped with the light emitting device 100 in the vertical direction. The plurality of reflectors 170A are disposed in a direction of emission of each of the light emitting devices 100 and the plurality of reflectors 170A are connected by a connection portion 181. A width Y3 of the connection portion 181 may be an interval between the reflectors 170A.

The upper portion of the reflector 170A disposed in each emission direction of the light emitting device 100 may extend to an upper side of another adjacent light emitting device 100. Accordingly, it is possible to prevent occurrence of dark portions or hot spots in a region between adjacent reflectors 170A. As another example, the upper portion of the reflector 170A disposed in each emission direction of the light emitting device 100 may be disposed to be overlapped with a lower portion of another adjacent reflector in the vertical direction. Since a portion of the adjacent reflectors 170A are overlapped with each other in the vertical direction, the light emitting device 100 may be protected, a height of the reflector 170A may be lowered and the occurrence of hot spots or dark portions in a boundary region may be prevented.

Referring to FIG. 34, the reflector 170A has a structure in which a transverse length E11 is wider than a longitudinal length E21 of the reflection cells of the reflective surfaces 171, 173, 175 and 177, for example, the transverse length E11 may be 1.5 times or more the longitudinal length E12. Such reflection cells may have convex portions and concave portions and may be connected by first bridge portions 172, 172A, and 172B and a second bridge portion 174, and a detailed description is made with reference to the third embodiment. The longitudinal lengths of the reflection cells of such reflective surfaces 171, 173, 175 and 177 are narrowed and arranged, and thus uniformity of light can be further improved.

Figure 42:
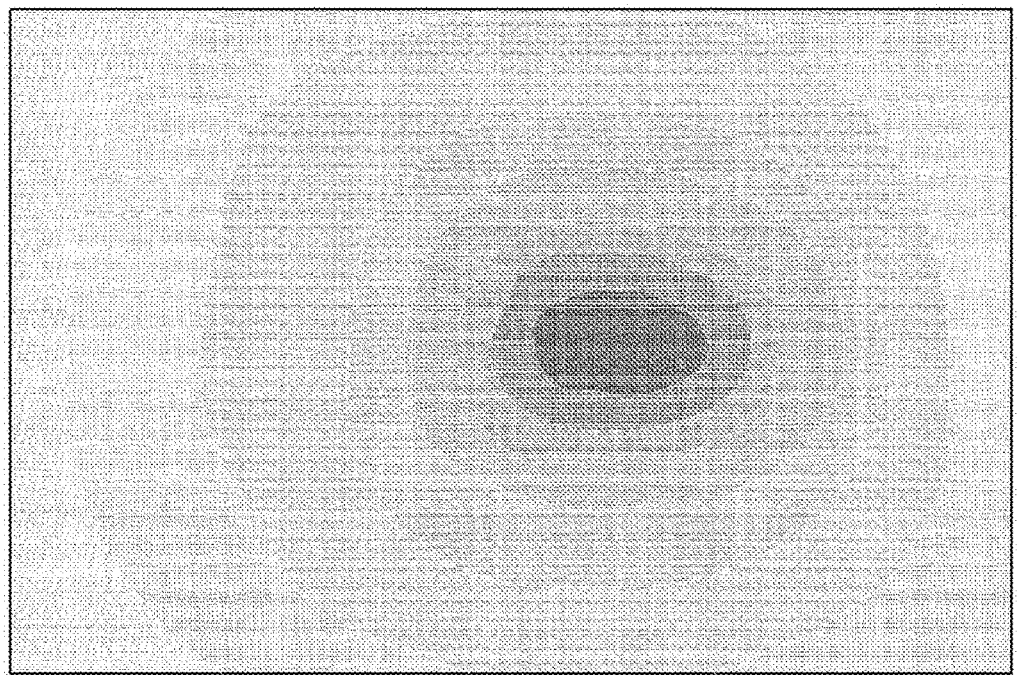
FIG. 42 is a view illustrating luminous intensity by each reflector in a lighting device according to an embodiment.
Figure 43:
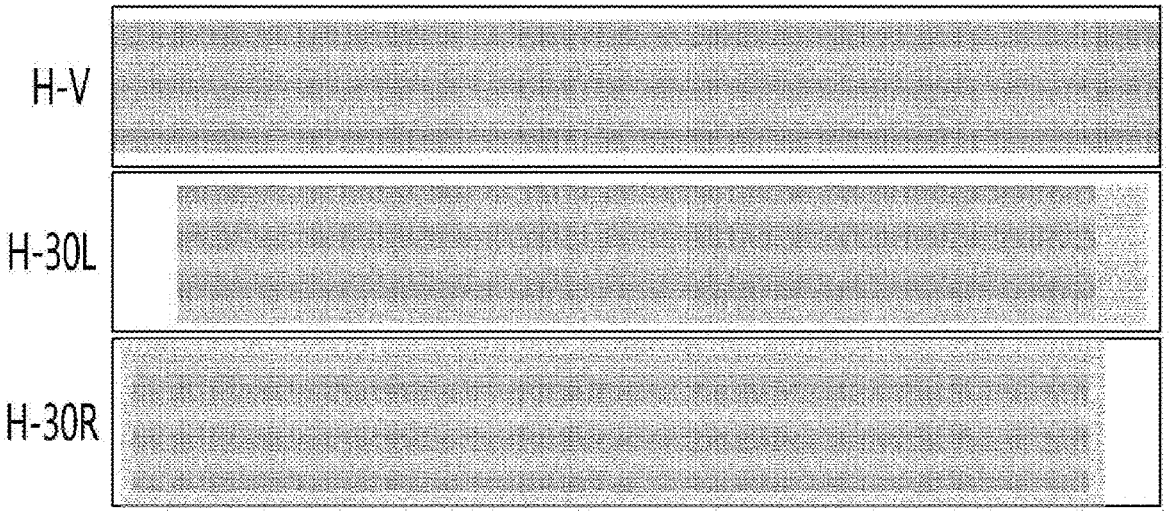
FIG. 43 is a view illustrating light distribution by a lighting device according to an embodiment.

The luminous intensity emitted from such a lighting device may appear as shown in FIG. 42, and external light uniformity may be provided as a light distribution at a center side (H-V), a left side (H-30L), or a right side (H-30R) as shown in FIG. 43. Here, H is the transverse direction, V is the vertical direction, 30L is a region at the left side of 30 degrees, and 30R is a region at the right side of 30 degrees. As shown in FIGS. 42 and 43, a surface light source may be provided in the form of a linear light source having a predetermined width. The lighting device according to an embodiment may be applicable to various vehicle lighting devices such as a head lamp, a side mirror lamp, a fog lamp, a tail lamp, a stop lamp, a side marker lamp, and a daytime running light, and traffic lights.

Figure 36:
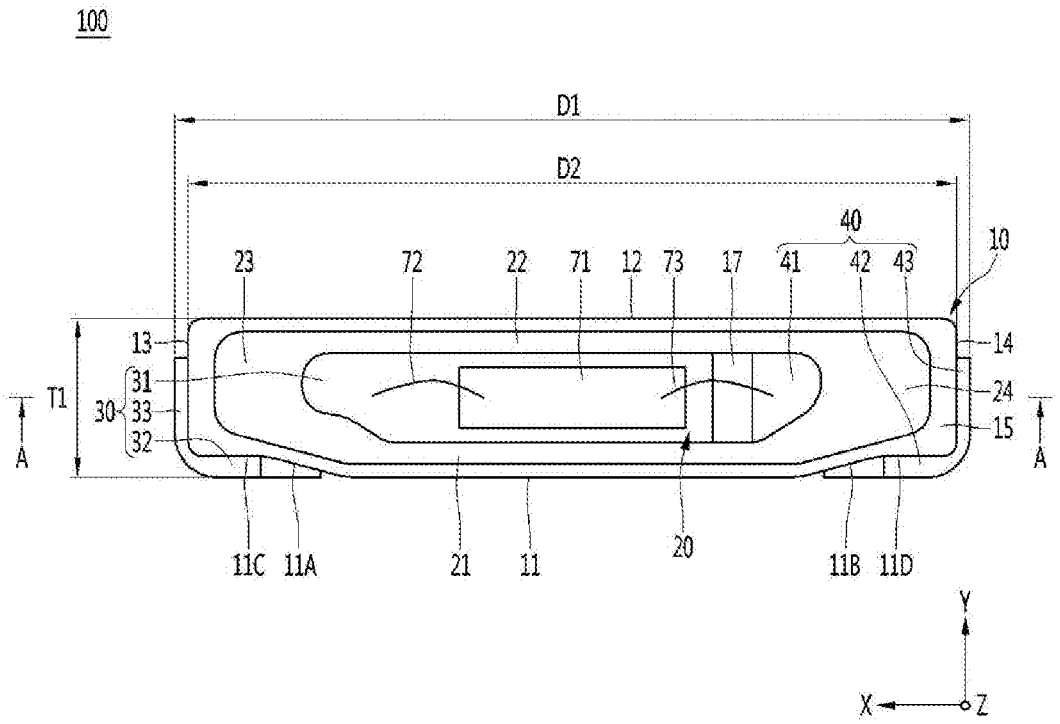
FIG. 36 is a front view of a light emitting device of a lighting module according to an embodiment.
Figure 37:
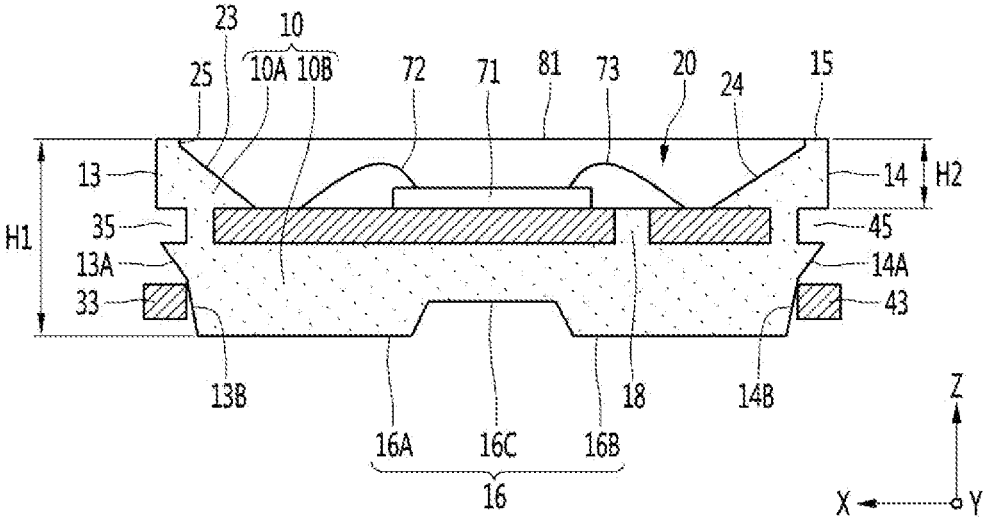
FIG. 37 is an A-A side cross-sectional view of the light emitting device of FIG. 36.

FIG. 36 is a front view of a light emitting device of a lighting module according to an embodiment, FIG. 37 is an A-A side cross-sectional view of the light emitting device of FIG. 36, FIG. 38 is a front view of the light emitting device of FIG. 36 disposed on a substrate, and FIG. 39 is other side view of the light emitting device of FIG. 36 disposed on a substrate.

Referring to FIGS. 36 and 37, the light emitting device 100 includes a body 10 having a cavity 20, a plurality of lead frames 30 and 40 in the cavity 20, and a light emitting chip 101 is disposed on at least one of the plurality of lead frames 30 and 40. The light emitting device 100 may be implemented as a side view light emitting type package.

In the light emitting device 100, a length D1 in a second direction X may be three times or more, for example, a four times or more than a thickness T1 of the third direction Z. The length D1 in the second direction X may be 2.5 mm or more, for example, in a range of 2.7 mm to 4.5 mm. As the length D1 in the second direction X of the light emitting device package 100 is provided longer, when the light emitting device 100 are arranged in the second direction X, the number of the light emitting device 100 may be reduced. The light emitting device 100 can be provided with a relatively thin thickness T1 and a thickness of a light unit having the light emitting device 100 can reduce. The thickness T1 of the light emitting device 100 may be less than or equal to 2 mm.

The length D1 in the second direction X of the light emitting device 100 may be greater than a length D2 of the body 10, and the thickness T1 may be equal to a thickness of the body 10, for example, the thickness in the third direction Z of the body 10. The length D2 of the body 10 may be three times or more than the thickness of the body 10.

The body 10 includes a first portion 10A having a cavity at a bottom thereof to which the lead frames 30 and 40 are exposed, and a second portion 10B supporting the first portion 10A. The first portion 10A may be an upper portion body or a front portion body, and the second portion 10B may be a lower portion body or a rear portion body. The first portion 10A may be a front portion region based on the lead frames 30 and 40, and the second portion 10B may be a rear region based on the lead frames 30 and 40. The first and second portions 10A and 10B may be integrally formed. The plurality of lead frames 30 and 40 such as a first lead frame 30 and a second lead frame 40 are coupled to the body 10.

The body 10 may be formed of an insulating material. The body 10 may be formed of a reflective material. The body 10 may be formed of a material having a reflectance higher than a transmittance with respect to a wavelength emitted from the light emitting chip 71, for example, a material having a reflectance of 70% or more. In the case in which the reflectance is 70% or more, the body 10 may be defined as a non-transparent material or a reflective material. The body 10 may be formed of a resin-based insulating material, for example, a resin material such as Polyphthalamide (PPA). The body 10 may be formed of a thermosetting resin including a silicone-based, epoxy-based, or plastic material, or a material having high heat resistance and high light resistance. The body 10 includes a white-based resin. In the body 10, an acid anhydride, an antioxidant, a release agent, a light reflector, inorganic filler, a curing catalyst, a light stabilizer, a lubricant, and titanium dioxide may be selectively added. The body 10 may be formed of at least one selected from the group consisting of an epoxy resin, a modified epoxy resin, a silicone resin, a modified silicone resin, an acrylic resin, and a urethane resin. For example, an epoxy resin composed of triglycidyl isocyanurate, hydrogenated bisphenol A diglycidyl ether, etc. and an acid anhydride composed of hexahydrophthalic anhydride, 3-methylhexahydrophthalic anhydride, 4-methylhexahydrophthalic anhydride, etc. are added with 1,8-diazabicyclo (5,4,0) undecene-7 (DBU) as a curing agent, ethylene glycol as a co-catalyst, titanium oxide pigment, and glass fiber in the epoxy resin, and thus, a solid epoxy resin composition which is partially cured by heating and B stated may be used but the present invention is not limited thereto. The body 10 may be formed by suitably mixing at least one selected from the group consisting of a dispersant, a pigment, a fluorescent material, a reflective material, a light shielding material, a light stabilizer, and a lubricant in a thermosetting resin.

The body 10 may include a reflective material, such as a resin material in which a metal oxide is added, and the metal oxide may include at least one of $TiO_2$, $SiO_2$, and $Al_2O_3$Such a body 10 may effectively reflect incident light. As another example, the body 10 may be formed of a resin material having a translucent resin material or a phosphor material converting a wavelength of incident light.

Side surfaces of the body 10 may include a first side portion 11 and a second side portion 12 opposite to the first side portion 11, and third and fourth side portions 13 and 14 adjacent to the first and second side portions 11 and 12 and disposed opposite to each other. The first and second side portions 11 and 12 are opposite to each other with respect to the third direction Z of the body 10, and the third and fourth side portions 13 and 14 may be opposite to each other with respect to the second direction X. The first side portion 11 may be a bottom of the body 10, the second side portion 12 may be an upper surface of the body 10, the first and second side portions 11 and 12 may be a long side surface having the length D2 of the body 10, and the third and fourth side portions 13 and 14 may be a short side surface having a thickness which is smaller than the thickness T1 of the body 10. The first side portion 11 may be a side surface corresponding to a circuit board.

The body 10 may include the front side portion 15 and the rear side portion 16, and the front side portion 15 may be a surface in which the cavity 20 is disposed, and may be a surface from which light is emitted. The front side portion 15 may be a front surface portion of the body 10. The rear side portion 16 may be the opposite side surface of the front side portion 15. The rear side portion 16 may be a rear surface portion of the body 10. The rear side portion 16 may include a first rear side portion 16A and a second rear side portion 16B, and a gate portion 16C between the first rear side portion 16A and the second rear side portion 16B. The gate portion 16C may be recessed between the first and second rear side portions 16A and 16B in a cavity direction than the first and second rear side portions 16A and 16B.

The first lead frame 30 includes a first lead portion 31 disposed at the bottom of the cavity 20, a first bonding portion 32 disposed on a first outer regions 11A and 11C of the first side portion 11 of the body 10, and a first heat radiating portion 33 disposed on the third side portion 13 of the body 10. The first bonding portion 32 is bent from the first lead portion 31 disposed in the body 10 and protrudes to the first side portion 11, and the first heat radiating portion 33 may be bent from the first bonding portion 32. The first outer regions 11A and 11C of the first side portion 11 may be a region adjacent to the third side portion 13 of the body 10.

The second lead frame 40 includes a second lead portion 41 disposed on the bottom of the cavity 20, a second bonding portion 42 disposed on second outer regions 11B and 11D of the first side portion 11 of the body 10, and a second heat radiating portion 43 disposed on the fourth side portion 14 of the body 10. The second bonding portion 42 is bent from the second lead portion 41 disposed in the body 10 and the second heat radiating portion 43 may be bent from the second bonding portion 42. The second outer regions 11B and 11D of the first side portion 11 may be a region adjacent to the fourth side portion 14 of the body 10.

A gap portion 17 between the first and second lead portions 31 and 41 may be formed of a material of the body 10 and may be the same horizontal surface with the bottom of the cavity 20 or may protrude, but the invention is not limited thereto. The first outer regions 11A and 11C and the second outer regions 11B and 11D has an inclined regions 11A and 11B and a flat regions 11C and 11D. The first and second bonding portions 32 and 42 of the first and second lead frames 30 and 40 may protrude through the inclined regions 11A and 11B, but the invention is not limited thereto.

Here, the light emitting chip 71 may be disposed on, for example, the first lead portion 31 of the first lead frame 30. The light emitting chip 71 may be connected to the first and second lead parts 31 and 41 by wires 72 and 73, or the light emitting chip 71 may be adhesively connected to the first lead part 31 and connected to the second lead part 41 by wire. The light emitting chip 71 may be a horizontal chip, a vertical chip, or a chip having a via-structure. The light emitting chip 71 may be mounted in a flip chip manner. The light emitting chip 71 may selectively emit light within a wavelength range of an ultraviolet ray to a visible ray. The light emitting chip 71 may emit ultraviolet light or a blue peak wavelength, for example. The light emitting chip 71 may include at least one of a group II-VI compound and a group III-V compound. The light emitting chip 71 may be formed of a compound selected from the group consisting of GaN, AlGaN, InGaN, AlInGaN, GaP, AN, GaAs, AlGaAs, InP and mixtures thereof. The light emitting chip 71 may be disposed in the cavity 20 in one or more. The plurality of light emitting chips 71 may be disposed on at least one of the first lead frame 30 and the second lead frame 40.

In an inner side of the cavity 20, first, second, third and fourth inner sides 21, 22, 23 and 24 disposed around the cavity 20 may be inclined with respect to a horizontal straight line of an upper surface of the lead frames 30 and 40. A first inner side 21 adjacent to the first side portion 11 and a second inner side 22 adjacent to the second side portion 12 is inclined at an angle to the bottom of the cavity 20, and a third inner side 23 adjacent to the third side portion 13 and a fourth inner side 24 adjacent to the fourth side portion 14 may be inclined at an angle smaller than the inclination angle of the first and second inner sides 21 and 22. Accordingly, the first and second inner sides 21 and 22 reflect the progress of the incident light toward the first direction Y, and the third and fourth inner sides 23 and 24 may diffuse the incident light in the second direction X.

The inner side surfaces 21, 22, 23 and 24 of the cavity 20 may have a stepped region 25 vertically stepped from the front side portion 15 of the body 10. The stepped region 25 may be disposed to be stepped between the front side portion 15 of the body 10 and the inner sides 21, 22, 23 and 24. The stepped region 25 may control the directivity characteristic of the light emitted through the cavity 20.

As shown in FIG. 37, a depth H2 of the cavity 20 may be ⅓ or less of a width H1 of the body 10, for example, may be in a range of 0.3 mm±0.05 mm. In the case in which the depth H2 of the cavity 20 is less than the above range, it is difficult to control the directivity angle of light, and in the case of exceeding the above range, there is a problem that the width H1 of the body 10 is increased or the light directing angle is narrowed.

Here, the width H1 of the body 10 may be an interval between the front side portion 15 and the rear side portion 16 of the body 10. Here, the width H1 of the body 10 may be greater than the thickness T1 of the body 10, and the difference between the width H1 and the thickness T1 of the body 10 may be 0.05 mm or more, for example, in a range of 0.05 mm to 0.5 mm, and in the case in which the thickness T1 of the body 10 is greater than the difference, the thickness of the light unit may be increased, and in the case of being smaller than the above range, the heat radiation area of the lead frames 30 and 40 may be reduced.

The third and fourth side portions 13 and 14 of the body 10 may have a concave portions 35 and 45 recessed inwardly, and fingers supporting the body 10 may be inserted into the concave portions 35 and 45 during the injection process of the body 10. The concave portions 35 and 45 may be disposed on extension line extended parallel with the first and second lead portions 31 and 41 of the first and second lead frames 30 and 40. The concave portions 35 and 45 may be disposed to be spaced apart from the first and second lead portions 31 and 41. A depth of the concave portions 35 and 45 may be formed in a depth through which a portion of the concave portions 35 and 45 may be overlapped with the cavity 20, for example, a portion of the cavity 20 in a vertical direction, but it is not limited thereto.

A rear receiving region of the third and fourth side portions 13 and 14 of the body 10 include first regions 13A and 14A inclined from the third side portion 13 and the fourth side portion 14, and second regions 13B and 14B inclined from the first regions 13A and 14A.

The light emitting chip 71 disposed in the cavity 20 of the light emitting device 100 according to the embodiment may be provided singularly or in plural. The light emitting chip 71 may be selected from, for example, a red LED chip, a blue LED chip, a green LED chip, and a yellow green LED chip.

A molding member 81 is disposed in the cavity 20 of the body 10, and the molding member 81 includes a light transmitting resin such as silicone or epoxy and may be formed in a single layer or multiple layers. A phosphor may be included on the molding member 81 or the light emitting chip 71 for changing the wavelength of emitted light, and the phosphor excites a part of the light emitted from the light emitting chip 71 and emits the excited light as light of a different wavelength. The phosphor may be selectively formed from a quantum dot, a YAG, a TAG, a silicate, a nitride, and an oxy-nitride-based material. The phosphor may include at least one of a red phosphor, a yellow phosphor, and a green phosphor, but the invention is not limited thereto. The surface of the molding member 61 may be formed in a flat shape, a concave shape, a convex shape, or the like, but is not limited thereto. As another example, a translucent film having a phosphor may be disposed on the cavity 20, but the present invention is not limited thereto.

A lens may be further formed on the body 10, and the lens may include a concave and/or convex lens structure and may adjust the light distribution of the light emitted from the light emitting device 100.

A semiconductor device such as a light receiving device or a protection device may be mounted on the body 10 or any one of the lead frames, and the protection device may be implemented as a thyristor, a Zener diode, or a TVS (Transient Voltage Suppression), and the Zener diode protects the light emitting chip 71 from electrostatic discharge (ESD).

Referring to FIGS. 38 and 39, at least one or a plurality of light emitting device packages 100 is disposed on the substrate 201. The substrate 201 includes a board on which a circuit pattern is printed on an insulating layer, and may include, for example, a resin-based printed circuit board (PCB), a metal core PCB, a flexible PCB, a ceramic PCB, and an FR-4 substrate.

The first and second lead portions 33 and 43 of the light emitting device 100 are bonded to electrode patterns 213 and 215 of the substrate 201 with solder or a conductive tape which is conductive bonding members 203 and 205.

Figure 40:
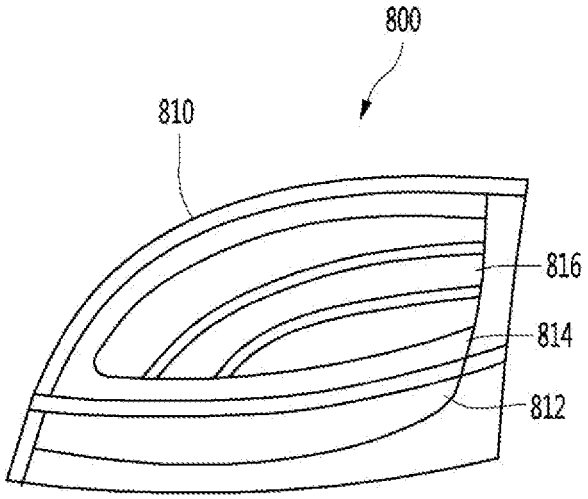
FIG. 40 is a view illustrating a vehicle lamp having a lighting device according to an embodiment.
Figure 41:
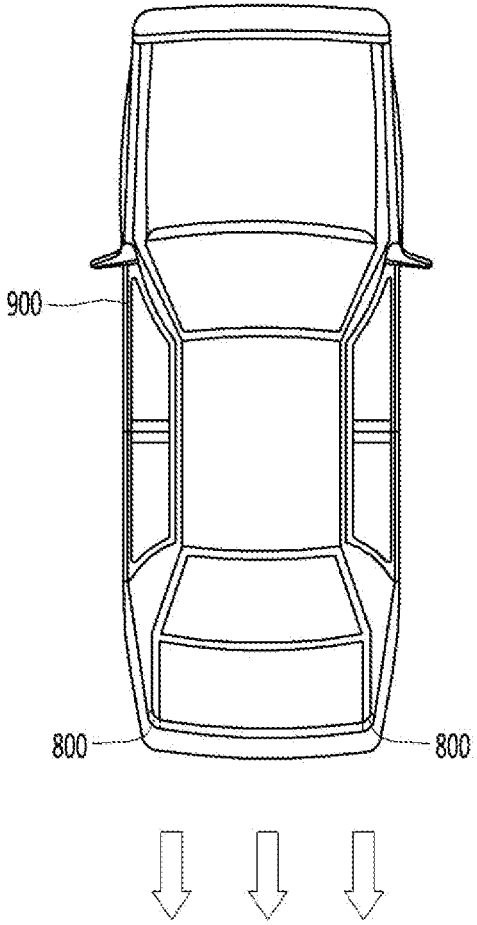
FIG. 41 is a plan view of a vehicle to which the vehicle lamp of FIG. 40 is applied.

FIGS. 40 and 41 are a views showing of a vehicle lamp to which the lighting module or a lighting device according to the embodiment is applied.

Referring to FIGS. 40 and 41, a taillight 800 in a vehicle 900 may include a first lamp unit 812, a second lamp unit 814, a third lamp unit 816, and a housing 810. Here, the first lamp unit 812 may be a light source serving as a turn signal lamp, the second lamp unit 814 may be a light source serving as a side marker lamp, and the third lamp unit 816 may be a light source serving as a stop lamp, but is not limited thereto. At least one or all of the first to third lamp units 812, 814, and 816 may include the lighting module disclosed in an embodiment.

The housing 810 accommodates the first to third lamp units 812, 814, and 816, and may be made of a light transmitting material. At this point, the housing 810 may have a curve according to a design of a vehicle body, and the first to third lamp units 812, 814, and 816 may have a curved surface light source according to a shape of the housing 810. Such a vehicle lamp may be applied to a turn signal lamp of a vehicle when the lamp unit is applied to a tail lamp, a stop lamp, or a turn signal lamp of a vehicle.

Here, in a safety standard of the vehicle lamp, when the light is measured with reference to the front light, the light distribution standard of the tail lamp is in a range of 4 to 5 candelas (cd), the light distribution standard of the brake lamp is in a range of 60 to 80 candelas (cd). As shown in FIGS. 22 and 23, the lighting module according to the embodiment can be provided with luminous intensity within the vehicle safety standard of the lamp such as the brake lamp, the tail lamp, or the like, since it is luminous with a luminous flux having a candelas higher than a vehicle safety standard.

The characteristics, structures and effects described in the above-described embodiments are included in at least one embodiment but are not limited to one embodiment. Furthermore, the characteristic, structure, and effect illustrated in each embodiment may be combined or modified for other embodiments by a person skilled in the art. Thus, it would be construed that contents related to such a combination and such a modified example are included in the scope of the invention.

In addition, embodiments are mostly described above. However, they are only examples and do not limit the invention. A person skilled in the art may appreciate that several variations and applications not presented above may be made without departing from the essential characteristics of the embodiments. For example, each component particularly represented in the embodiments may be varied. In addition, it should be construed that differences related to such a variation and such an application are included in the scope of the invention defined in the following claims.

INDUSTRIAL APPLICABILITY

The invention can be used for the lighting module or the lighting apparatus to provide a light source having a surface light source or a constant line width.

The lighting module or the lighting apparatus of the invention may be used for various lamps.

The lighting module or the lighting apparatus of the invention can be used in a vehicle lamp.

The invention claimed is:

1. A lighting module comprising:

a light emitting device; and a reflector disposed in a front direction of the light emitting device, wherein the reflector includes a first edge adjacent to the light emitting device and a second edge opposite to the first edge, wherein the reflector includes a plurality of first convex portions arranged in a first direction from the first edge to the second edge, wherein the light emitting device includes a front portion having an emission surface for emitting light toward the reflector, a rear portion opposite the front portion, and a plurality of side portions disposed around the front portion, and wherein the rear portion and the side portions are formed of a body of reflective material.

2. The lighting module of claim 1, wherein a first edge of the plurality of first convex portions is disposed lower than an optical axis passing through a center of the emission surface of the light emitting device, and wherein a second edge of the plurality of first convex portions is disposed highest among the first convex portions.

3. The lighting module of claim 1, wherein the reflector includes a plurality of second convex portions and a third convex portions arranged in the first direction, and wherein each of the plurality of first convex portions is disposed between each of the plurality of second convex portions and each of the plurality of third convex portions.

4. The lighting module of claim 3, wherein a first edge of the plurality of first convex portions is disposed lower than an optical axis passing through a center of the emission surface of the light emitting device, wherein a second edge of the plurality of first convex portions is disposed highest among the first convex portions, wherein a first edge of the plurality of second convex portions has a higher end than one end adjacent to the first edge of the plurality of first convex portions, and wherein a first edge of the plurality of third convex portions has a higher end than one end adjacent to the first edge of the plurality of first convex portions.

5. The lighting module of claim 4, wherein the second edge of the plurality of second convex portions has a higher end than one end adjacent to the second edge of the plurality of first convex portions, and wherein a second edge of the plurality of third convex portions has a higher end than one end adjacent to the second edge of the plurality of first convex portions.

6. The lighting module of claim 1, comprising:

a plurality of first bridge portions disposed between each of the plurality of first convex portions and connecting adjacent first convex portions to each other.

7. The lighting module of claim 3, comprising:

a plurality of first bridge portions respectively disposed between the plurality of first convex portions, each between the plurality of second convex portions and each between the plurality of third convex portions, and a plurality of second bridge portions respectively disposed between the plurality of first convex portions and the plurality of second convex portions and between the plurality of first convex portions and the plurality of third convex portions.

8. The lighting module of claim 7, wherein each of the plurality of first bridge portions includes an inclined surface, wherein each of the plurality of second bridge portions includes an inclined surface, wherein the plurality of first bridge portions and the plurality of second bridge portions including a reflective surface crossing each other.

9. The lighting module of claim 7, wherein the first bridge portions respectively disposed between the plurality of second convex portions have one end adjacent to the first convex portions lower than the other end of an outer side, wherein the first bridge portions respectively disposed between the plurality of third convex portions have one end adjacent the first convex portions lower than the other end of an outer side.

10. The lighting module of claim 8, wherein a width of each of the first bridge portions in the first direction and a width of each of the second bridge portions in a second direction are 0.2 mm or more, wherein a width of each of the first convex portions in the first direction is in a range of 2 mm to 15 mm, wherein a length of each of the first convex portions in the second direction is smaller than the width of the first direction, and wherein each of the second convex portions and each of the third convex portions are disposed in a region that does not overlap with the light emitting device in a direction from the front portion to the rear portion.

11. A lighting module comprising:

a substrate;

a light emitting device disposed on the substrate; and a reflector disposed in a front direction of the light emitting device, wherein each of the reflector includes a first edge adjacent to the light emitting device and a second edge opposite to the first edge, wherein the reflector includes a plurality of first convex portions arranged in a first direction from the first edge to the second edge, wherein the light emitting device includes a front portion having an emission surface for emitting light toward the reflector, a rear portion opposite the front portion, and a plurality of side portions disposed around the front portion, and wherein the rear portion and the side portions are formed of a body of reflective material body.

12. The lighting module of claim 11, comprising:

an air gap between the substrate and the second edge of the reflector.

13. The lighting module of claim 11, wherein the reflector has a height gradually higher toward the second edge from the first edge adjacent to the light emitting device.

14. The lighting module of claim 11, comprising:

a bridge portion having an inclined surface around the plurality of first convex portions, wherein the plurality of first convex portions have a convex curved surface, and wherein the plurality of first convex portions is arranged in a matrix.

15. The lighting module of claim 11, wherein a first edge of the plurality of first convex portions is disposed lower than an optical axis passing through a center of the emission surface of the light emitting device, and wherein a second edge of the plurality of first convex portions is disposed highest among the first convex portions.

16. The lighting module of claim 11, wherein the reflector includes a plurality of second convex portions and a plurality of third convex portions arranged in the efirst direction, wherein each of the plurality of first convex portions is disposed between each of the plurality of second convex portions and each of the plurality of third convex portions, wherein a first edge of the plurality of first convex portions is disposed lower than an optical axis passing through a center of the emission surface of the light emitting device, wherein a second edge of the plurality of first convex portions is disposed highest among the first convex portions, wherein a first edge of the plurality of second convex portions has a higher end than one end adjacent to the first edge of the first convex portions, and wherein a first edge of the plurality of third convex portions has a higher end than one end adjacent to the first edge of the first convex portions.

17. The lighting module of claim 16, wherein the second edge of the plurality of second convex portions has a higher end than one end adjacent to the second edge of the first convex portions, wherein the second edge of the plurality of third convex portions has a higher end than one end adjacent to the second edge of the first convex portions.

18. The lighting module of claim 14, comprising:

an open region between the light emitting device and a first edge of the bridge portion.

19. The lighting module of claim 18, wherein the open region has a recess deeper in a direction of an optical axis of the light emitting device.

20. The lighting module of claim 18, wherein the open region has a length in a second direction greater than a length in the first direction, wherein the length of the open region in the second direction is greater than a length of the light emitting device in the second direction.

* * * * *